US005577782A

United States Patent [19]

Johnson et al.

[11] Patent Number: 5,577,782

[45] Date of Patent: Nov. 26, 1996

[54] DOOR LATCH WITH DOUBLE LOCKING ANTITHEFT FEATURE

[75] Inventors: James B. Johnson, Gregory; Andrew J. Barta, Westland; Michael A. Petik, Brighton, all of Mich.

[73] Assignee: Stoneridge, Inc., Warren, Ohio

[21] Appl. No.: 570,537

[22] Filed: Dec. 11, 1995

Related U.S. Application Data

[63] Continuation-in-part of Ser. No. 137,448, Oct. 15, 1993, Pat. No. 5,474,339.

[51] Int. Cl.[6] ..... E05C 3/16

[52] U.S. Cl. ..... 292/216; 292/201; 292/DIG. 23; 292/DIG. 27

[58] Field of Search ..... 292/216, DIG. 27, 292/DIG. 23, 201, 336.3

[56] References Cited

U.S. PATENT DOCUMENTS

| | | | |
|---|---|---|---|
| 4,342,209 | 8/1982 | Kleefeldt | 70/264 |
| 5,078,436 | 1/1992 | Kleefeldt et al. | 292/201 |
| 5,100,185 | 3/1992 | Menke et al. . | |

*Primary Examiner*—Rodney M. Lindsey
*Attorney, Agent, or Firm*—MacMillan, Sobanski & Todd

[57] ABSTRACT

A vehicle door latch assembly including a pivotal rotor engagable with a striker pin. A pawl is moveable between a blocking position retaining the rotor in engagement with the striker pin, and a release position permitting the rotor to disengage the striker pin. A link is moveable, manually or by means of an electric motor, between a coupled position engaging the pawl and an uncoupled position disengaged from the pawl. The link also engages an actuator member when the link is in the coupled position and is disengaged from the actuator member in the uncoupled position. The actuator member may be operated, when the link is in the coupled position, to move the pawl to the release position by means of the link. A Bowden cable may be connected to an interior operating handle, the link, and the actuator member to permit locking, unlocking, and unlatching from a single operating handle. A lost motion connection may be provided which cooperates with an over-center spring to improve the feel of the operation of the lock of the latch assembly from the interior operating handle. In another embodiment, a single lever is connected to the Bowden cable to be pivoted thereby to selectively cause the link to rotate between the coupled and uncoupled positions, and to axially drive the link to place the latch assembly in the unlatched condition.

13 Claims, 23 Drawing Sheets

FIG. 6
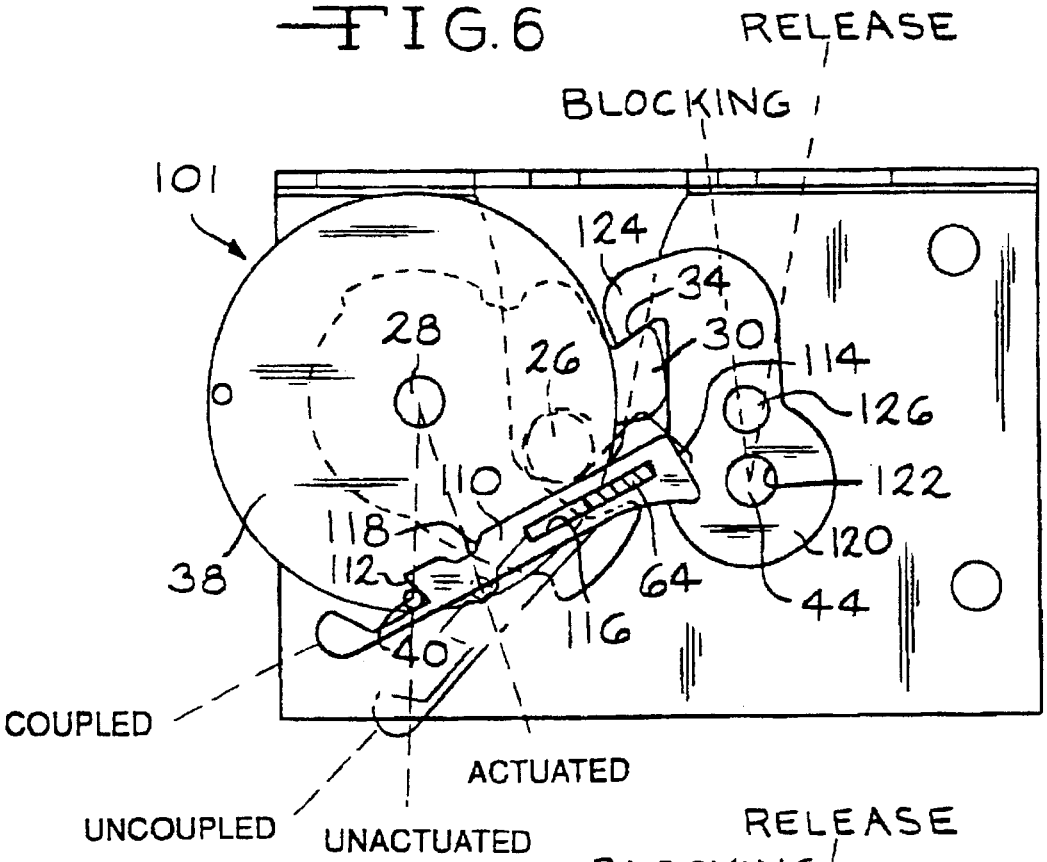
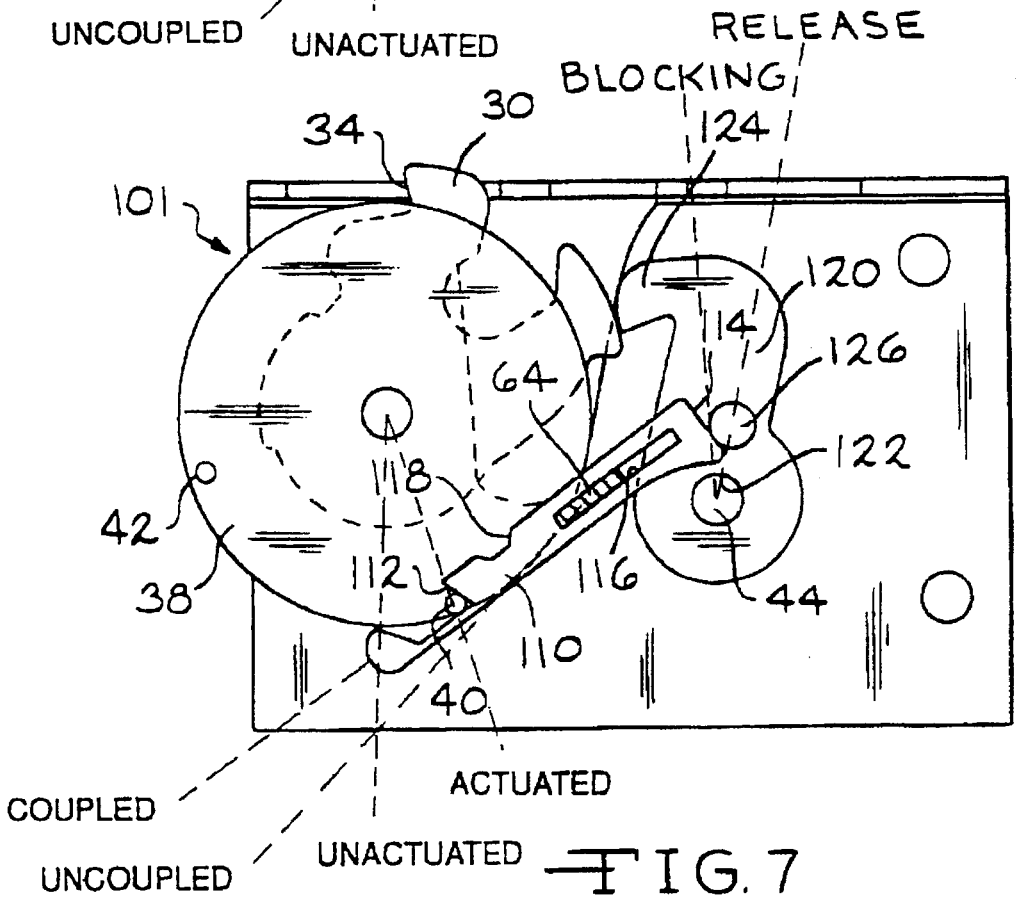
FIG. 7

290
260
259a
259
259b
292
269
272
270a
270b
270
288
270a
212c
244
212e
212a
212d
212
212d
212b
243
256b
258
242
238
268
256
257
254a
238b
256a
238a
276
256c
254b
238c
254
255
254d
278
254c
267
245c
240
265b
245
245b
245a
228c
228a
265a
265
266
266a
228b
265c
266c
250
274a
266b
228
236
274
248
284a
210a
246
274b
284f
264
230
284b
284e
210d
210e
284d
210
210b
252
234
284
263a
232
218c
284c
216c
218b
282
263
262
218a
280b
201
214
280
280a
280c
216
216a
216b
220
216d
224
218d
218

DOOR LATCH WITH DOUBLE LOCKING ANTITHEFT FEATURE

CROSS REFERENCE TO RELATED APPLICATION

This application is a continuation-in-part of application Ser. No. 08/137,448 filed on Oct. 15, 1993, now U.S. Pat. No. 5,474,339 and assigned to the assignee of this application.

BACKGROUND OF THE INVENTION

This invention relates in general to electrically actuated latch assemblies and, in particular, to an improved structure for an electrically actuated vehicle door latch having a double locking antitheft feature.

Vehicles such as passenger cars are commonly equipped with individual latch assemblies which secure respective passenger and driver doors. Each latch assembly is typically provided with manual latch actuating mechanisms for unlatching the latch assembly from outside and inside the vehicle, e.g., respective outer and inner door handles. Each latch assembly is also typically provided with an individual mechanical lock which may be provided with a key operated locking mechanism for operating the lock from the exterior of the vehicle and provided with manual locking mechanism for operating inside the vehicle, e.g., a respective sill button. Further, these locks are commonly provided with a locking mechanism for remote operation, such as an electrically operated mechanism for actuating the lock.

As is commonly known, the lock may be actuated to prevent release of the latch assembly. On vehicles with an interior manual locking mechanism, a thief may break a window of the vehicle and reach inside to manually unlock the latch assembly. It has therefore been proposed to provide a latch assembly having a "double lock" feature by which the interior manual locking mechanism may be selectively disabled when the occupant exits the vehicle. A vehicle having latch assemblies thus equipped with a double lock feature would be a less attractive target for thieves.

Generally, such a double lock feature has been provided by blocking latch assembly components from moving from a locked position to an unlocked position when the latch assembly is double locked. As described in U.S. Pat. No. 4,342,209 to Kleefeldt and U.S. Pat. No. 4,669,283 to Ingehoven, the double lock position is set by an electric motor actuator having a motor whose output shaft is a spindle on which is threaded a nut that acts to block the inside lock element in the locked position. Thus the structure must be strong enough to withstand whatever force a would-be thief is willing to apply. Hence, the elements must be made fairly robust and, therefore, are expensive to manufacture. Additionally, the latch mechanism can only be reset out of the double lock position by the electric motor. Thus if the vehicle's electric power fails while the latch assembly is double locked, even an authorized operator with the correct key will be locked out.

A second method for providing a double lock feature is described in U.S. Pat. No. 5,078,436 to Kleefeldt et al. As described therein, in the locked condition a coupling pin is moved to an uncoupled position. This uncouples an operating arm of the latch operating mechanism from an actuating lever which must be operated to unlatch the assembly. Double locking of the latch assembly is accomplished by an electric motor actuator having a motor whose output shaft is a spindle on which is threaded a nut that acts to move a two-part antitheft lever into a double lock position which blocks the coupling pin in the uncoupled position. If the vehicle's electric power fails, an outside key cylinder may be operated to move the blocking part of the antitheft lever into an unblocking position, allowing the latch assembly to be unblocked. However, only the electric motor actuator can move the two-part antitheft lever into the double lock position. Additionally, the assembly relies on a blocking action to keep the antitheft lever in the double lock position. Thus, again, the structure must be strong enough to to withstand whatever force a would-be thief is willing to apply. Hence, the elements must be made fairly robust and, therefore, are more expensive to manufacture.

SUMMARY OF THE INVENTION

This invention relates to an improved structure for a vehicle door latch assembly wherein locking and double locking are accomplished by uncoupling components thereof. In particular, the latch assembly includes a lock mechanism which may be actuated between a locked and unlocked condition. The latch assembly is adapted to be mounted to a motor vehicle structure to engage a striker pin fixed to the motor vehicle. The latch assembly includes a pivotal rotor engagable with the striker pin to secure the vehicle door shut. A pawl is operatively coupled to the rotor and moveable between a blocking position retaining the rotor in engagement with the striker pin, and a release position permitting the rotor to disengage the striker pin. A link is operatively coupled to the pawl. The link engages the pawl in a coupled position, and is selectively moveable between the coupled position and an uncoupled position in which the link is disengaged from the pawl. An actuator member is operatively coupled to the link and engages the link when the link is in the coupled position. The actuator member is disengaged from the link when the link is in the uncoupled position. The actuator member is selectively moveable between an unactuated position and an actuated position in which the actuator member causes, when the link is in the coupled position, the link to move the pawl to the release position.

In one embodiment, a double lock feature is provided for the latch assembly. A lock/unlock lever is operatively coupled to the link, to a first fork, and to a second fork. When engaged with the lock/unlock lever, the first fork and the second fork may be selectively moved to drive the lock/unlock lever to urge the link between the coupled and the uncoupled positions. The first fork may be operated to move the lock/unlock lever into a double lock position in which the lock/unlock lever is disengaged from the second fork, and the link is disengaged from the pawl and the actuator member.

Various objects and advantages of this invention will become apparent to those skilled in the art from the following detailed description of the preferred embodiment, when read in light of the accompanying drawings.

BRIEF DESCRIPTION OF THE DRAWINGS

FIG. 6 is a view similar to that of FIG. 4 illustrating a second embodiment of the latch assembly in a latched condition.

FIG. 7 is a view similar to that of FIG. 6 illustrating the latch assembly in an unlatched position.

DETAILED DESCRIPTION OF THE PREFERRED EMBODIMENT

Figure 1:
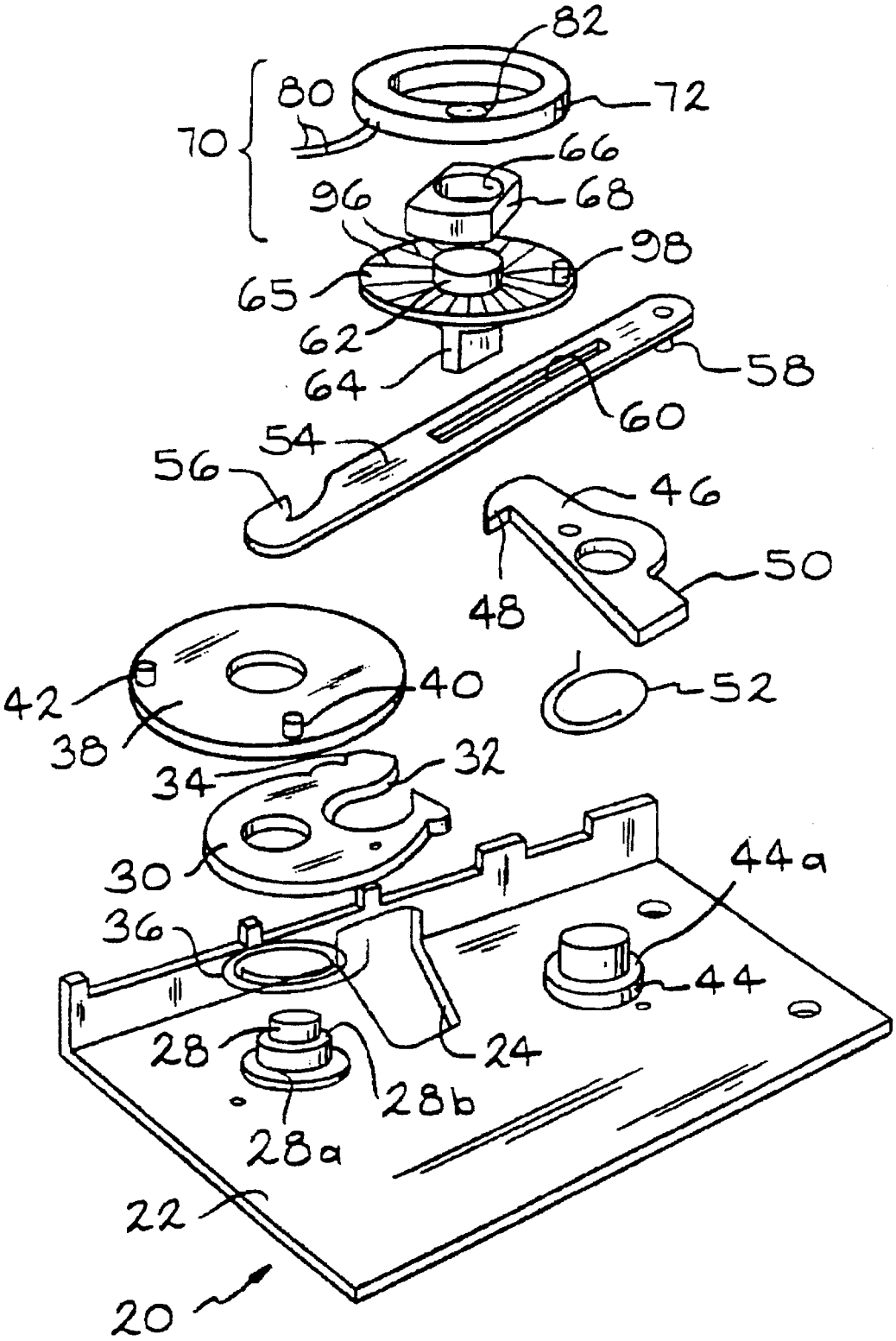
FIG. 1 is an exploded perspective view of one embodiment of the latch assembly of this invention and which does not include a double lock feature.

In the following description of the invention, certain terms will be utilized for the purpose of reference only and are not intended to be limiting. The terms "upward", "downward", "above", "below", "rightward", "leftward", "clockwise", and "counterclockwise" refer to directions in the drawings to which reference is made. The terms "inward" and "outward", refer to directions toward and away from, respectively, the geometric center of the device described. Such terminology will include the words specifically mentioned above, derivatives thereof, and words of similar import.

Referring now to the drawings, there is illustrated in FIG. 1 a latch assembly, indicated generally at 20, which has a frame 22. The frame 22 is adapted to be secured to a first structure, for example, the edge of a vehicle door (not shown). The frame 22 is formed with a laterally extending notch 24, the inner edges of which converge inwardly and diverge outwardly. The notch 24 is adapted to receive a striker bolt 26 (FIG. 4) secured to a second structure, such as a doorpost (not shown) of a vehicle when the vehicle door is closed. Those of ordinary skill in the art will appreciate that the latch assembly 20 may be arranged other than as described above. For example, the latch assembly 20 may be mounted on a doorpost and mate with a striker bolt 26 mounted to move with a door.

Figure 3:
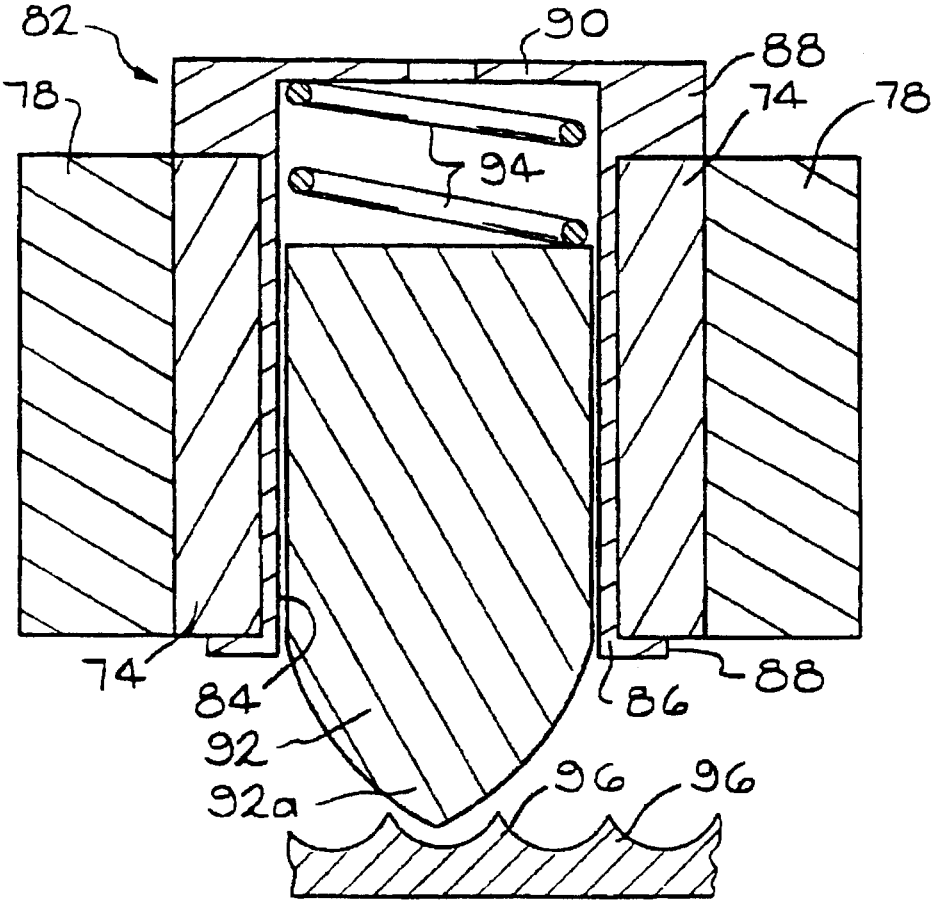
FIG. 3 is an enlarged sectional view taken along the line 3—3 of FIG. 2, illustrating an electrically actuated detent.

The frame includes a first upright stepped pin 28 fixed thereto, spaced apart from the notch 24. The stepped pin 28 is provided with at least a first step **28*a* and a second step 28*b*. A rotor 30 is pivotally mounted on the pin 28, and bears against the step 28*a*. The step 28*a* acts to space the rotor 30 apart from the frame 22. The rotor 30 includes a notch 32, and a retaining step 34. As will be further described below with reference to FIG. 3, the rotor 30 (in a latched position) receives the striker bolt 26 within the notch 32, which cooperates with the notch 24 formed in the frame 22 to retain the striker bolt 26. In unlatching the latch assembly 20 (FIG. 4), the rotor 30 rotates counterclockwise to an unlatched position in which the notch 32 is aligned with the notch 24 to permit the striker bolt 26** to be released.

The rotor is biased in a counterclockwise direction (toward the unlatched position) by a spring 36. One end of the spring 36 engages the frame 22, while an opposite end engages the rotor 30. The spring 36 may be conventionally formed of a suitable material such as music wire.

An actuator member 38 is pivotally mounted on the pin 28, and is provided to adapt the motion of the vehicle's latch actuating mechanism (not shown) to the latch assembly. The actuator member 38 bears against the step 28*b*, which acts to space the actuator member 38 from the rotor 30. The actuator member 38 includes a pin or tab 40 extending upwardly from the upper surface thereof, the purpose of which will be explained below. The actuator member 38 is also provided with a second upwardly extending tab 42 or other feature for connecting the actuator member 38 to the latch actuating mechanism. As will be further explained below, the latch actuating mechanism may be selectively operated to drive against the tab 42 so as to cause the actuator member 38 to pivot about the pin 28. The actuator member 38 can be formed of a stamped steel. The tabs 40 and 42 are preferably integrally formed with the actuator member 38.

The frame is provided with a second upright stepped pin 44, spaced apart from the notch 24 and the first stepped pin 28. The stepped pin 44 is provided with at least a first step 44*a*. A pawl 46 is pivotally mounted on the pin 44. The pawl 46 bears against the step 44*a*, which acts to space the pawl 46 from the frame 22. The pawl 46 includes a hook 48 formed on one end thereof extending toward the rotor 30. A bearing surface 50 is formed on the opposite end of the pawl 46 from the hook 48.

As will be further explained below, the pawl 46 is adapted to be pivoted between a blocking position (shown in FIG. 4) and a release position (shown in FIG. 5). In the blocking position, the hook 48 is adapted to engage the retaining step 34 on the rotor 30 to retain the rotor 30 in the latched position. When the pawl 46 is in the release position, the hook 48 is disengaged from the retaining step 34, permitting the rotor 30 to rotate to the unlatched position.

The load bearing components described above (i.e., all the above describe components except the spring 36 and the actuator 38) may be subjected to impact stresses during a vehicle collision. As is well known, an occupant of a vehicle is normally safer during a collision inside the vehicle than if ejected from the vehicle. Thus, the load bearing components of the latch assembly 20 should be designed to withstand these impact stresses to keep the vehicle door latched closed during a collision. Therefore, the frame 22, the stepped pins 28 and 44, the rotor 30, the pawl 46, and the striker bolt 26 are formed of suitable materials selected for strength and toughness as well as low cost, preferably a metal such steel.

One end of a spring 52 engages the frame 22. A second end of the spring 52 engages the pawl 46. Thus engaged, the spring 52 acts to urge the pawl 46 to pivot counterclockwise from the release position to the blocking position. The spring 52 may be conventionally formed of a suitable material such as music wire.

An elongate link 54 is provided with a tab or hook 56 at one end thereof and a depending tab 58 at the other end thereof. An axially extending slot 60 is formed in the link 54 intermediate the hook 56 and the tab 58. The link 54 is operatively coupled to both the pawl 46 and the actuator member 38. In a manner to be described below, the link 54 is adapted to be pivoted between a coupled position and an uncoupled position. When the actuator 38 is in its unactuated position, the link 54 may be rotated clockwise to a coupled position to cause the hook 56 to engage the tab 40 on the upper surface of the actuator 38. The tab 58 on the opposite end of the link 54 engages the bearing surface 50 on the pawl 46, the tab 58 being positioned abutting or slightly spaced apart from the bearing surface 50. The link 54 can be formed of stamped steel.

A shaft 62 includes a depending tongue 64 which is received in the slot 60 of the link 54 with a slip fit. The link 54 is thus keyed to the shaft 62, such that rotation of the shaft 62 about it's axis causes the link 54 to rotate therewith between the coupled and uncoupled positions. The link 54 may be moved radially relative to the shaft 62. As the link 54 is moved relative to the axis of the shaft 62, the pivot point of the link 54 moves correspondingly along the slot 60. A circumferential flange 65 is fixed to the shaft 62 for a purpose which will be explained later.

Figure 2:
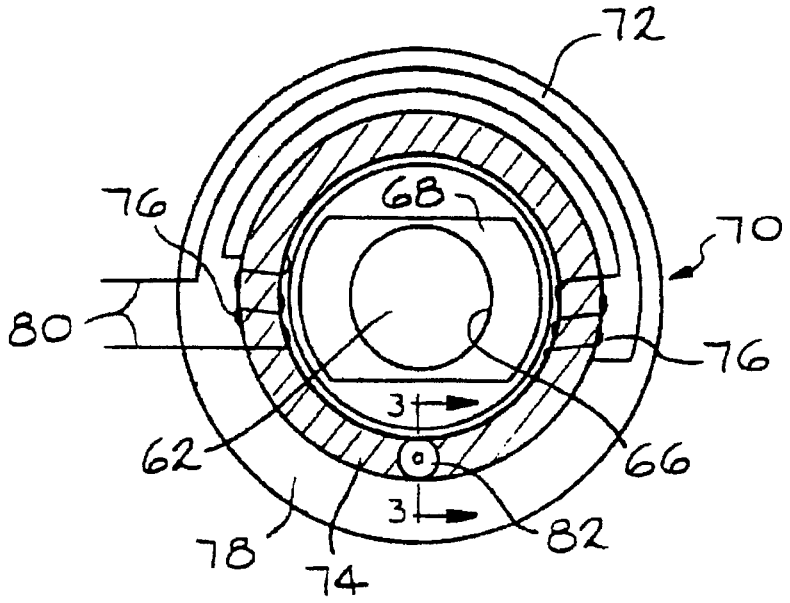
FIG. 2 is a diagrammatic plan view of the limited rotation torque motor illustrated in FIG. 1.

Referring now additionally to FIG. 2, the shaft 62 is fixed in an aperture 66 of a rotor 68 of a limited rotation torque motor, shown generally at 70. Limited rotation torque motors are known devices providing a controlled rotation of a predetermined angular magnitude. Limited rotation torque motors are available commercially from Globe Motors, a Division of Labinal Components and Systems, Inc., of Dayton, Ohio. The rotor 68 forms a permanent magnet, having a magnetic field (not shown). The rotor 68 is rotatably mounted within a stator 72 of the motor 70. The stator 72 is conventionally mounted so as to be fixed relative to the frame 22, for example by mechanical fasteners (not shown). The stator 72 has a core 74 (FIG. 2) which formed of a paramagnetic material which will have little residual magnetism. Electrical windings 76 are wrapped about the core 74 so as to form electromagnetic coils. The core 74 and the windings 76 are typically encapsulated within a housing 78.

Upon electrical energization of the windings 76 with a direct current (D.C.) flowing in a first direction through electrical leads 80, the windings 76 produce a magnetic field (not shown). The interation of the magnetic field of the windings 76 and magnetic field of the rotor 68 causes the rotor 68 to be aligned in a first position, which causes the shaft 62 and consequently the link 54 to be aligned in the uncoupled position. The windings 76 may then be deenergized.

When the windings are energized by a D.C. current flowing in a second direction, opposite to the first direction, the magnetic field produced by the windings 76 having the opposite polarity from that described above. Consequently, the rotor 68 rotates from the first position to a second position. The shaft 62 rotates therewith, pivoting the link 54 to the coupled position. The windings 76 may then be deenergized.

In the illustrated embodiment, an electrically actuated, spring loaded detent 82 is formed in the stator 72. A bore 84 is formed through the stator 72, including the core 74. A plastic sleeve 86 lines the bore 84. The sleeve 86 has outwardly extending flanges 88 at either end thereof to retain and axially position the sleeve 86 in the aperture 84. The upper end of the sleeve 86 also includes an inwardly extending flange 90. An armature 92 is slidably disposed within the sleeve 86. The lower end 92*a* of the armature 92 may be tapered into a point.

A compression spring 94 is interposed between the armature 92 and the flange 90. The spring 94 urges the armature 92 downwardly in the sleeve 86. The lower end 92*a* is thus urged into contact with the upper surface of the flange 65 on the shaft 62. Radially extending ridges 96 formed on the upper surface of the flange 65 cooperate with the spring loaded armature 92 to prevent relative rotation between the stator 72 and the shaft 62. Those in the art will appreciate that features other than the ridges 96, such as slots or apertures formed in the flange 92, may be used to permit the armature 92 to securely engage the flange 92 to prevent rotation thereof relative to the stator 72. The link 54 is keyed to the shaft 62 by the slot 60, and is thus prevented from rotation by the action of the detent 82.

A manual locking mechanism (not shown), such as an inside door sill button or an exterior key cylinder, may be directly coupled to the link 54 to permit operation thereof to selectively move the link 54 to the coupled and uncoupled positions. Preferably, however, such a manual locking mechanism will be coupled to cause the shaft 62 to rotate. A feature such as a pin or tab 98 is provided on the flange 65, by means of which the manual locking mechanism is operatively coupled to rotate the shaft 62, and thus the link 54.

Figure 4:
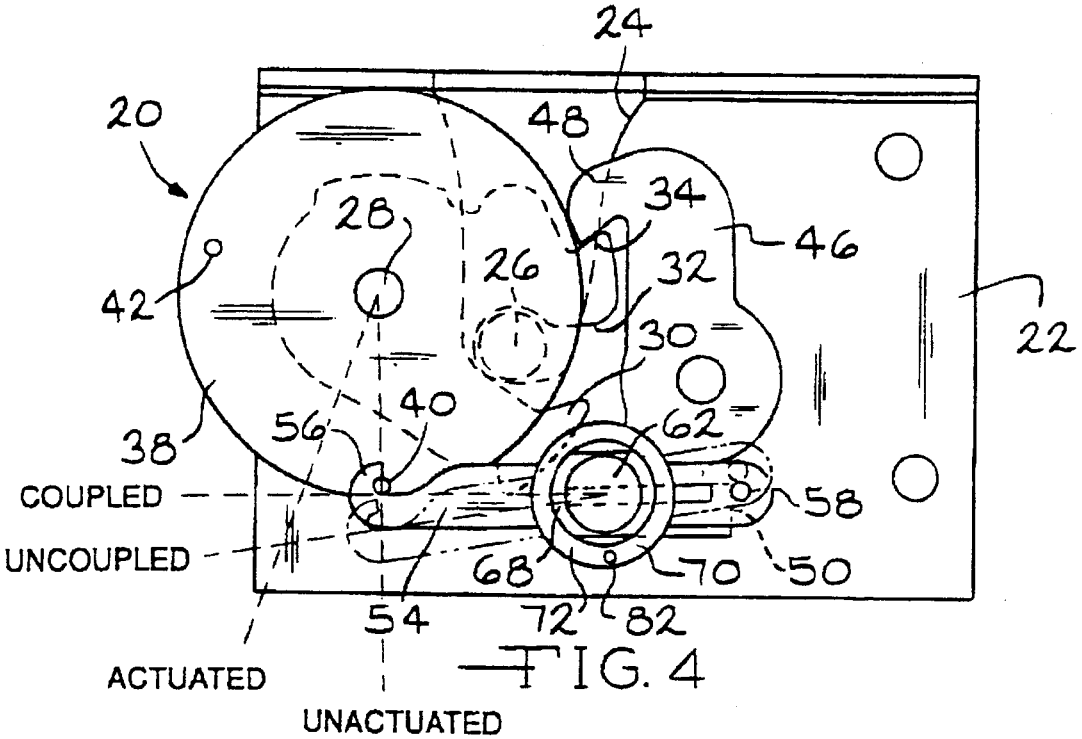
FIG. 4 is a plan view of the assembled latch assembly of FIG. 1 in a latched condition.

Referring now to FIG. 4, the operation of the latch assembly 20 will now be explained. The latch assembly 20 is illustrated therein in a latched and unlocked condition. The rotor 30 is oriented such that the notch 32 is generally perpendicular to the notch 24 in the frame 22. The rotor 30 thus cooperates with the frame 22 to capture the striker bolt 26 at the inner end of the notch 24.

The hook 48 on the pawl 46 engages the retaining step 34 on the rotor 30, thereby preventing the rotor 30 from pivoting to release the striker bolt 26. The spring 52 (FIG. 1) urges the pawl 46 to remain in the illustrated blocking position, engaged with the rotor 30. The actuator member 38 is illustrated in the unactuated position. The link 54 is illustrated in the coupled position, with the hook 56 on one end thereof engaging the tab 40 of the actuator member 38, and the tab 58 on the other end thereof engaging the bearing surface 50 of the pawl 46.

Figure 5:
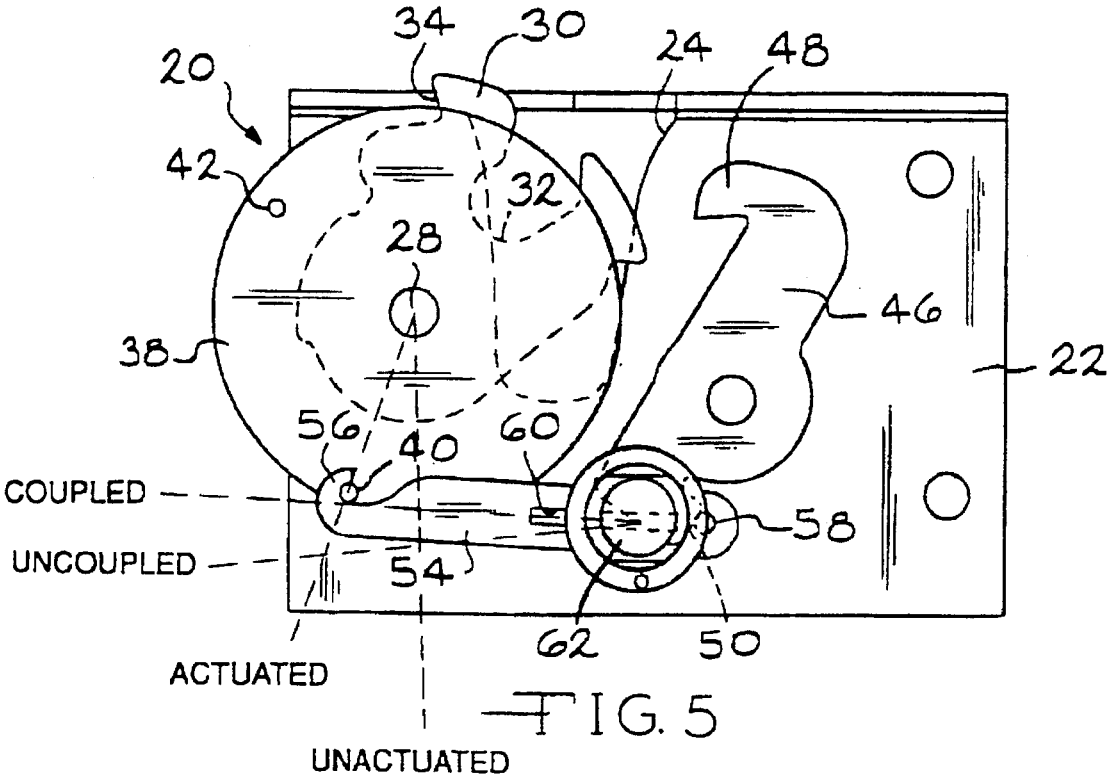
FIG. 5 is a view similar to that of FIG. 4 illustrating the latch assembly in an unlatched position.

To unlatch the latch assembly 20, the vehicle's latch actuating mechanism (for example, a door handle) coupled to the tab 42 of the actuator member 38 is operated to cause the actuator member 38 to rotate to the actuated position, as illustrated in FIG. 5. The tab 40 of the actuator member 38 urges the link 54 leftward, the link 54 moving relative to the shaft 62 by means of the slot 60 formed in the link 54. With the link 54 under tension, the tab 58 thereon bears against the bearing surface 50 to urge the pawl 46 to rotate clockwise to the release position, in which the pawl 46 is disengaged from the rotor 30. The rotor 30 is thus free to rotate to substantially align the notch 32 thereof with the notch 24 of the frame 22, releasing the striker bolt 26. The spring 36 causes the rotor 30 to remain positioned with the notch 32 aligned with the notch 24.

The latch actuating mechanism may then be released by the operator to permit the actuator member 38 to be rotated back to the unactuated position under the urging of the spring 36. This permits the link 54 to reposition as the pawl 46, acting under the urging of the spring 52, rotates to engage the periphery of the rotor 30. If the striker bolt 26 and the latch assembly 20 are subsequently brought relatively together again, the striker bolt 26 will enter the notch 24 in the frame 22 and engage the notch 32 in the rotor 30. The rotor 30 is rotated by the striker bolt 26 until the striker bolt reaches the inner end of the notch 24 in the frame 22. The rotor 30 is thus positioned with the retaining step 34 aligned with the hook 48 of the pawl 46, permitting the pawl 46 to be moved to the blocking position by the spring 52, placing the latch assembly 20 back in a latched condition.

To lock the latch assembly 20 in the latched condition, the link 54 is rotated to the uncoupled position. This may be accomplished either manually by operation of the manual locking mechanism or electrically by the motor 70. To manually lock the latch assembly 20, the manual locking mechanism operates through the tab 98 on the flange 65 to urge the shaft 62 to rotate. Sufficient force can be exerted through the manual locking mechanism to cause the armature 92 of the detent 82 to ride upwardly over the ridges 96 on the flange 65, compressing the spring 94 urging the armature 92 downwardly. The tongue 64 on the shaft 62 drives the link 54 to the uncoupled position. The armature 92 engages the ridges 96 on the flange 65 to prevent the shaft 62 and the link 54 from inadvertently moving from the uncoupled position due to, for example, vibrations transmitted from the vehicle.

The latch assembly may be electrically locked by energizing the motor 70 to cause current flow in the first direction. The magnetic field generated by the windings 76 preferentially pass through the core 74. The magnetic field is distorted at the bore 84 through the core 74. The magnetic field therefore acts to retract the armature 92 of the detent 82 into the sleeve 86, compressing the spring 96, and disengaging the armature 92 of the detent 82 from the ridges 96 of the flange 65. The detent 82 may thus be described as being electrically actuated, since the armature 92 is retracted by the magnetic field developed by electrically energizing the windings 76.

With the armature 92 thus retracted, the motor 70 may easily rotate the link 54, by means of the tongue 64 of the shaft 62, to the uncoupled position illustrated by the dashed line in FIG. 2. As the detent 82 is electrically actuated during the rotation of the shaft 62, the motor 70 need not be designed to develop as high a torque as was required to manually rotate the shaft 62 with the armature 92 camming over the ridges 96.

In referring to FIG. 4, it is apparent that, with the link 54 thus placed in the uncoupled position indicated by the broken line, the link 54 is disengaged from the tab 40 on the actuator member 38. The tab 58 on the link 54 is also disengaged from the pawl 46. Rotation of the actuator member 38 to the actuated position will not cause the tab 40 to engage or drive the link 54, and thus the pawl 46 will remain in the blocking position.

To unlock the latch assembly 20, the link 54 is rotated back to the coupled position. This may be accomplished manually by actuating the manual locking mechanism to rotate the flange 65, the shaft 62, and thus the link 54 clockwise to the coupled position. As the flange 65 rotates, the ridges 96 thereon bear against the armature 92 of the detent 82, causing the armature 92 to move upwardly, compressing the spring 94. Alternatively, the motor 70 may be energized with current flowing in the second direction through the leads 80 and the windings 76. This will cause the detent 82 to disengage the armature 92 from the ridges 96. The motor 70 will then rotate the link to the coupled position. Deenergizing the motor 70 then permits the spring 94 to urge the armature 92 into engagement with the flange 65. The ridges 96 cooperate with the spring loaded armature 92 to prevent the shaft 62 from inadvertently rotating, thus retaining the link 54 in the coupled position.

It will be noted that the actuator member 38 is mounted on the same stepped pin 28 as the rotor 30. This advantageously provides a more compact design, thus permitting the latch assembly 20 to be installed within smaller volumes in a vehicle. It also eliminates the need to have separate mounting pins for each of the actuator member 38 and the rotor 30.

Another embodiment the latch assembly of this invention is illustrated in FIGS. 6 and 7, and indicated generally at 101. The latch assembly 101 is similar to the latch assembly 20 illustrated in FIGS. 1 through 4, and those components which are identical in each of the embodiments are denoted by identical reference numbers. The main difference between the two embodiments is that while unlatching the latch assembly 20 the link 54 acts under tension, whereas in the latch assembly 101, a link 110 acts under compression during unlatching.

As best seen in FIG. 7, the elongate link 110 is provided with a first notch 112 at one end thereof, opening toward the actuator member 38. A bearing surface 114 is provided at the other end of the link 110 from the notch 112. An axially extending slot 116 receives the tongue 64 with a slip fit. For clarity of illustration, the latch assembly 101 is shown with the motor 70 removed along with the shaft 62 above a section line through the tongue 64. A second notch 118 is formed in the link 110 intermediate the first notch 112 and the slot 116, and opens toward the actuator member 38.

A pawl 120 is provided with an aperture 122 by means of which the pawl 120 is rotatably mounted on the stepped pin 44. The pawl 120 bearing against the step 44*a*. The pawl 120 includes a hook 124 formed on one end thereof extending toward the rotor 30. A tab or pin 126 is fixed to the pawl 120 between the hook 48 and the aperture 122.

Like the pawl 46, the pawl 120 is adapted to be pivoted between a blocking position (shown in FIG. 6) and a release position (shown in FIG. 7). The spring 52 urges the pawl 46 to rotate counterclockwise into engagement with the rotor 30. In the blocking position, the hook 124 is adapted to engage the retaining step 34 on the rotor 30 to retain the rotor 30 in the latched position. When the pawl 120 is in the release position, the hook 124 is disengaged from the retaining step 34, permitting the rotor 30 to rotate to the unlatched position.

The actuator member 38 is operatively coupled to the link 110 and the pawl 120. When the actuator member 38 is in an unactuated position and the link 110 is in a coupled position, as illustrated in FIG. 6, the tab 40 on the actuator 38 engages the notch 112 in the link 110. The pin 126 on the pawl 120 is aligned with the axis of the slot 116 in the link 110.

To unlatch the latch assembly 101, the latch actuating mechanism (not shown) which engages the tab 42 on the actuator member 38 may be operated to cause the actuator member 38 to rotate to the actuated position illustrated in FIG. 7. The tab 40 on the actuator member 38 bears against the notch 112 in the link 110, pushing the link bearing surface 114 of the link 110 into engagement with the pin 126 on the pawl 120. The link 110, acting under compression, urges the pawl 120 to rotate clockwise to the release position illustrated in FIG. 7. The tongue 64 cooperates with the slot 116 to keep the link 110 axially aligned with the tongue 64 such that the bearing surface 114 remains engaged with the pin 126 as the link 110 moves radially relative to the shaft 62 to rotate the pawl 120 to the release position. In the release position, the pawl is disengaged from the rotor 30, and the rotor 30 is free to rotate counterclockwise to release the striker bolt 26.

To lock the latch assembly 101 in the latched position, the link 110 is rotated to the uncoupled position illustrated in broken line in FIG. 6. When the link 110 is in the uncoupled position, the tab 40 cannot engage the notch 112 in the link 110. The actuator member 38 may be rotated to the actuated position, however, the notch 118 in the link 110 provides a relief preventing the tab 40 from touching the adjacent edge of the link 110. Therefore, if the actuator member 38 is moved to the actuated position the tab 40 cannot engage the notch 112 or frictionally engage the edge of the link 110, and thus cannot actuate the link 110. Furthermore, in the uncoupled position the tongue 64 holds the link 110 out of alignment with the pin 126 on the pawl 120. Therefore, even if the link 110 were to move radially from the shaft 62, for example due to inertia effects during a collision, the link 110 would not engage the pin 126, and thus the latch assembly 101 will remain latched.

As indicated above, it is desirable to provide a double lock feature for a vehicle door latch assembly. FIGS. 8 through 12 illustrate a latch assembly, indicated generally at 201, which is an embodiment of this invention having a double lock feature. The latch assembly 201 is similar to the latch assembly 20 illustrated in FIGS. 1 through 5 in that the link 210 is under tension during unlatching of the latch assembly 201. It will be apparent to those in the art that the components which are similar in function among the various embodiments disclosed herein will suitably be constructed of similar materials.

The latch assembly 201 includes an actuator housing 212 which is mounted on a frame 214. The actuator housing 212 is formed of any suitable material, preferably a molded polymeric material. The frame 214 is adapted to be secured to a vehicle structure, for example, the edge of a vehicle door (not shown). The frame 214 includes a base portion 216 and a wall portion 218 extending upwardly from one edge of the base portion 216. The wall portion 218 is shown with a portion broken away for clarity.

Figure 8:
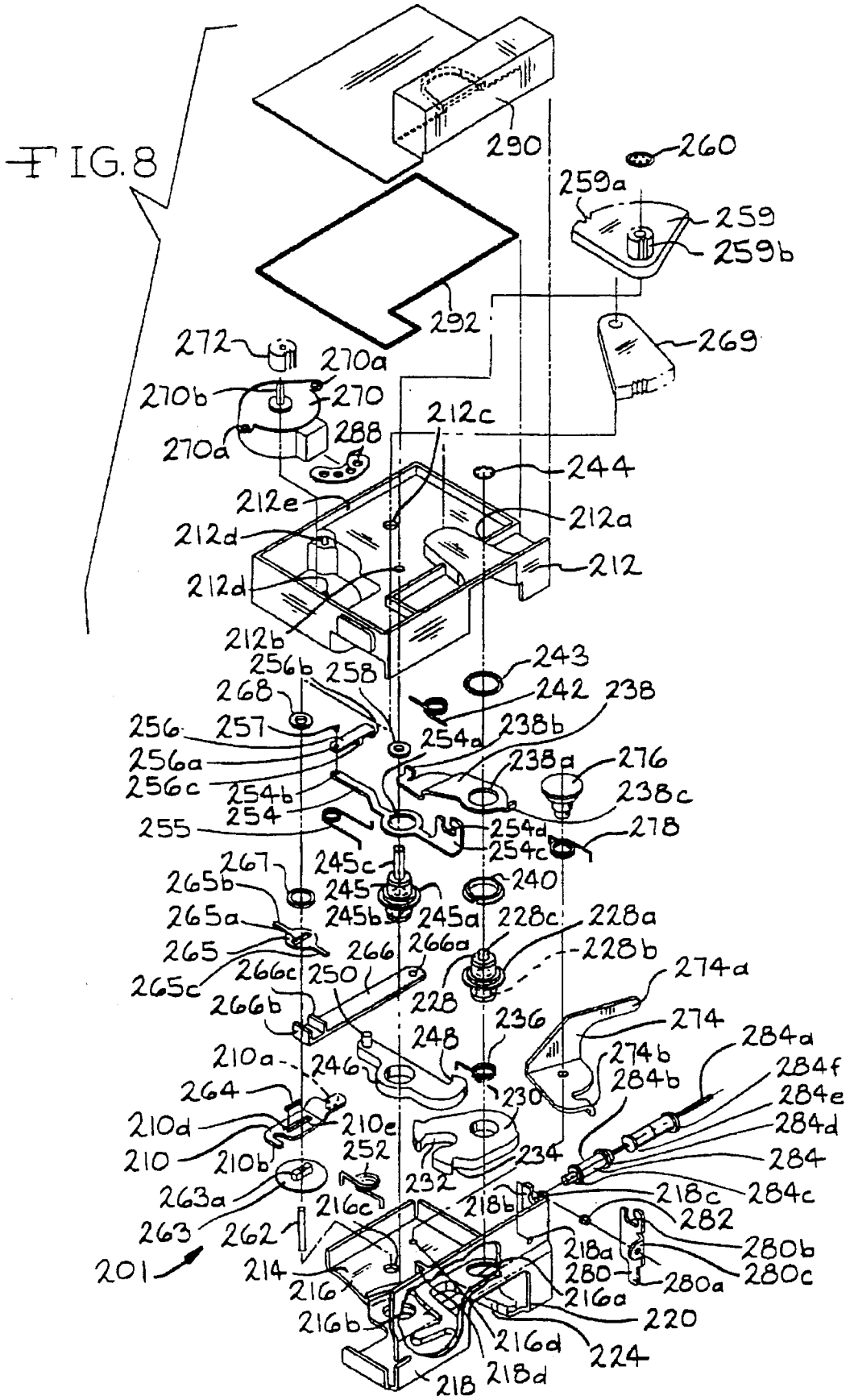
FIG. 8 is an exploded perspective view of a third embodiment of the latch assembly which is similar to the embodiment shown in FIG. 1 but has been modified to include a double lock feature.

An opening 220 in the frame 214 extends into both the wall portion 218 and the base portion 216 (best seen in FIG. 8). The opening 220 forms a laterally extending notch 224 in the base portion 216, the inner edges of which converge inwardly and diverge outwardly. The notch 224 is adapted to receive a striker bolt 226 (FIGS. 10 through 12) secured to another vehicle structure, such as a doorpost (not shown) when the vehicle door is closed.

Apertures 216*a* and 216*b* are formed through the base portion 216 on opposite sides of the notch 224. Apertures 216*c* and 216*d* are formed through the base portion 216 and spaced apart from the apertures 216*a* and 216*b*. An aperture 218*a* is formed through the wall portion 218 of the frame 214, adjacent the opening 220. A flange 218*b* extends perpendicularly to the wall portion 218, over the base portion 216 of the frame 214. A notch 218*c* is formed in the upper edge of the flange 218*b*. A second flange 218*d* extends perpendicularly to the wall portion 218 adjacent the notch 224. The purpose of the apertures 216*a*, 216*b*, 216*c*, 216*d*, and 218*a*, and of the notch 218*c* will become clear in the discussion below.

A stepped pivot pin 228 is fixed in the aperture 216*a*. A rotor 230 is pivotally mounted between a circumferential flange 228*a* on the pin 228 and the base portion 216. The pin 228 may advantageously be provided with a threaded recess or bore 228*b*. A threaded fastener (not shown) may be threaded into the bore 228*b* to secure the latch assembly 201 to the vehicle. A shaft 228*c* formed on the upper surface of the pin 228 extends axially upwardly therefrom.

The rotor 230 includes a notch 232, and a retaining step 234. The rotor 230 rotates counterclockwise to an unlatched position (FIG. 9) in which the notch 232 is aligned with the notch 224 to permit the striker bolt 226 to be released during unlatching. The rotor 230 is formed of a suitable material, such as steel, which is preferably case hardened. Additionally, the rotor 230 is preferably coated with a suitable material to prevent rattling and wear due to metal-to-metal contact, such as a wear resistant polymeric material overmolded onto the rotor 230. A spring 236 engages the frame 214 and the rotor 230 to urge the rotor 230 to rotate counterclockwise direction from the latched position to the unlatched position.

An actuator member 238 is formed with an aperture 238*a*, by means of which the actuator member 238 is pivotally mounted on the pin 228, above the flange 228*a*. The actuator member 238 further includes a tab 238*b* extending upwardly from the upper surface thereof by means of which the actuator member 238 is coupled to the link 210. The actuator member 238 is provided with a second upwardly extending tab 238*c* on the other side of the aperture 238*a* from the first tab 238*b*.

As will be further explained below, the actuator member 238 may be selectively pivoted about the pin 228 between an unactuated and an actuated position. To help prevent rattling and wear due to metal-to-metal contact between the pin 228 and the actuator member 238, an annular bearing 240 is fitted in the aperture 238*a*. The bearing 240 is preferably formed of a plastic such as nylon. A spring 242 engages the frame 214 and the actuator member 238 to urge the actuator member to rotate counterclockwise toward the unactuated position.

The shaft 228*c* of the pin 228 extends upwardly through an aperture 212*a* in the actuator housing 212. An elastomeric o-ring 243 interposed between the actuator housing 212 and the shaft 228*c* provides a leak resistant seal therebetween. A retaining clip 244 is removeably fixed about the upper end of the shaft 228*c* of the pin 228, thereby utilizing the pin 228 to secure the actuator housing 212 to the frame 214.

A stepped pivot pin 245 is fixed in the aperture 216*b* in the frame 214. The pin 245 is similar to the pin 228, and includes a circumferential flange 245*a*, a threaded bore 245*b*, and an axial shaft 245*c* extending upwardly from the upper surface thereof. The threaded bore 245*b* may be utilized with a threaded fastener to assist in securing the latch assembly 201 to the vehicle.

A pawl 246 is pivotally mounted on the pin 228 between the flange 245*a* and the base portion 216 of the frame 214. The pawl 246 includes a hook 248 formed on one end thereof extending toward the rotor 230. An upwardly extending pin 250 is formed on the opposite end of the pawl 246 from the hook 248. The pawl 246 is adapted to be pivoted between a blocking position (shown in FIGS. 10, 11, and 12), in which the hook 248 engages the retaining step 234 of the rotor 230, and a release position (shown in FIG. 9), in which the hook 248 is disengaged from the retaining step 234. Like the rotor 230, the pawl 246 is preferably formed of a material such as case hardened steel, and is preferably overmolded with a wear resistant polymeric material. A spring 252 engages the pawl 246 and the frame 214 to urge the pawl 246 to pivot counterclockwise from the release position to the blocking position.

Figure 11:
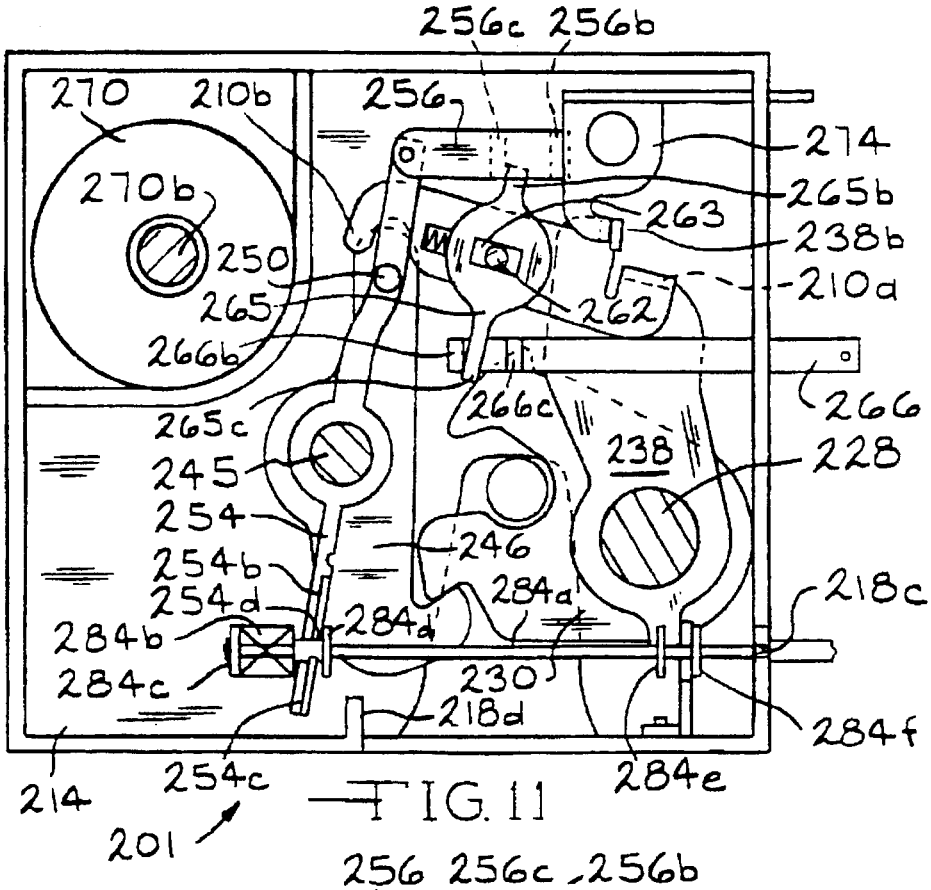
FIG. 11 is a view similar to that of FIGS. 9 and 10 illustrating the latch assembly in a locked condition.
Figure 12:
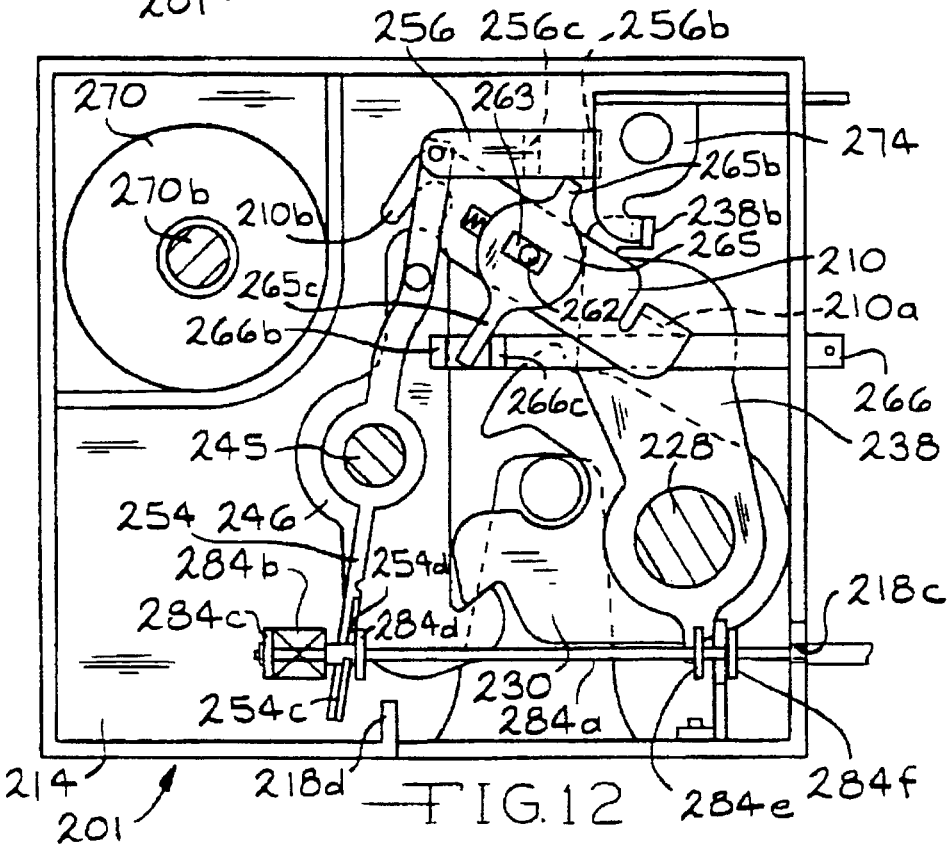
FIG. 12 is a view similar to that of FIGS. 9, 10 and 11 illustrating the latch assembly in a double locked condition.

An elongate interior lock lever 254 includes a central aperture 254*a* therethrough by means of which the interior lock lever 254 is pivotally mounted on the pin 245. A first end of the interior lock lever 254 is provided with a second aperture 254*b*, while the other end thereof is provided with an upwardly extending tab or flange 254*c*. The flange 254*c* extends longitudinally along the interior lock lever 254. A generally L-shaped notch 254*d* is formed in the upper edge of the flange 254*c*. The interior lock lever 254 may be selectively moved between an unlock position in which the flange 254*c* abuts the flange 218*d* of the wall portion 218 of the frame 214 (illustrated in FIGS. 9 and 10), and a lock position in which the flange 254*c* is spaced apart from the flange 218*d* (FIGS. 11 and 12). An over-center spring 255 engages the frame 214 and the interior lock lever 254, urging the interior lock lever 254 from any position intermediate the lock and unlock positions toward the closer of the lock and unlock positions.

A first end of an interior lock fork 256 is provided with an aperture 256*a*. A mechanical fastener 257, such as a rivet, is rotatably received in the aperture 256*a* in the interior lock fork 256 and the aperture 254*b* in the interior lock lever 254 to pivotally join the interior lock fork 256 to the interior lock lever 254. A second end of the interior lock fork 256 is provided with two spaced apart, depending tines 256*b* and 256*c*.

The shaft 254*c* of the pin 245 extends upwardly through an aperture 212*b* formed in the actuator housing 212. An elastomeric o-ring 258 interposed between the actuator housing 212 and the shaft 254*c* provides a leak resistant seal therebetween.

A compound sector gear 259 is rotatably mounted on the shaft 254*c* above the actuator housing 212. The compound sector gear 259 includes a sector gear portion 259*a* and a spur gear portion 259*b* above the sector gear portion 259*a*. The compound sector gear 259 is formed of a suitable material, and is preferably molded of a polymeric material. A retainer clip 260 is removeably fixed about the upper end of the shaft 245*c* of the pin 245, thereby retaining the compound sector gear 259 on the shaft 245*c*. Additionally, the retainer clip 260 and the compound sector gear 259 cooperate with the pin 245 to secure the actuator housing 212 to the frame 214.

A shaft 262 is rotatably received in the aperture 216*c*, and extends upwardly from the base portion 216 of the frame 214. A disc-shaped index member 263 is rotatably mounted on the shaft 262. The index member 263 includes a rectangular boss 263*a* on the upper surface thereof. The index member 263 may be formed of any suitable material, such as a powdered metal.

The elongate link 210 is provided with a depending tab 210*a* at one end thereof and a hook 210*b*, opening toward the pawl 246, at the other end thereof. An axially extending, rectangular slot 210*c* is formed in the link 210 intermediate the tab 210*a* and the hook 210*b*. The link 210 is operatively coupled to both the pawl 246 and the actuator member 238. The link 210 may be selectively moved to a coupled and an uncoupled position. When the actuator 238 is in its unactuated position, and the link 210 is in the coupled position, the tab 210*a* engages a portion of the tab 238*b* on the upper surface of the actuator 238. The hook 210*b* on the opposite end of the link 210 engages the pin 250 on the pawl 246, the hook 210*b* being positioned abutting or slightly spaced apart from the pin 250.

The link 210 is coupled to the index member 263 with the boss 263*a* of the index member 263 being slidably received in the slot 210*c* of the link 210. The link 210 is thus keyed to the shaft 262, such that rotation of the shaft 262 about the axis thereof causes the link 210 to rotate therewith between the coupled and uncoupled positions. The link 210 may be moved radially relative to the shaft 262, and thus moved radially relative to the boss 263*a* of the index member 263.

An axially extending tab 210*d* is formed at the end of the slot 210*c* closest to the hook 210*b*. A coil spring 264 is retained on the tab 210*d* and compressed between the link 210 and the boss 263*a* on the index member 263. The spring 264 biases the link 210 to move the hook 210*b* thereof away from the index member 263.

The index member 263 is also coupled to a lock/unlock lever 265. The boss 263*a* of the index member 263 extends upwardly through the slot 210*c* of the link 210 to be received in a rectangular aperture 265*a* formed in the lock/unlock lever 265. Thus rotation of the lock/unlock lever 265 will cause concurrent rotation of the index member 263 and the link 210.

The lock/unlock lever 265 has two operating arms, 265*b* and 265*c*, extending outwardly from a central body portion containing the aperture 265*a*. The arm 265*b* is operatively coupled to the interior lock fork 256. The arm 265*b* may be selectively captured between the tines 256*b* and 256*c* formed on the interior lock fork 256. When the arm 265*b* is captured between the tines 256*b* and 256*c*, axial movement of the interior lock fork 256 against the arm 265*b* will cause the lock/unlock lever 265 to rotate, causing the link 210 to rotate therewith.

The operating arm 265*c* is similarly operatively coupled to an exterior lock fork 266. A first end of the exterior lock fork 266 is provided with an aperture 266*a*. The exterior lock actuating mechanism (such as a key cylinder, not shown) is operatively coupled to the exterior lock fork by means of the aperture 266*a*. A second end of the exterior lock fork 266 is provided with two spaced apart, upright tines 266*b* and 266*c*. The operating arm 265*c* is captured between the tines 266*b* and 266*c* such that axial movement of the exterior lock fork 266 will cause rotation of the lock/unlock lever 265. Unlike the operating arm 265*b*, which is selectively captured by the interior lock fork 256, the operating arm 265*c* remains captured by the exterior lock fork 266 in all operating positions of the lock/unlock lever 265. The interior lock fork 256 and the exterior lock fork 266 are preferably formed of powdered metal.

A wave washer 267 coaxial with the shaft 262 is compressed between the upper surface of the lock/unlock lever 265 and the lower surface of the actuator housing 212. The wave washer 267 urges the lock/unlock lever 265 and the link 210 downwardly on the index member 263. The wave washer is preferably formed of a stainless steel.

The shaft 262 extends upwardly through an aperture 212*c* in the actuator housing 212. A seal 268 is provided to form a leak resistant seal between the shaft 262 and the actuator housing 212. The seal 268 is preferably formed of an elastomeric material.

A generally wedge shaped output gear 269 is fixed to the upper end of the shaft 262 so as to be rotatable therewith. Thus the output gear 269 is coupled through the shaft 262 to the index member 263 and thus to the link 210. The output gear 269 meshes with and is driven by the spur gear portion 259*b* of the compound sector gear 259.

A stepper motor 270 includes an output shaft 270*a*. The motor 270 selectively rotates the shaft 270 to drive a pinion gear 272 fixed to the shaft 270*a*. The pinion gear 272 meshes with and drives the sector gear portion 259*a* of the compound sector gear 259, and, through the compound sector gear 259, drives the output gear 269 and the shaft 262 coupled thereto. Thus, the motor 270 is provided with a gear train which includes the pinion gear 272, the compound sector gear 259 and the output gear 269, by means of which the motor 270 may lock, unlock, and double lock the latch assembly 201. Stepper motors are available commercially from Johnson Electric North America, Inc., of Fairfield, Connecticut.

Stepper motors such as the motor 270 have a relatively high torque output compared to the small DC motors traditionally used in electrically operated lock mechanisms for latches, and therefore require less gear train torque amplification. With a reduction in the required gear train torque amplification, fewer gears may be needed to achieve the required torque for actuating the lock mechanism of the latch assembly 201. This allows the latch assembly 201 to be made relatively more compactly. Additionally, with low gear train torque amplification, little effort is required to manually operate the lock mechanism because little effort is required to back drive the gear train and motor 270.

The motor 270 is provided with a pair of mounting ears 270*a* having apertures formed therethrough. The ears 270*a* mate with a pair of mounting pins 212*d* formed on the actuator housing 212. The motor 270 is secured in position by heat staking, that is, heating and deforming the free ends of the mounting pins 212*d* to form an enlarged head thereon, thereby securing the mounting ears 270*a* of the motor 270 on the mounting pins 212*d*.

An exterior release lever 274 is rotatably mounted on a pivot pin 276, the pin 276 being fixed in the aperture 216*d* of the frame 214. The exterior release lever 274 is provided with an operating arm 274*a*, which is adapted to be engaged by an exterior latch actuating mechanism (not shown) such as an exterior door handle. The exterior release lever 274 is also provided with a depending tab 274*b*, which is operatively coupled with the actuator member 238. The exterior release lever 274 may be selectively rotated from an unactuated position to an actuated position, thereby causing the tab 274*b* thereon to engage the tab 238*b* of the actuator member 238 and rotate the actuator member 238 from its unactuated position to its actuated position. A spring 278 engages both the exterior release lever 274 and the frame 214 to urge the exterior release lever 274 to rotate out of engagement with the actuator member 238. The spring 278 is compressed when the exterior release lever 274 is rotated to drive the actuator member 238 to the actuated position.

The latch assembly 201 also includes an interior release lever 280. The elongate interior release lever 280 includes a depending arm 280*a* formed on the lower end of the lever body, a generally L-shaped notch 280*b* formed in the upper edge of the lever body, and a mounting flange 280*c* extending at right angles to the lever body. The mounting flange 280*c* includes an aperture formed therethrough. A mounting pin 282 is rotatably fitted in the aperture through the mounting flange and fixed in the aperture 218*a* in the wall portion 218 of the frame 214. The interior release lever 280 is thereby pivotally mounted to the wall portion 218 of the frame 214. The depending arm 280*a* is adapted to engage the tab 238*c* of the actuator member 238. The interior release lever 280 may be selectively pivoted between an unactuated position and an actuated position to cause the actuator member 238 to correspondingly rotate between its unactuated and actuated positions.

The interior latch actuating mechanism may advantageously be embodied as a Bowden cable 284, although those in the art will recognize that other conventional operating devices such as pivoting lever arms, operating rods, and wire cables may be used in place thereof. Indeed, those in the art will recognize that in certain applications, the exterior latch actuating mechanism and the interior latch actuating mechanism may advantageously be directly fixed to the actuator member 238 without the intermediate levers 274 or 280, respectively. The Bowden cable includes an outer sheath which terminates in and is fixed to the notch 218*c* formed in the tab 218*b* of the wall portion 218 of the frame 214. The Bowden cable 284 includes a cable core 284*a* which is slidable within the outer shealth, and which extends into the latch assembly 201. A plurality of barrels are fixed to the cable core 284*a* to operably couple the Bowden cable 284 to the interior lock lever 254 and the interior release lever 280 in a manner which will be described below. Each barrel includes a tubular portion having an outwardly extending circumferential flange at one end thereof.

A first barrel 284*c* and a second barrel 284*d* are fixed to cable core 284*a* with the tubular portion thereof abutting. The tubular portions of the barrels 284*c* and 284*d* are slidably received in the slot 254*d* in the flange 254*c* of the interior lock lever 254. A spring pack 284*b* is disposed about the tubular portions of the barrels 284*c* and 284*d*, and interposed between the flange 254*c* and the flange portion of the barrel 284*c*.

A third barrel 284*e* and a fourth barrel 284*f* are similarly fixed to the cable core 284*a* with abutting tabular portions. The tubular portions of the barrels 284*e* and 284*f* are slidably received in the slot 280*b* in the interior release lever 280. The flanges portions of the barrels 284*e* and 284*f* thus cooperate to form a lost motion connection between the cable core 284*a* and the interior release lever 280.

A plurality of conventional dome switches 288 may be provided to provide indication of the position of the link 210. Advantageously, the switches 288 will be mounted on the upper surface of the actuator housing 212, and actuated by a conventional position arm (not shown) driven through the gear train between the motor 270 and the shaft 262 in a manner well known in the art. The motor 270 may be controlled utilizing the position indication provided by the switches 288.

The motor 270 may be energized to drive the components of the latch assembly 201 to the unlocked, locked, and double locked conditions thereof, and the motor 270 deenergized when actuation of a switch 288 indicates that the latch assembly is unlocked, locked, or double locked, respectively. The motor 270 may be controlled in a manner well known for stepper motors to accelerate to a high speed in a first portion of operation, operate at a sustained high speed in a second portion of operation, and then decelerated to a stop at a desired position. It is believed that operation of the motor 270 in this manner reduces stress and wear in various components of the latch assembly 201.

A cover 290 is provided to protect the motor 270, the gear train driven thereby, and the other components mounted above the upper surface of the actuator housing 212. An elastomeric seal 292 is compressed between the cover 290 and a peripheral wall 212*e* extending upwardly from the actuator housing 212. The seal 292 provides a leak-tight seal between the actuator housing 212 and the cover 290. The cover 290 is secured to the actuator housing 212 by conventional means such as sonic welding, adhesive materials, or mechanical fasteners (not shown).

Figure 9:
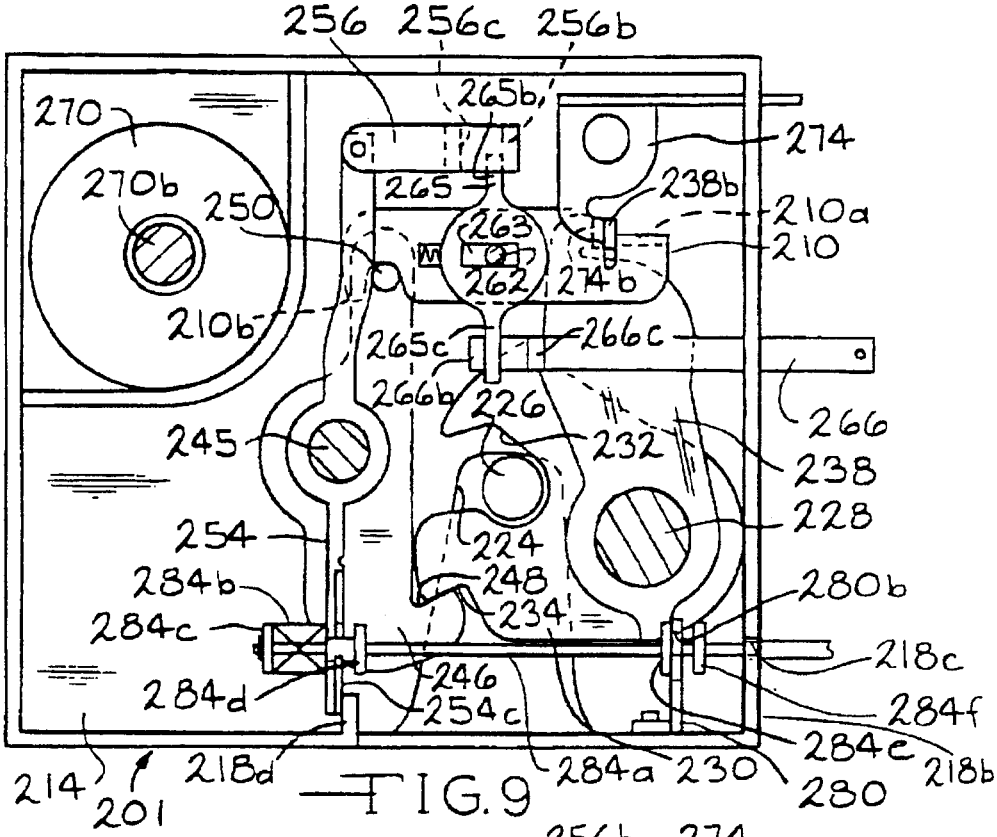
FIG. 9 is a plan view of the assembled latch assembly of FIG. 8 below the actuator housing in a latched and unlocked condition.

Referring now to FIGS. 9 through 12, the operation of the latch assembly 201 will now be explained. The operation of the latch assembly 201 is similar to that of the latch assembly 20 illustrated in FIGS. 1 through 5. FIG. 9 illustrates the latch assembly 201 in a latched and unlocked condition. The rotor 230 is oriented such that the notch 232 is generally perpendicular to the notch 224 in the frame 214. The rotor 230 thus cooperates with the frame 214 to capture the striker bolt 226 at the inner end of the notch 224.

The hook 248 on the pawl 246 is engaged with the retaining step 234 on the rotor 230, thereby preventing the rotor 230 from pivoting to release the striker bolt 226. The link 210 is illustrated in the coupled position, with the tab 210*a* thereof engaging the tab 238*b* of the actuator member 238, and the hook 210*b* on the other end of the link 210 engaging the pin 250 of the pawl 246.

Figure 10:
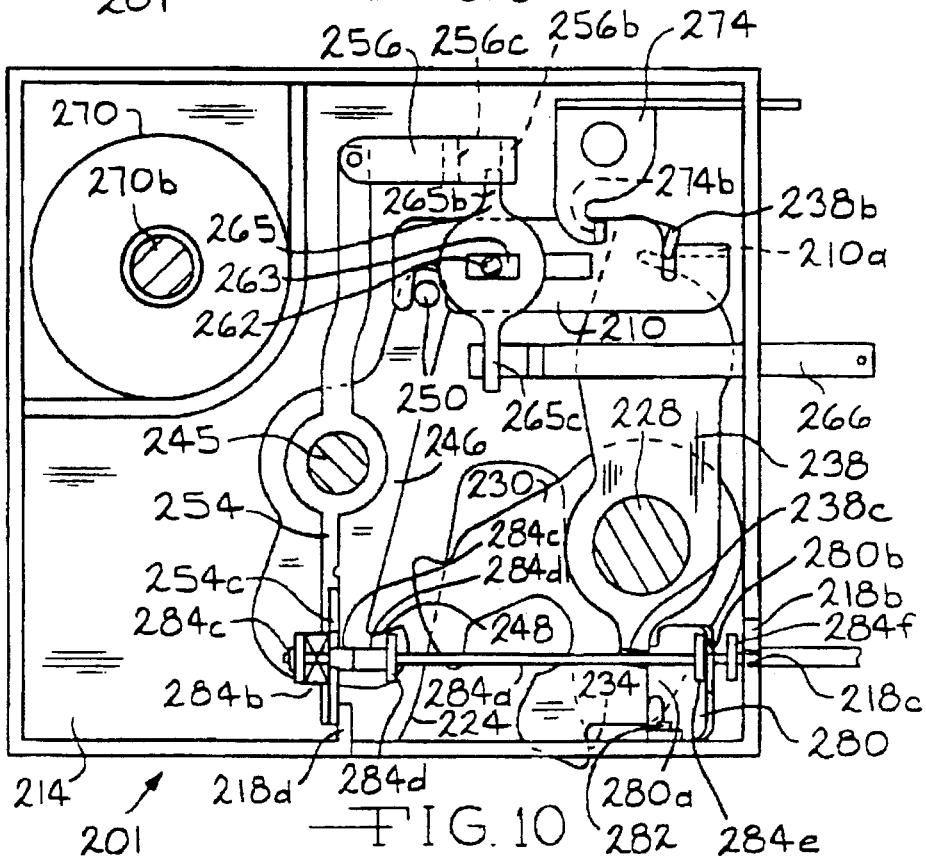
FIG. 10 is a view similar to that of FIG. 9 illustrating the latch assembly in an unlatched condition.

To unlatch the latch assembly 201, the actuator member 238 must be rotated to the actuated position thereof (illustrated in FIG. 10). As the actuator member 238 is rotated to the actuated position, the actuator member 238 moves the link 210 rightward (radially relative to the shaft 262), rotating the pawl 246 clockwise to the release position. Thus, the rotor 230 is freed to rotate to release the striker bolt 226 in a manner similar to that described for the latch assembly 20. To rotate the actuator member 238 to the actuated position, the exterior release lever 274 may be rotated (utilizing the exterior latch actuating mechanism, which is not shown). Rotating the exterior release lever 274 to the actuated position causes the tab 274*b* thereof to drive against the upwardly extending tab 238*b* of the actuator member 238. The tab 274*b* thus urges the actuator member 238 to rotate to the actuated position thereof.

Alternatively, the latch assembly 201 may be unlatched from the interior of the vehicle by actuating an interior release handle (not shown) to operate the Bowden cable 284, drawing the cable core 284*a* to the right. Drawing the cable core 284*a* to the right causes the flange of the barrel 284*c* to urge the spring pack 284*b* against the flange 254*c* on the interior lock lever 254. The flange 254*c* bears against the flange 218*d*, and further rightward motion of the cable core 284*a* compresses the spring pack 284*b*. As the spring pack 284*b* is compressed, the flange of the barrel 284*e* bears against the interior release lever 280, causing the interior release lever 280 to pivot about the pin 282 to a release position. As the interior release lever 280 pivots to the release position thereof, the arm 280*a* bears against the tab 238*c* of the actuator member 238, thereby causing the actuator member 238 to rotate to the actuated position thereof.

When the interior operating handle (not shown) is released, the spring pack 284*b* expands, drawing the cable core 284*a* to the left. The barrel 284*f* bears against the interior release lever 280*a*, returning the interior release lever 280*a* to the unactuated position thereof, and permitting the actuator member 238 to return to the unactuated position thereof.

The latch assembly 201 may be locked from the interior of the vehicle, from the exterior of the vehicle, or electrically. As in the previously described embodiments, locking is accomplished by rotating the link 210 out of the unlocked position thereof, such that the tab 210*a* thereof cannot be engaged by the tab 238*b* of the actuator member 238. Additionally, the hook 210*b* is preferably disengaged from the pin 250 of the pawl 246 in the unlock position.

To lock the latch assembly 201 from the interior of the vehicle, interior locking mechanism (such as a sill button—not shown) is operated to cause the cable core 284*a* of the Bowden cable 284 to move leftward. The movement of the cable core 284*a* causes the barrel 284*d* to urge the interior lock lever 254 to rotate from the unlock position thereof (FIG. 9) clockwise toward the lock position thereof (illustrated in FIGS. 11 and 12). During the first half of the movement of the interior lock lever 254, the overcenter spring 255 (FIG. 8) is compressed, and opposes the motion of the interior lock lever 254. As the interior lock lever 254 passes the midpoint of travel between the unlock and the lock positions thereof, the overcenter spring 255 switches from opposing the motion of the interior lock lever 254 to aiding the motion as the overcenter spring 255 expands.

Movement of the interior lock lever 254 to the lock position causes the interior lock fork 256 to move axially, with the tine 256*c* engaging the arm 265*b* of the lock/unlock lever 265. The tine 256*c* thus urges the lock/unlock lever 265 to rotate to the lock position. As indicated above, the lock/unlock lever 265 is coupled to the link 210 for concurrent rotation therewith through the boss 263*a* of the index member 263. Movement of the lock/unlock lever 265 to the lock position thus causes the link 210 to rotate to the lock position. Additionally, the movement of the lock/unlock lever 265 causes the exterior lock fork 265 to reposition from the unlock position to the lock position thereof (FIG. 11).

To lock the latch assembly 201 from the exterior of the vehicle, the exterior lock mechanism (not shown) is operated to move the exterior lock fork 266 from the unlocked position to the locked position thereof. The tine 266*c* of the exterior lock fork 266 bears against the arm 265*a* of the lock/unlock lever 265 for the first portion of travel to the lock position. As the lock/unlock lever 265 is thereby rotated toward the lock position, the arm 265*b* bears against the tine 256*b* of the interior lock fork 256, thereby driving the interior lock lever 254 toward the lock position. At the midpoint of travel, the overcenter spring 255 begins to drive the latch assembly components toward the lock position as described above. Thus, in the locked position, the arms 265*a* and 265*b* of the lock/unlock lever 265 will be spaced apart from the respective tines 266*c* and 256*b* which the lock/unlock lever 265 engaged during the first portion of travel from the unlock to lock positions.

Finally, to lock the latch assembly 201 electrically, the motor 270 may be energized to rotate the output gear 269 to the lock position by driving the output gear 269 through the pinion gear 272 and the compound sector gear 259. Rotating the output gear 269 to the lock position drives the shaft 262, the index member 263, the link 210 and the lock/unlock lever 265 to the lock position. The arms 265*b* and 265*c* of the lock/unlock lever 265 bear against the tines of the interior and exterior lock forks, 256 and 266, respectively, moving the interior and exterior lock mechanism to their respective lock positions. Note that the action of the overcenter spring 255, acting through the interior lock fork 256, will hold the lock/unlock lever in the lock position. The overcenter spring 255 thus acts to prevent the latch assembly 201 from inadvertently moving to the unlock position, which might otherwise occur, for example, due to vibrations experienced by the latch assembly 201.

To unlock the latch assembly 201 from the interior of the vehicle, the Bowden cable 284 is operated to cause the cable core 284*a* to move rightward. The stop 284*c* drives the spring pack 284*b* against the flange 254*c* of the interior lock lever 254. The spring pack 284*b* does not significantly compress, but rather drives the interior lock lever 254 from the lock position toward the unlock position. The overcenter spring 255 will act to drive the interior lock lever 254 toward the unlock position during the last portion of movement toward the unlock position. The interior lock fork 256 in turn causes the lock/unlock lever 265 and the index member 263, and thus the link 210, to return to the unlock positions thereof. Additionally, the arm 265*b* of the lock/unlock lever 265 drives against the tine 266*c* of the exterior lock fork 266 to reposition the exterior lock fork 266 to the unlock position (FIGS. 9 and 10).

Unlocking may be accomplished from the exterior of the vehicle by operating the exterior lock mechanism to move the exterior lock fork 266 to the unlock position. The tine 266 thereof will engage the arm 265*b* of the lock unlock/lever 265, thus urging the lock/unlock lever 265 toward the unlock position. The lock/unlock lever 265 will in turn drive the interior lock lever 254 and the link 210 to their respective unlock positions. The overcenter spring 255 will act to drive the latch assembly 201 components toward the unlock position during the last portion of travel thereof.

Electrical unlocking of the latch assembly 201 may be accomplished by energizing the motor 270 to operate in the opposite direction from that during locking. The gear train of the motor 270 operates to rotate the shaft 262 counterclockwise to move the index member 263, the link 210 and the lock/unlock lever 265 to the unlock position. The motor 270 is then deenergized.

The latch assembly 201 may be placed in the double lock condition illustrated in FIG. 12 either electrically, by energizing the motor 270, or manually, by operating the exterior locking mechanism. To electrically move the link 210 to the double lock position, the motor 270 is energized to move in the same direction as that during locking, but the motor 270 is not deenergized in the lock position, but is rather allowed to drive gear train until the double lock position is reached. Similarly, when the exterior locking mechanism is used, the exterior lock fork 266 is moved axially in the same direction as that for locking, but is moved further. This causes the tine 266*c*, bearing against the arm 265*a*, to drive the lock/unlock lever 265 to the double lock position.

The double lock position is similar to the lock position, in that the tab 210*a* of the link 210 is disengaged from the tab 238*b* of the actuator member 238 such that rotation of the actuator member 238 to the actuated position will not move the link 210. The double lock position is unlike the lock position in that the arm 265*b* of the lock/unlock lever 265 is no longer captured between the tines 256*b* and 256*c* of the interior lock fork 256. The distance the exterior lock fork 266 is spaced from the shaft 262 is equal to the distance the interior lock fork 256 is spaced from the shaft 262. However, as indicated above, the lock/unlock lever 265, which pivots about the axis of the shaft 262, is provided with arms 265*b* and 265*c* of unequal length. This arrangement permits the longer arm 265*a* to remain engaged by the exterior lock fork 266 when the lock/unlock lever 265 is rotated to an angle in which the shorter arm 265*b* is disengaged from the interior lock fork 256. With the lock/unlock lever 265 thus disengaged from the interior lock fork 256, the interior lock mechanism cannot unlock the latch assembly 201. Either the motor 270 or the exterior lock mechanism, acting through the exterior lock fork 266, must be operated to place the latch assembly back into either the locked or unlocked conditions. In the locked and unlocked conditions, the lock/unlock lever 265 is again engaged by the interior lock fork 256.

Figure 13:
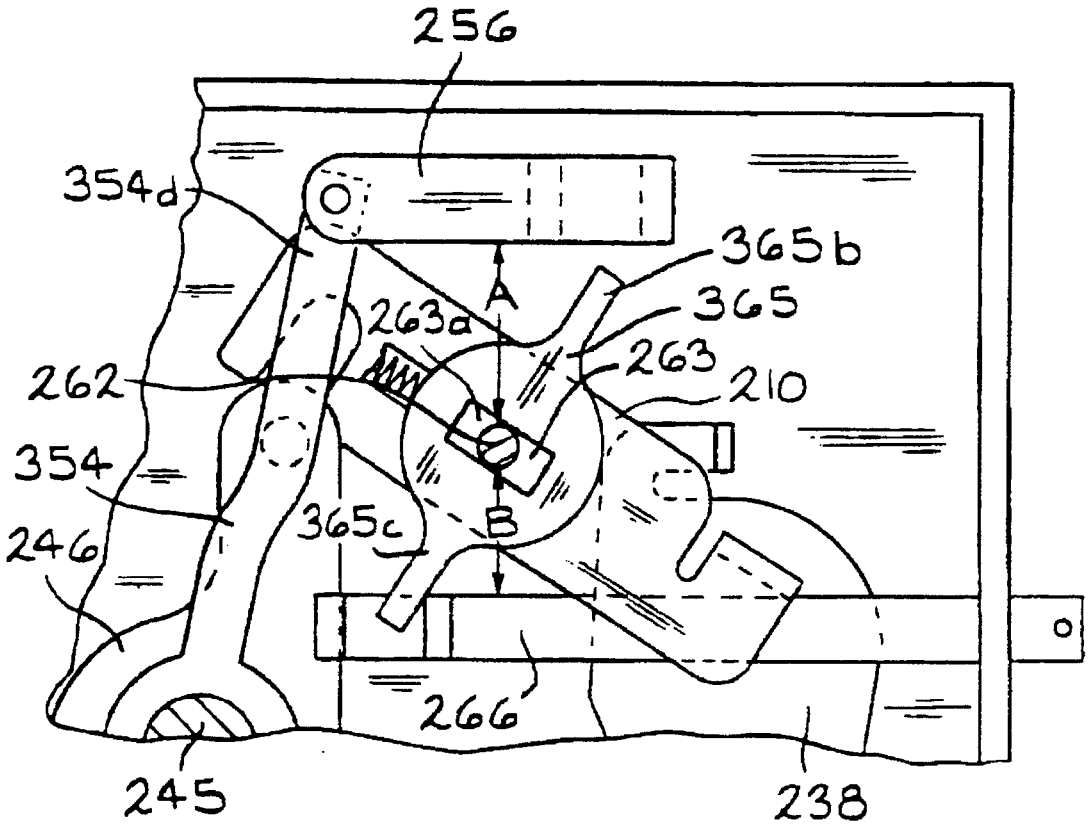
FIG. 13 is a partial plan view of a fourth embodiment of the latch assembly which is similar to the embodiment shown in FIGS. 8 through 12, but which has been modified to include a second type of double lock feature.

Other methods are contemplated for placing the latch assembly of this invention into the double lock condition. For example, FIG. 13 illustrates a fourth embodiment of the latch assembly of this invention. Most of the structure of the latch assembly 301 is identical to that of the latch assembly 201 illustrated in FIGS. 8 through 12. Accordingly, like reference numbers are used to indicate similar components.

One of the components which differ between the two embodiments is an interior lock lever 354. The interior lock lever 354 is generally similar to the interior lock lever 254. However the arm 354*d* to which the interior lock fork 256 is coupled is longer on the interior lock lever 354 than the corresponding arm on the interior lock lever 254. Thus, the interior lock fork 256 will be spaced further from the shaft 262 in the latch assembly 301 than in the latch assembly 201. Furthermore, in the latch assembly 301, the interior lock fork 256 defines a first distance "A" from the shaft 262 which is greater than a second distance "B" defined between the exterior lock fork 366 and the shaft 262.

A lock/unlock lever 365, coupled to the index member 263 by the boss 263*a*, pivots with the shaft 262 about the axis of the shaft 262. The lock/unlock lever 365 has arms 365*b* and 365*c* of equal length, unlike the lock/unlock lever 265. The arm 365*b* may be selectively captured between the tines 256*b* and 256*c* of the interior lock fork 256. The arm 365*c* is captured between the tines 266*b* and 266*c* of the exterior lock fork 266 in all operating states of the latch assembly 301.

The exterior lock fork 266 may be operated to rotate the lock/unlock lever 365 to the double lock position illustrated in FIG. 13. While the exterior lock fork 266 remains engaged with the lock/unlock lever 365, the interior lock fork 256, being spaced further from the axis of rotation of the lock/unlock lever 365, is disengaged from the lock/unlock lever 365. Only the exterior lock fork 266 (and the motor 270 illustrated in FIGS. 8 through 12, operating through the shaft 262) can rotate the lock/unlock lever 365 to a position in which the arm 365*b* will be engaged by the interior lock fork 256. Thus, the interior lock mechanism is disabled in the double lock position.

FIGS. 14 through 17 illustrate a fifth embodiment of the latch assembly of this invention. As with the latch assembly 301 illustrated in FIG. 13, most of the structure of the latch assembly 401 illustrated in FIGS. 14 through 17 is identical to that of the latch assembly 201 illustrated in FIGS. 8 through 12, and like reference numbers are used to indicate similar components. In this embodiment, axial movement of a lock/unlock lever 465 relative to the shaft 262 provides a means for selectively uncoupling one of a pair of lock forks. The latch assembly 401 depicted therein is similar to the latch assembly 201 illustrated in FIGS. 8 through 12, and identical parts will be depicted utilizing the same reference numbers.

Figure 17:
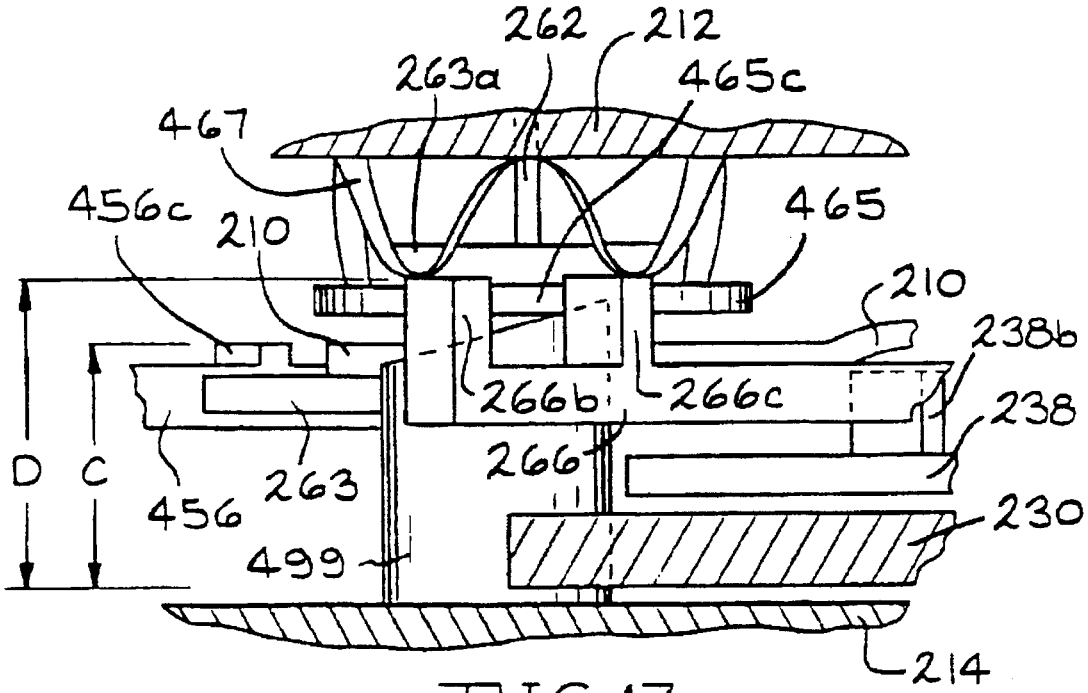
FIG. 17 is a view taken along the line 17—17 of FIG. 16.
Figure 18:
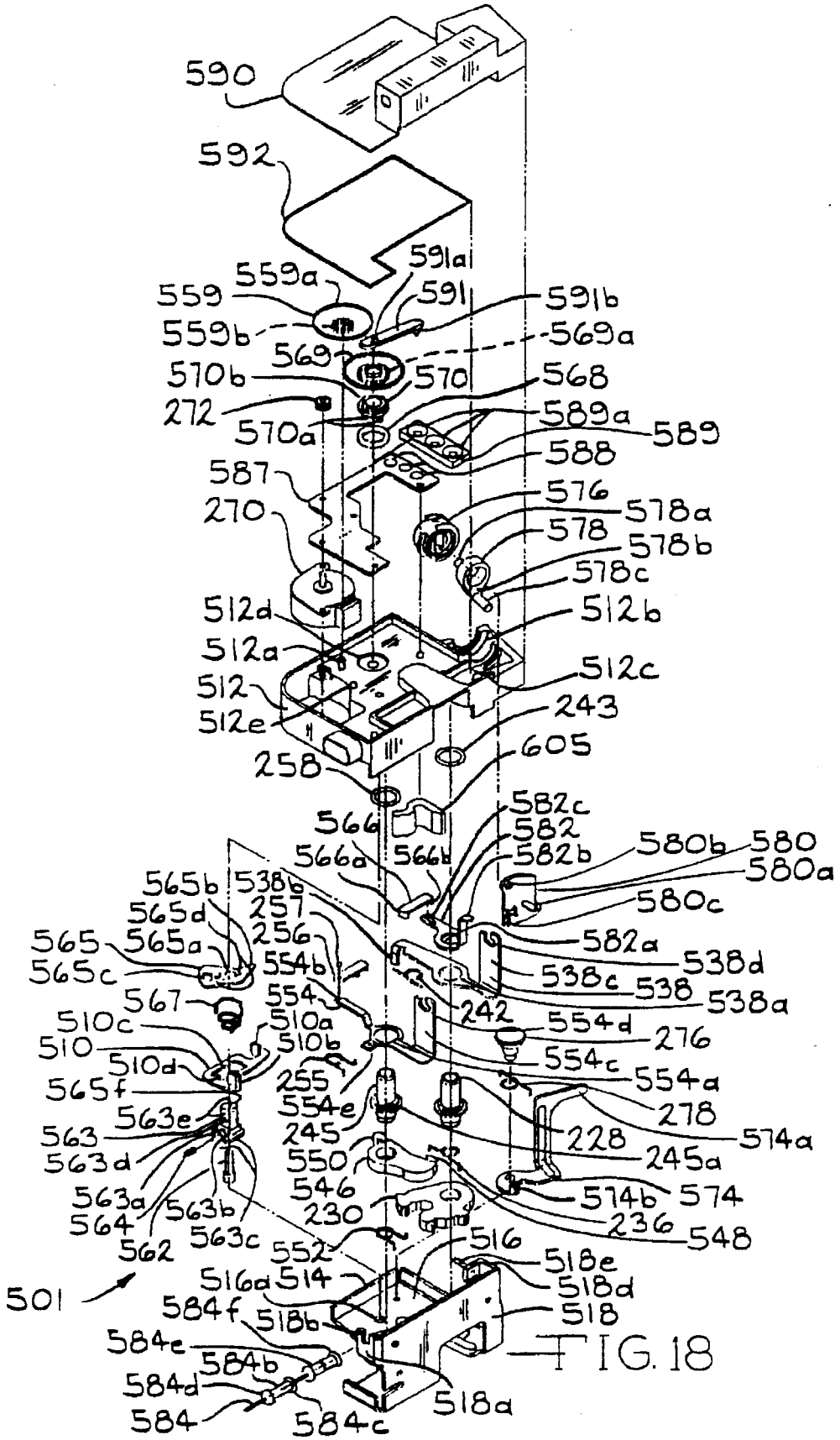
FIG. 18 is an exploded perspective view of a sixth embodiment of the latch assembly which is similar to the embodiment shown in FIG. 14 but has been modified to include a fourth type of double lock feature.

A first end of an interior lock fork 456 is provided with an aperture 456*a*. The mechanical fastener 257 is rotatably received in the aperture 456*a* in the interior lock fork 456 and the aperture 254*b* in the interior lock lever 254 to pivotally join the interior lock fork 456 to the interior lock lever 254. A second end of the interior lock fork 456 is provided with two spaced apart tines 456*b* and 456*c*. The tines 456*b* and 456*c* of the interior lock fork 456 extend upwardly, unlike the downwardly extending tines 256*b* and 256*c* of the interior lock fork 256 in the latch assembly 201. The tines 456*b* and 456*c* extend upwardly a distance "C" above the frame 214 within the latch assembly 401. As illustrated in FIG. 17, the tines 266*b* and 266*c* of the exterior lock fork 266 extend a distance "D" above the frame 214, the distance "D" being greater than the distance "C".

The lock/unlock lever 465, being coupled to the index member 263 by the boss 263*a*, pivots with the shaft 262 about the axis of the shaft 262. The lock/unlock lever 465 has arms 465*b* and 465*c* of equal length. As will be further explained below, the arm 465*b* may be selectively captured between the tines 456*b* and 456*c* of the interior lock fork 456. The arm 465*c* is captured between the tines 266*b* and 266*c* of the exterior lock fork 266 in all operating states of the latch assembly 401.

A spring or wave washer 467 is compressed between the lock/unlock lever 465 and the actuator housing 212, urging the lock/unlock lever 465 downwardly. Thus, the wave washer 467 tends to seat the arm 465*b* of the lock/unlock lever 465 between the tines 456*b* and 456*c* of the interior lock fork 456, and to seat the arm 465*c* of the lock/unlock lever 465 between the tines 266*b* and 266*c* of the exterior lock fork 266.

A pair of ramps 499 are fixed to the frame 214 on opposite sides of the shaft 262. The ramps 499 are inclined upwardly in a clockwise direction. The ramps 499 are spaced outwardly from the shaft 262 to engage the arms 465*b* and 465*c* of the lock/unlock lever 465 when the arms 465*b* and 465*c* are rotated over the ramps 499. Preferably the inclined surfaces of the ramps 499 describe a helix to permit maximum contact with the arms 465*b* and 465*c*, thereby spreading the load thereon and minimizing wear of the ramps 499.

Figure 14:
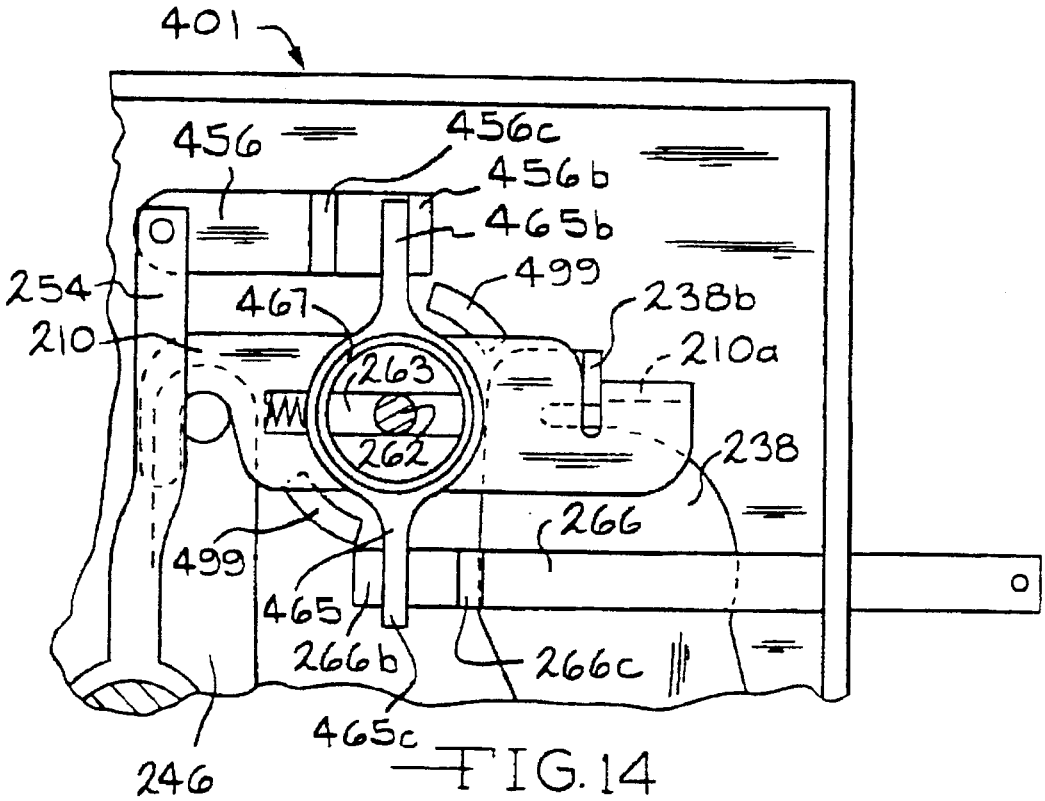
FIG. 14 is a partial plan view of a fifth embodiment of the latch assembly which is similar to the embodiment shown in FIGS. 8 through 12, but which has been modified to include a third type of double lock feature utilizing axial movement to provide double locking.

In the unlocked condition illustrated in FIG. 14, the link 210 is positioned by the index member 263 in a coupled position. When the link 210 is in the coupled position, movement of the actuator member 238 to the actuated position will cause the link 210 to move the pawl 246 to its release position, unlatching the latch assembly 401. The arms 465*b* and 465*c* of the lock/unlock lever 465 are not aligned to engage the ramps 499. The arms 465*b* and 465*c* are engaged by their respective lock forks, 456 and 266. Therefore, the latch assembly 401 may be locked by operating the interior lock mechanism, through the interior lock fork 456, the exterior lock mechanism, through the exterior lock fork 266, or the motor 270, operating through the shaft 262 and the index member 263.

Figure 15:
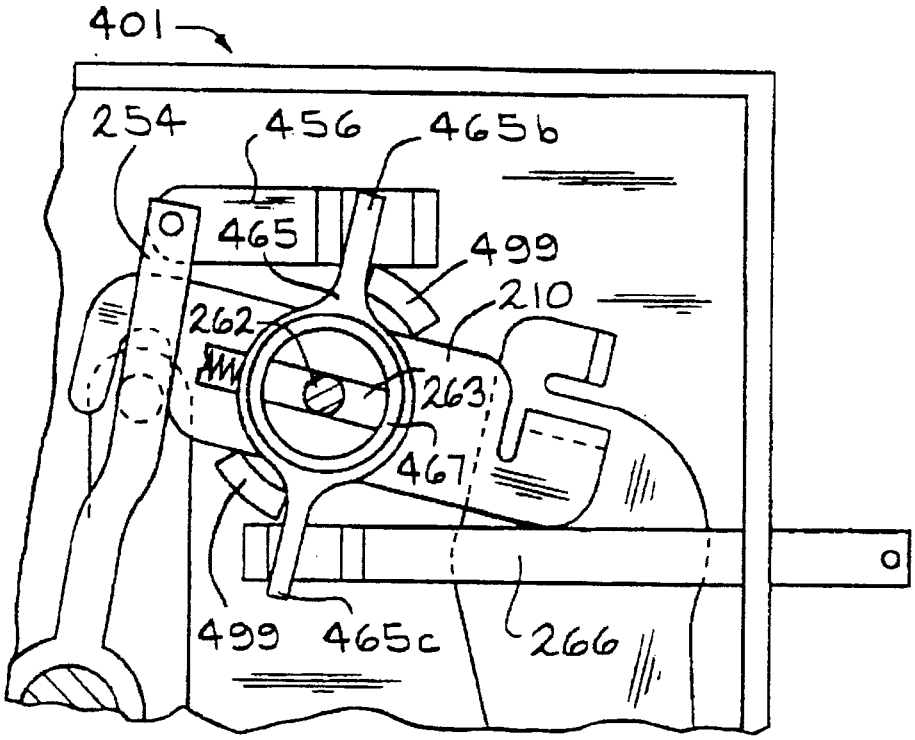
FIG. 15 is a view similar to that of FIG. 14 illustrating the latch assembly in a latched condition.

When the latch assembly 401 is in the lock condition, illustrated in FIG. 15, the link 210 is rotated to an uncoupled position in which the link 210 is disengaged from the actuator member 238. The arms 465*b* and 465*c* of the lock/unlock 465 lever abut the low end of the respective ramp 499. However, the arms 465*b* and 465*c* remain captured between the tines of the interior lock fork 456 and the exterior lock fork 266, respectively. Thus, any of the motor 270, the exterior locking mechanism, or the interior locking mechanism may be operated to unlock the latch assembly 401, returning the latch assembly to the unlock condition illustrated in FIG. 14.

Figure 16:
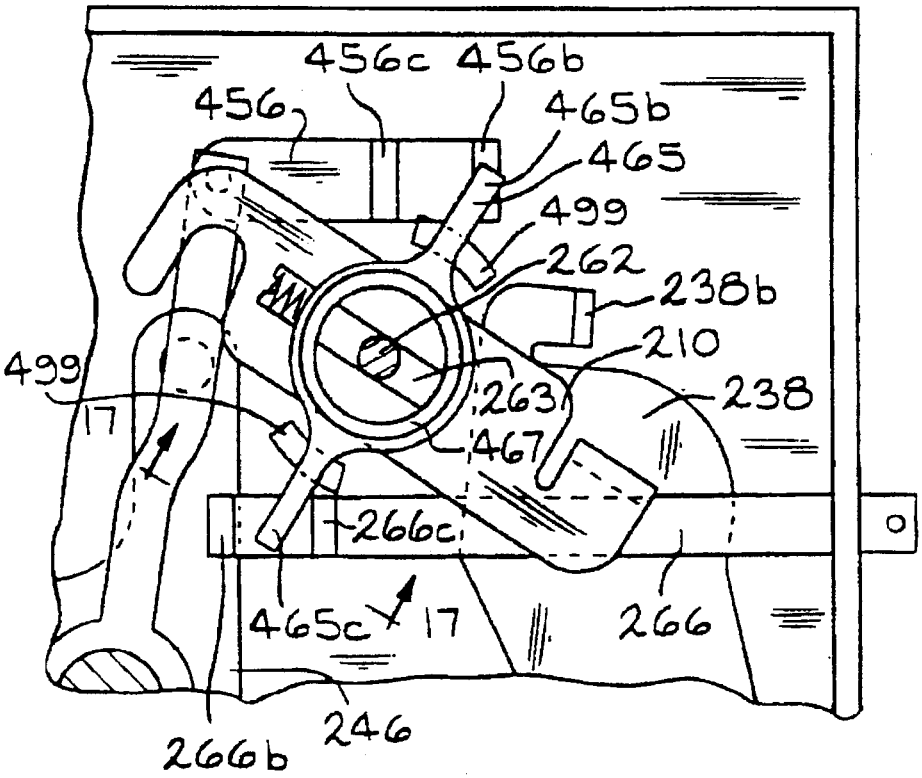
FIG. 16 is a view similar to that of FIGS. 14 and 15, illustrating the latch assembly in a double locked condition.

The exterior lock mechanism, acting through the exterior lock fork 266, or the motor 270, acting through the shaft 262 and the index member 263, may be operated to place the latch assembly 401 in the double lock condition illustrated in FIGS. 16 and 17. As the lock/unlock lever 465 is thereby rotated clockwise from the lock position illustrated in FIG. 15 to the double lock position, the arms 465*b* and 465*c* engage the inclined upper surface of the respective ramp 499, and are cammed upwardly thereby. The lock/unlock lever 465 is driven upwardly relative to the interior lock fork 456 and the exterior lock fork 266 as the lock/unlock lever 465 is rotated clockwise. Thus the lock/unlock lever 465 is moved axially upwardly on the shaft 262, compressing the wave washer 467. The link 210 remains disengaged from the actuator member 238 when the latch assembly 401 is placed in the double lock condition.

In the double lock position, the lock/unlock lever 465 is positioned greater than the distance "C" from the frame 214, and the arm 465*b* of the lock/unlock lever 465 is positioned above the upper end of the tine 456*b* of the interior lock fork 456, as shown in FIG. 16. Thus, the lock/unlock lever 465 is disengaged from the interior lock fork 456, preventing the interior lock mechanism from repositioning the latch assembly 401 to the lock or unlock positions. The overcenter spring 255 (FIG. 8) will act to keep the interior lock lever 254 against the flange 218*d* (FIGS. 9 and 10). Thus, the interior lock fork 456 is maintained in the lock position while the lock/unlock lever 465 is in the double lock position.

The lock/unlock lever 465 is not positioned greater than the distance "D" from the frame 214, and therefore the arm 465*c* remains captured between the tines 266*b* and 266*c* of the exterior lock fork 266. Either the exterior lock mechanism, operating through the exterior lock fork 266, or the motor 270, operating through the shaft 262 and the index member 263, may be operated to rotate the lock/unlock lever 465 counterclockwise back to the lock position. As the lock/unlock lever 465 is thus rotated, the arm 465*b* thereof will be moved from a position above the tine 456*b* to a position in which the arm 465*b* is captured between the tine 456*b* and the tine 456*c* of the interior lock fork 456.

FIGS. 18 through 27 illustrate a sixth embodiment of the latch assembly of this invention, indicated generally at 501. The latch assembly 501 is similar to the latch assembly 401 illustrated in FIGS. 14 through 17 in that a lock/unlock lever 465 moves axially relative to an index member 563 to selectively uncouple an interior lock fork 456. In the sixth embodiment, however, movement of the lock/unlock lever 565 is downward to disengage the interior lock fork 556, as opposed to the upward movement required in the fifth embodiment. Most of the structure of the latch assembly 501 is identical to that of the latch assembly 201 illustrated in FIGS. 8 through 12, and like reference numbers are used to indicate similar components.

Among the components of the latch assembly 501 which are not identical to that of the latch assembly 201 is the frame 514 thereof. The frame 514 includes a base portion 516 and a wall portion 518 extending upwardly from one edge of the base portion 516. The base portion 516 includes apertures to mount the stepped pins 228 and 245, as well as an aperture 516*a* to mount a pivot 562. The frame 514 also includes the notch 224 for receiving the striker bolt 226.

A first flange 518*a* extends perpendicular to the wall portion 518, over an edge of the base portion 516 of the frame 514. A notch 518*b* is formed in the upper edge of the flange 518*a* which receives a Bowden cable 584. Note that in this embodiment, the Bowden cable 584 is routed to act in the opposite direction from that of the Bowden cable 284 in the embodiment of the latch assembly 201 illustrated in FIGS. 8 through 12. A second flange 518*c* (illustrated in FIGS. 21 through 23) extends perpendicular from the wall portion 518 toward the pin 245. An L-shaped flange 518*d* extends outwardly from the wall portion 518 over the base portion 516 of the frame 514. A pivot 518*e* fixed thereto pivotally mounts a key disk 580 of the exterior lock actuating mechanism, which will be further described below.

The actuator member 538 of the latch assembly 501 is formed with an aperture 538*a*, by means of which the actuator member 538 is pivotally mounted on the pin 228, above the flange 228*a*. The actuator member 538 further includes a tab 538*b* extending downwardly therefrom, by means of which the actuator member 538 is coupled to the link 510. The actuator member 538 is provided with an upwardly extending second tab 538*c* on the other side of the aperture 538*a* from the first tab 538*b*. A notch 538*d* is formed in the upper edge of the second tab 538*c* to receive the Bowden cable 584.

A pawl 546 is pivotally mounted on the pin 228 between the flange 245*a* and the base portion 516 of the frame 514. The pawl 546 includes a hook 548 formed on one end thereof extending toward the rotor 230. An outwardly extending spur 550 is formed on the opposite end of the pawl 546 from the hook 548. The pawl 546 is adapted to be pivoted between a blocking position, in which the hook 248 engages the retaining step 234 of the rotor 230, and a release position, in which the hook 548 is disengaged from the retaining step 234. A spring 552 engages the pawl 546 and the frame 514 to urge the pawl 546 to pivot counterclockwise from the release position to the blocking position.

It should be noted that the pawl 546 can also hold the rotor 230 in a secondary latch position. In the secondary latch position, the hook 548 engages the notch 232 rather than the retaining step 234. The rotor 230 is held with the notch 232 generally out of alignment with the notch 224 in the frame 514. Thus, with the latch assembly 501 in the secondary latch condition, the release of the striker bolt 226 is prevented even thought the hook 548 of the pawl 546 does not engage the retaining step 234. It will be appreciated that the other embodiments of the latch assembly of this invention are similarly provided with a secondary latch capability.

An elongate interior lock lever 554 includes a central aperture 554*a* therethrough by means of which the interior lock lever 554 is pivotally mounted on the pin 245. A first end of the interior lock lever 554 is provided with a second aperture 554*b*, while the other end thereof is provided with an upwardly extending tab or flange 554*c*. The flange 554*c* extends longitudinally along the interior lock lever 554. A generally L-shaped notch 554*d* is formed in the upper edge of the flange 554*c*. The interior lock lever 554 may be selectively moved between an unlock position in which the flange 554*c* abuts the flange 518*c* of the wall portion 518 of the frame 514, and a lock position in which the flange 554*c* is spaced apart from the flange 518*c*. A tab 554*e* extends laterally outward from the interior lock lever and is provided with an aperture. An over-center spring 555 engages the frame 514 and the aperture in the tab 554*e* of the interior lock lever 554, urging the interior lock lever 554 from any position intermediate the lock and unlock positions toward the closer of the lock and unlock positions.

The mechanical fastener 257 is rotatably received in the aperture 256*a* in the interior lock fork 256 and the aperture 554*b* in the interior lock lever 554 to pivotally join the interior lock fork 256 to the interior lock lever 554. The tines 256*b* and 256*c* of the interior lock fork 256 are oriented to face downwardly.

As described above the pivot 562 is fixed in the aperture 516*a*, and extends upwardly from the base portion 516 of the frame 514. An elongate index member 563 includes an axially extending recess in the bottom portion thereof (not shown) into which the pivot 562 is received to rotatably mount the index member 563 on the pivot 562. The index member 563 includes a rectangular body 563*a* having a recess 563*b* formed in a first lateral face thereof. A pair of flanges 563*c* extend from the bottom of opposed second and third faces of the body 563*a*. A shaft 563*d* extends upwardly from the body 563*a*. The shaft 563*d* is generally cylindrical, but has a pair of flattened axially extending faces 563*e* which are parallel with the second and third faces of the body 563*a*. A semicircular boss 563*f* is formed on the upper surface of the shaft 563*d*. The index member 563 may be formed of any suitable material, such as a powdered metal.

The elongate link 510 has a first hook 510*a* at one end thereof and a second hook 510*b* at the other end thereof. The first hook is disposed to engage the depending tab 538*b* of the actuator member 538. The second hook is disposed to engage the spur 550 on the pawl 546. The hooks 510*a* and 510*b* preferably include respective upwardly extending tabs thereon to increase the contact area of the respective hook. An axially extending, rectangular slot 510*c* is formed in the link 510 intermediate the hook 510*a* and the hook 510*b*. The link 510 is operatively coupled to both the pawl 546 and the actuator member 538 by the hooks 510*b* and 510*a*, respectively. The link 510 may be selectively moved to a coupled and an uncoupled position. When the actuator member 538 is in its unactuated position, and the link 510 is in the coupled position, the hook 510*a* engages a portion of the tab 538*b* of the actuator 538. The hook 510*b* on the opposite end of the link 510 engages the spur 550 on the pawl 546, the hook 510*b* being positioned abutting or slightly spaced apart from the spur 550.

The shaft 563*d* of the index member 563 is slidably received in the slot 510*c* of the link 510, with the flattened sides 563*d* of the shaft 563 engaging the edges of the slot 510*c* to key the rotation of the link 510 to the index member 563. Thus the index member 563 may be selectively rotated about the longitudinal axis defined by the shaft 563*d* to cause the link 510 to rotate therewith between the coupled and uncoupled positions. The link 510 may be moved radially relative to the shaft 563*d*.

An axially extending tab 510*d* is formed at the end of the slot 510*c* closest to the hook 510*b*. A coil spring 564 is retained on the tab 510*d* and extends into the recess 563*b* in the index member 563. The spring 564 is compressed between the link 510 and the body 563*a* of the index member 563. The spring 564 biases the link 510 to move the hook 510*b* thereof away from the index member 563.

Figure 24:
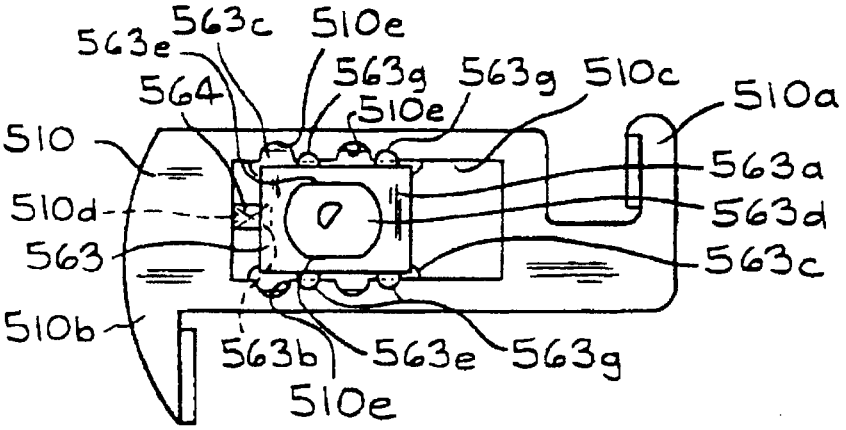
FIG. 24 is a plan view of an embodiment of the link and index member of the latch assembly illustrating the means by which the index member retains the link.

The corners of upper surface of the body 563*a* may staked or otherwise outwardly deformed to enable them to cooperate with the flanges 563*c* to retain the link 510 therebetween. Another method for retaining the link 510 in position on the index member 563 is illustrated in FIG. 24. The index member 563 may be provided with a plurality of tabs 563*g* extending outwardly from the second and third faces thereof, spaced upwardly from the flanges 563*c*. A corresponding set of recesses 510*e* are formed in the edges of the slot 510*c*. By vertically aligning the tabs 563*g* with the recesses 510*e*, the link 510 can be lowered into operating position abutting the flanges 563*c*. The link 510 can move radially relative to the index member, and when the recesses 510*e* are not vertically aligned with the tabs 563*g*, is retained between the tabs 563*g* and the flanges 510*c*. After the link 510 is placed in position against the flanges 510*c* during assembly, the link 510 is moved radially to cause the tab 510*d* at the end of the slot 510*c* to move away from the index member 563. The spring 564 can then be installed in the recess 563*b* and over the tab 510*d*. As illustrated in FIG. 24, when the link 510 is moved rightward relative to the index member 563, the spring 564 will be fully compressed, blocking further movement, before the tabs 563*g* and the recesses 510*e* are vertically aligned. Thus inadvertent disengagement of the link 510 from the index member 563 during operation is prevented.

The index member 563 is also coupled to the lock/unlock lever 565. The lock/unlock lever 565 is generally triangular in outline, and is provided with a generally hourglass shaped central opening 565*a*. The shaft 563*d* of the index member 563 extends upwardly through the opening 565*a* in the lock/unlock lever 565. As will be further explained below, the hour glass shape of the opening 565*a* cooperates with the flattened faces 563*e* of the shaft 563*d* of the index member 563 to provide a lost motion connection between the index member 563 and the lock/unlock lever 565. After lost motion, rotation of the lock/unlock lever 565 will cause concurrent rotation of the index member 563 and the link 510.

The lock/unlock lever 565 includes a first operating arm 565*b*, which is operatively coupled to the interior lock fork 256. The arm 565*b* may be selectively captured between the tines 256*b* and 256*c* formed on the interior lock fork 256. When the arm 565*b* is captured between the tines 256*b* and 256*c*, axial movement of the interior lock fork 256 against the arm 565*b* will cause the lock/unlock lever 565 to rotate, causing the link 510 to rotate therewith.

The lock/unlock lever 565 includes a second operating arm 565*c* which is provided with an aperture therethrough. An exterior lock link 566 is pivotally received in the aperture in the arm 565*c* to couple the lock/unlock lever 565 to the exterior lock actuating mechanism as will be described below. Axial movement of the exterior lock link 566 will cause rotation of the lock/unlock lever 565. Unlike the interior lock fork 256, which may be selectively disengaged from the arm 565*b*, the exterior lock link 566 remains engaged with the arm 565*c* in all operating positions of the lock/unlock lever 565.

The opening 565*a* is provided with a pair of opposed recesses 565*d* extending into respective operating arms of the lock/unlock lever 565. As will be further described below, the recesses 565*d* allow the lock/unlock lever 565 to be remotely (electrically) positioned. The lock/unlock lever 565 may be suitably formed of stamped steel, while the interior lock fork 256 and the exterior lock link 566 are preferably formed of powdered metal.

A compression spring 567 extends about the shaft 563*d* and is interposed between the body 563*a* of the index member 563 and the lock/unlock lever 565. The spring 567 urges the lock/unlock lever 565 upwardly toward an actuator housing 512. The spring 567 is preferably formed of galvanized music wire, and wound as a volute or conical spring to prevent stacking of the coils thereof as the spring 567 is compressed.

The actuator housing 512 is formed of any suitable material, preferably a molded polymeric material. Among the differences between the actuator housing 512 and the actuator housing 212 is that the actuator housing 512 includes a vertically extending pivot 512*a* fixed thereto for mounting a portion of the gear train of the latch assembly 501. The pivot 512*a* is preferably integrally molded with the actuator housing 512.

The actuator housing 512 also has a cavity 512*b* formed therein for rotatably mounting a key cylinder nut 576 of the external key cylinder. The key cylinder nut 576 is coupled to a first key lever 578 for rotation therewith by a pin 578*a* extending outwardly from the first key lever 578 to engage the key cylinder nut 576. The first key lever 578 has a crank arm 578*b* which extends downwardly through an opening 512*c* formed through the actuator housing 512. A pin 578*c* on the end of the crank arm 578*b* engages a slot 580*a* formed through the key disk 580. As previously discussed, the key disk 580 is pivotally mounted on the pivot 518*e* extending from the tab 518*d* on the wall portion 518 of the frame 514. The pivot 518*e* extends through an aperture 580*b* formed through the key disk 580 to pivotally mount the key disk 580. The key disk 580 further includes a bow-tie-shaped aperture 580*c*.

A second key lever 582 is pivotally mounted on the pin 228 above the actuator member 538. The second key lever 582 includes a central aperture 582*a* through which the pin 228 extends, a first arm 582*b* on one end of the second key lever 582 and a second arm 582*c* on the other end thereof. The first arm 582*b* initially extends upwardly, then outwardly to engage the aperture 580*c* in the key disk 580. The second arm 582*c* is provided with an arcuate slot to which is pivotally engaged by the exterior lock link 566. Rotary movement of the exterior key cylinder is transmitted through the exterior key cylinder nut 576 and the first key lever 578 to pivot the key disk 580 about the pivot 518*e*. This movement of the key disk 580 causes pivotal movement of the second key lever 582, which in turn causes axial movement of the exterior lock link 566.

Figure 19:
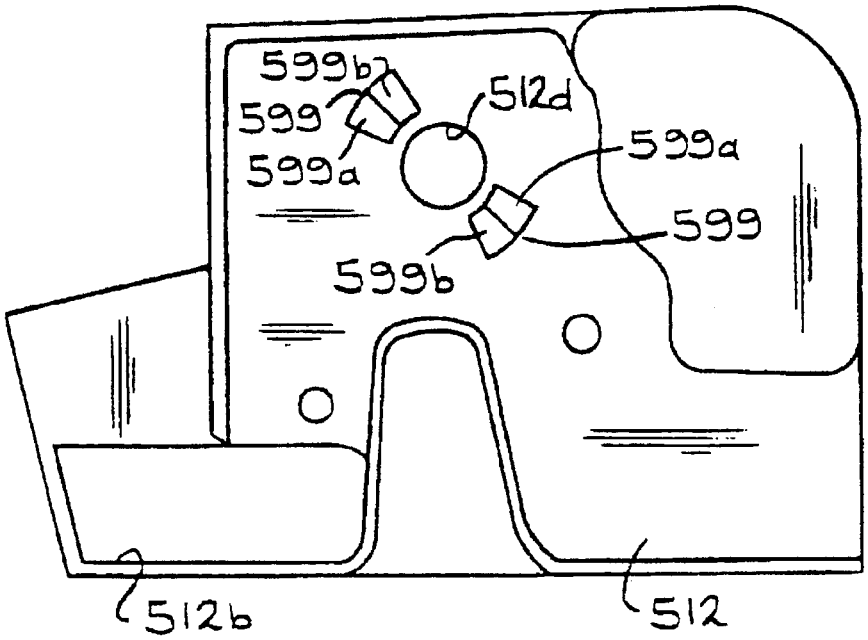
FIG. 19 is a bottom plan view of the actuator housing of FIG. 18 showing a pair of opposed ramps thereon.
Figure 20:
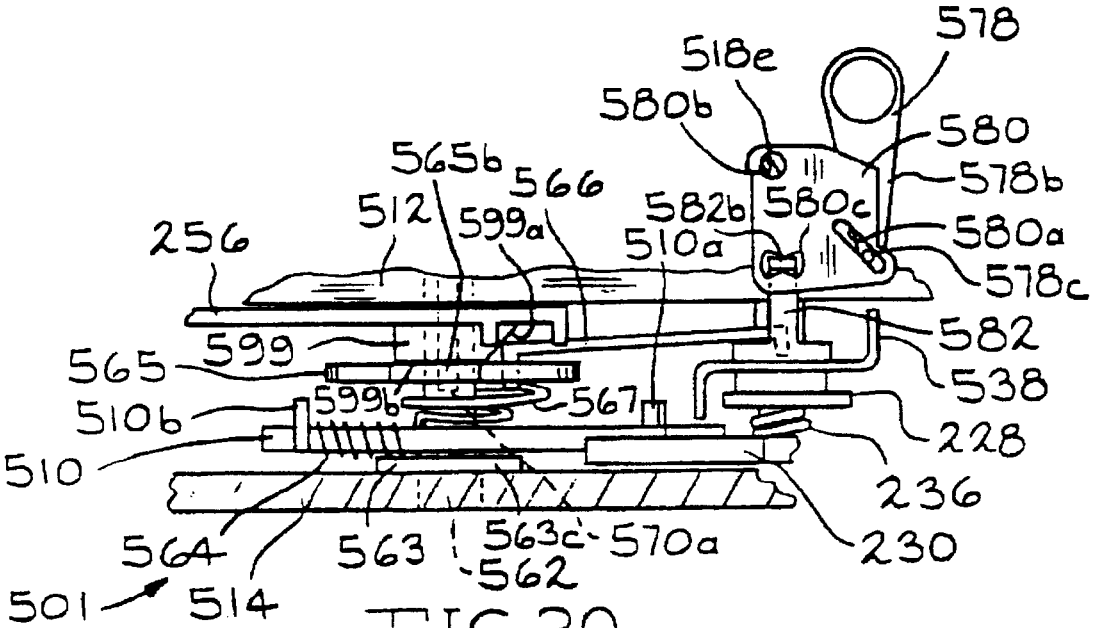
FIG. 20 is a side elevation view similar to that of FIG. 17 illustrating the latch assembly in a double lock condition.

The shaft 563*d* of the index member 563 extends upwardly through an aperture 512*d* in the actuator housing 12. As illustrated in FIGS. 19 and 20, a pair of ramps 599 are formed on the bottom the actuator housing 512 on opposite sides of the aperture 512*d*. The ramps 599 include respective inclined portions 599*a* and flat portions 599*b*. The relative position of the ramps 599 above the plane of the lock/unlock lever 565 is illustrated in broken lines in FIGS. 21 through 23. As will be further described below, the lock/unlock lever 565 may be selectively rotated toward the double lock position, causing it to engage the ramps 599, forcing the lock/unlock lever 565 downward on the index member 563, and disengaging the lock/unlock lever 565 from the interior lock fork 256, as illustrated in FIG. 20.

Above the actuator housing 512, the shaft 563*d* of the index member 563 extends upwardly through the central bore in a disk-shaped lock lever sleeve 570. The circular central bore of the lock lever sleeve 570 permits the lock lever sleeve 570 to rotate freely about the shaft 563*d*. A pair of opposed legs 570*a*, spaced inwardly from the outer circumference of the lock lever sleeve 570, depend from the lock lever sleeve 570 to engage the recesses 565*d* formed in the lock/unlock lever 565. The legs 570*a* thus couple the lock/unlock lever 565 for rotation with the lock lever sleeve 570. A seal 568 is provided to form a leak resistant seal between the outer circumference of the lower surface of the lock lever sleeve 570 and the actuator housing 512. The seal 568 is preferably formed of an elastomeric material.

The lock lever sleeve 570 has a boss 570*b* formed on the upper surface thereof. The boss 570 serves to key the lock lever sleeve 570 to an output gear 569. The output gear 569 has a recess 569*a* formed in the lower surface thereof which mates with the boss 570 to key the two components of the latch assembly 501 together. The boss 570*b* and the recess 569*a* preferably have mating pentagonal shapes, but those in the art will appreciate that other shapes will serve to key the lock lever sleeve 570 to the output gear 569 for rotation therewith. The boss 570*b* is preferably press fit into the recess 569*a* to fix the gear 569 to the lock lever sleeve 570, but the gear 569 and the lock lever sleeve 570 may jointed by other suitable methods, such as by an adhesive.

A compound gear 559 is rotatably mounted on the pivot 512*a* fixed to the actuator housing 512. The compound gear 559 includes a first gear portion 559*a* and a second gear portion 559*b* integrally formed with the first gear portion 559*a*. The pinion gear 272 mounted on the output shaft 270*a* of the motor 270 meshes with and drives the first gear portion 559*a* of the compound gear 559. The second gear portion 559*b* of the compound gear 559 meshes with and drives the output gear 569. The output gear 569 drives the lock lever sleeve 570 coupled thereto. Rotation of the lock lever sleeve 570 causes a corresponding rotation of the lock/unlock lever 565, and, through a lost motion connection, cause the link 510 to be moved. Thus, the motor 270 is provided with a gear train which includes the pinion gear 272, the compound gear 559 and the output gear 569, by means of which the motor 270 may lock, unlock, and double lock the latch assembly 501.

An exterior release lever 574 is rotatably mounted on the pivot pin 276 which is fixed in an aperture in the frame 514. The exterior release lever 574 is provided with an operating arm 574*a*, which is adapted to be engaged by an exterior latch actuating mechanism (not shown) such as an exterior door handle. The exterior release lever 574 is also provided with a hook having an upright tab 574*b*, which is operatively coupled with the actuator member 538. The exterior release lever 574 may be selectively rotated from an unactuated position to an actuated position, thereby causing the tab 574*b* thereon to engage the tab 538*b* of the actuator member 538 and rotate the actuator member 538 from its unactuated position to its actuated position. The spring 278 engages both the exterior release lever 574 and the frame 514 to urge the exterior release lever 574 to rotate out of engagement with the actuator member 538. The spring 278 is compressed when the exterior release lever 574 is rotated to drive the actuator member 538 to the actuated position.

The Bowden cable 584 of the interior latch actuating mechanism includes a cable core 584*a* which is slidable within the outer shealth, and which extends into the latch assembly 501. A plurality of barrels are fixed to the cable core 584*a* to operably couple the Bowden cable 584 to the interior lock lever 554 and the interior release lever 580 in a manner which will be described below. Each barrel includes a tubular portion having an outwardly extending circumferential flange at one end thereof.

A first barrel 584*c* and a second barrel 584*d* are fixed to cable core 584*a* with the tubular portion thereof abutting. The tubular portions of the barrels 584*c* and 584*d* are slidably received in the slot 584*d* in the flange 554*c* of the interior lock lever 554. A spring back 584*b* is disposed about the tubular portions of the barrels 584*c* and 584*d*, and interposed between the flange 554*c* and the flange portion of the barrel 584*c*.

A third barrel 584*e* and a fourth barrel 584*f* are similarly fixed to the cable core 584*a* with abutting tabular portions. The tubular portions of the barrels 584*e* and 584*f* are slidable received in the notch 538*d* formed in the tab 538*c* of the actuator member 538. The flange portions of the barrels 584*e* and 584*f* thus cooperate to form a lost motion connection between the cable core 584*a* and the actuator member 538.

A plurality of conventional dome switches 588 may be provided to provide indication of the position of the link 510. Advantageously, the switches 588 will be mounted on a circuit board 587 which is secured to the upper surface of the actuator housing 512 by heat staked pins 512*e*. The dome switches 588 are actuated by a position arm 591. The position arm 591 is provided with a semicircular aperture at one end which is secured onto the boss 563*f* on the upper end of the index member 563. Since the index member 563 is in turn keyed to the link 510, the position of the position arm 591 reflects the position of the link 510. Note that the lost motion connection between the lock/unlock lever 565 and the lock lever sleeve 570 prevents the gears 559, 569 or 272 from accurately reflecting the position of the link 510.

The position arm 591 further includes a depending finger 591*b* which bears against the switches 588 to actuate the switches 588. Preferably, the position arm 591 is formed of a spring material to urge the finger 591*b* downward against the switches 588. A detent mask 589 is preferably fitted over the dome switches 588. Conical apertures 589*a* are formed through the detent mask 589 over respective ones of each of the switches 588. The conical apertures 589*a* diverge upwardly to cam the finger 591*b* upwardly over the detent mask 589 as the finger 591*b* of the position arm 591 is moved from a position over one of the switches 588. The finger 591*b* is tapered downwardly to permit it to extend through an aperture 589*a* to actuate the respective switch 588. The finger 591*b* will engage the periphery of an aperture 589*a* to resist movement out of the aperture 589*a*. Thus a detent action is provided which will tend to hold the position arm 591, the index member 563 fixed thereto, and the link 510 keyed to the index member 563 in a desired position.

Figure 27:
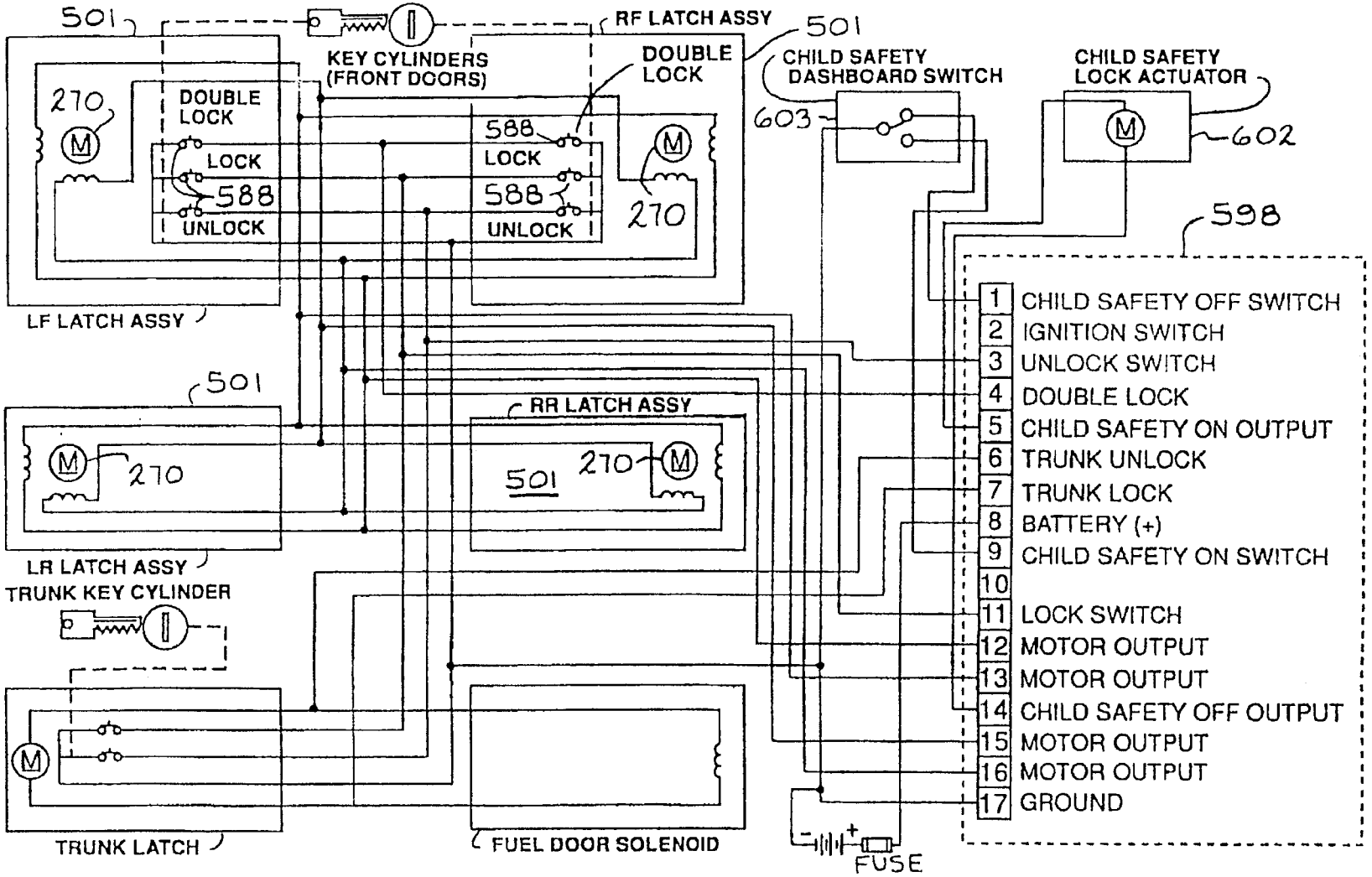
FIG. 27 is a schematic diagram of a central locking system utilizing latch assemblies of the invention

As illustrated in FIG. 27, the switches 588 are electrically connected to a central locking control module 598, as are the motors 270 in each of the latch assemblies 501 of the vehicle. The respective motor 270 of each latch assembly 501 may be controlled by the central locking control module 598 based on the position indication provided by the switches 588.

A cover 590 is provided to protect the motor 270, the gear train driven thereby, and the other components mounted above the upper surface of the actuator housing 512. An elastomeric seal 592 is compressed between the cover 590 and the actuator housing 512. The seal 592 provides a leak-tight seal between the actuator housing 512 and the cover 590. The cover 590 is secured to the actuator housing 512 by conventional means such as sonic welding, adhesive materials, or mechanical fasteners (not shown).

Figure 21:
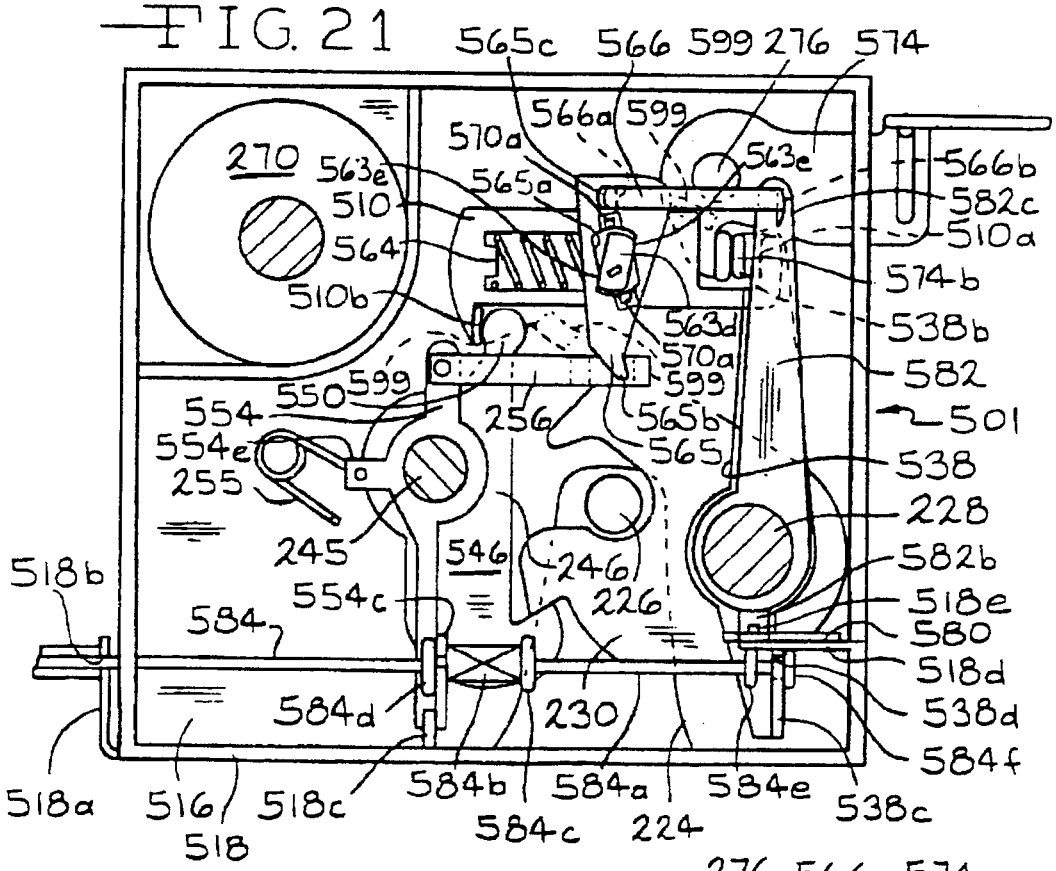
FIG. 21 is a top plan view illustrating the latch assembly in an unlocked condition.

In the unlocked condition illustrated in FIG. 21, the link 510 is positioned by the index member 563 in a coupled position. When the link 510 is in the coupled position, movement of the actuator member 538 to the actuated position will cause the link 510 to move the pawl 546 to its release position, unlatching the latch assembly 501. The arms 565*b* and 565*c* of the lock/unlock lever 565 are not aligned to engage the ramps 599. The arms 565*b* and 565*c* are respectively engaged by the interior lock fork 256 and the exterior lock link 566. Therefore, the latch assembly 501 may be locked by operating the interior lock mechanism, through the interior lock fork 256, the exterior lock mechanism, through the exterior lock link 566, or the motor 270, operating through the index member 563.

When in the unlocked position illustrated in FIG. 21, the latch assembly 501 may be unlatched from the interior of the vehicle by actuating an interior release handle (not shown) to operate the Bowden cable 584, drawing the cable core 584*a* to the left. Drawing the cable core 284*a* to the left causes the barrel 584*c* to compress the spring pack 584*b* against the flange 554*c* on the interior lock lever 554. The flange 554*c* bears against the flange 518*c*, and further rightward motion of the cable core 584*a* compresses the spring pack 584*b*. As the spring pack 584*b* is compressed, the flange on the barrel 584*f* bears against the tab 538*c* of the actuator member 538, thereby causing the actuator member 538 to rotate to the actuated position thereof. When the interior operating handle (not shown) is released, the spring pack 584*b* expands, bearing against the flange of the barrel 584*c* and urging the cable core 584*a* to the right. The flange of the barrel 584*e* bears against the tab 538*c* of the actuator member 538 and cooperates with the spring 242 to return the actuator member 538 to the unactuated position thereof.

Alternatively, the latch assembly 501 may be unlatched from the exterior of the vehicle by actuating an exterior release handle (not shown) to operate the exterior release lever 574. Rotating the exterior release lever 574 counterclockwise causes the tab 574*b* to engage the tab 538*b* and urge the actuator member 538 to rotate to the actuated position thereof.

To lock the latch assembly 501 from the interior of the vehicle, the interior locking mechanism (such as a sill button—not shown) may operated to cause the cable core 584*a* of the Bowden cable 284 to move rightward. The movement of the cable core 584*a* causes the barrel 584*d* to urge the interior lock lever 554 to rotate from the unlock position thereof, illustrated in FIG. 21, counterclockwise toward the lock position thereof (not illustrated). As the interior lock lever 554 moves, the interior lock fork urges the lock/unlock lever 565 to rotate clockwise.

Alternatively, the motor 270 may be energized to rotate clockwise. The pinion gear 272 will cause the compound gear 559 to rotate counterclockwise, which in turn will drive the output gear 559 clockwise. The clockwise motion of the output gear 559 will be transmitted to the lock lever sleeve 570, and the legs 570*a* thereof, engaging the recesses 565*d* of the lock/unlock lever 565, will cause the lock/unlock lever 565 to rotate clockwise.

The latch assembly 501 may also be locked from the exterior of the vehicle by actuating the key cylinder (only the key cylinder nut 576 thereof is shown) of the exterior lock actuating mechanism. As previously described, the key cylinder may be rotated to cause axial movement of the exterior lock link 566, and thus cause the lock/unlock lever 565 to rotate clockwise.

Figure 22:
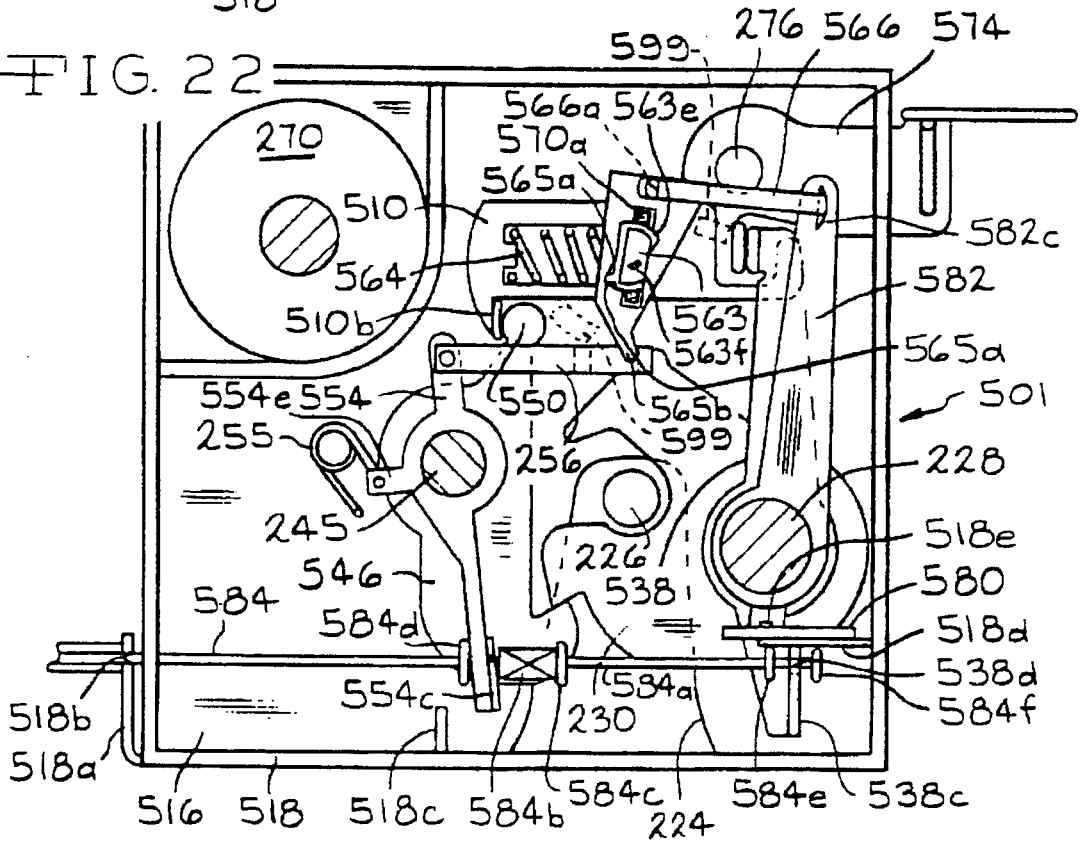
FIG. 22 is a view similar to that of FIG. 21 illustrating the latch assembly in an unlocked condition with no remaining lost motion in moving toward a locked condition.

During the first portion of the clockwise motion of the lock/unlock lever 565, however caused, the rotary motion of the lock/unlock lever 565 is not transmitted to the index member 563. The rotary motion is therefore not transmitted to the link 510. When the edges of the aperture 565*a* of the lock/unlock lever 565 contact the flattened faces 563*e* of the index member 563, as illustrated in FIG. 22, the index member 563 and the link 510 begin to rotate with the lock/unlock lever 565. During the first portion of the movement of the interior lock lever 554, the overcenter spring 255 is compressed, and opposes the motion of the interior lock lever 554. After this first portion of movement of the interior lock lever 554, the overcenter spring 255 switches from opposing the motion of the interior lock lever 554 to aiding the motion as the overcenter spring 255 expands. The lost motion connection between the lock/unlock lever 565 and the index member 563 ensures that the overcenter spring 255 is urging the interior lock lever 554 toward the lock position thereof when the link 510 is in the lock position.

When the latch assembly 501 is in the lock condition, which is not illustrated, the link 510 is rotated to an uncoupled position in which the link 510 is disengaged from the actuator member 538. The arms 565*b* and 565*c* of the lock/unlock 565 lever abut the low end of the respective ramp 599. However, the arm 565*b* remains captured by the tines of the interior lock fork 256 and and the arm remains 565*c* coupled to the exterior lock link 566. Thus, any of the motor 270, the exterior lock actuating mechanism, or the interior lock actuating mechanism may be operated to unlock the latch assembly 501, returning the latch assembly to the unlock condition illustrated in FIG. 14.

To unlock the latch assembly 501 from the interior of the vehicle, the Bowden cable 584 may be operated to cause the cable core 584*a* to move rightward. The barrel 584*c* drives the spring pack 584*b* against the flange 554*c* of the interior lock lever 554. The spring pack 584*b* does not significantly compress, but rather drives the interior lock lever 554 from the lock position toward the unlock position. The overcenter spring 255 will act to drive the interior lock lever 554 toward the unlock position during the last portion of movement toward the unlock position. The interior lock fork 256 in turn causes the lock/unlock lever 565 and the index member 563, and thus the link 510, to return to the unlock positions thereof. Additionally, the arm 565*b* of the lock/unlock lever 565 drives the exterior lock link 566 to the unlock position.

Figure 23:
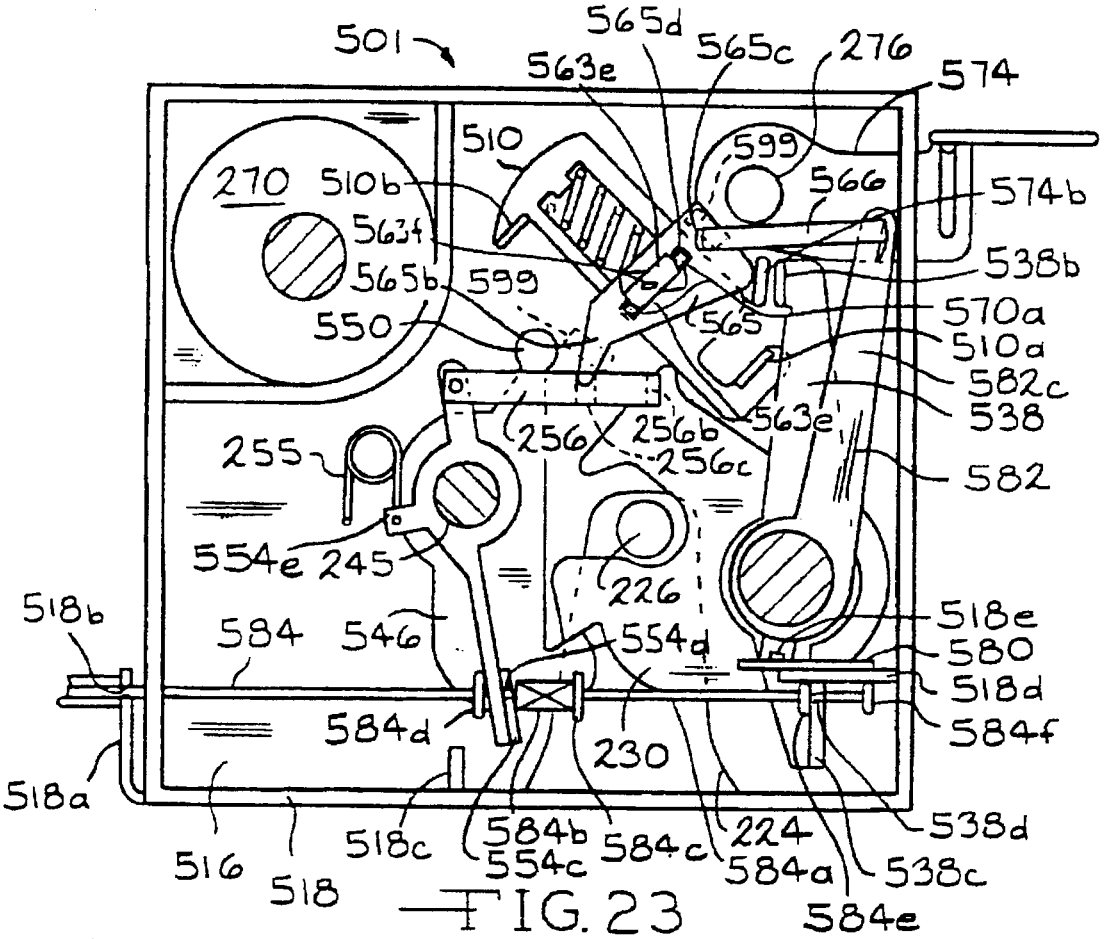
FIG. 23 is a view similar to that of FIGS. 21 and 22 illustrating the latch assembly in a double locked condition.

The exterior lock mechanism, acting through the exterior lock link 566, or the motor 270, acting through the index member 563, may be operated to place the latch assembly 501 in the double lock condition illustrated in FIGS. 20 and 23. As the lock/unlock lever 565 is thereby rotated clockwise from the lock position to the double lock position, the arms 565*b* and 565*c* engage the inclined upper surface of the respective ramp 599, and are cammed downwardly thereby. The lock/unlock lever 565 is driven downwardly relative to the interior lock fork 256 as the lock/unlock lever 465 is rotated clockwise, causing the arm 465*b* thereof to move out from between the tines 256*b* and 256*c* thereof. As the lock/unlock lever 565 is moved axially downwardly on the shaft 563*d* of the index member 563, compressing the spring 567. The exterior lock link 566 tilts to remain engaged with both the lock/unlock lever 465 and the second key lever 582. The link 510 remains disengaged from the actuator member 538 when the latch assembly 501 is placed in the double lock condition.

Thus, the lock/unlock lever 565 is disengaged from the interior lock fork 256, preventing the interior lock mechanism from repositioning the latch assembly 501 to the lock or unlock positions. The overcenter spring 255 will act to keep the interior lock lever 554, and thus the interior lock fork 256, in the lock position while the lock/unlock lever 565 is in the double lock position. The arm 565*c* remains coupled to the second key lever 582 through the exterior lock link 566. Either the exterior lock mechanism, operating through the exterior lock link 566, or the motor 270, operating through the index member 563, may be operated to rotate the lock/unlock lever 565 counterclockwise back to the lock position. As the lock/unlock lever 565 is thus rotated, the arm 565*b* thereof will be moved from a position below the tine 256*c* to a position in which the arm 565*b* is captured between the tine 256*b* and the tine 256*c* of the interior lock fork 256.

Figure 25:
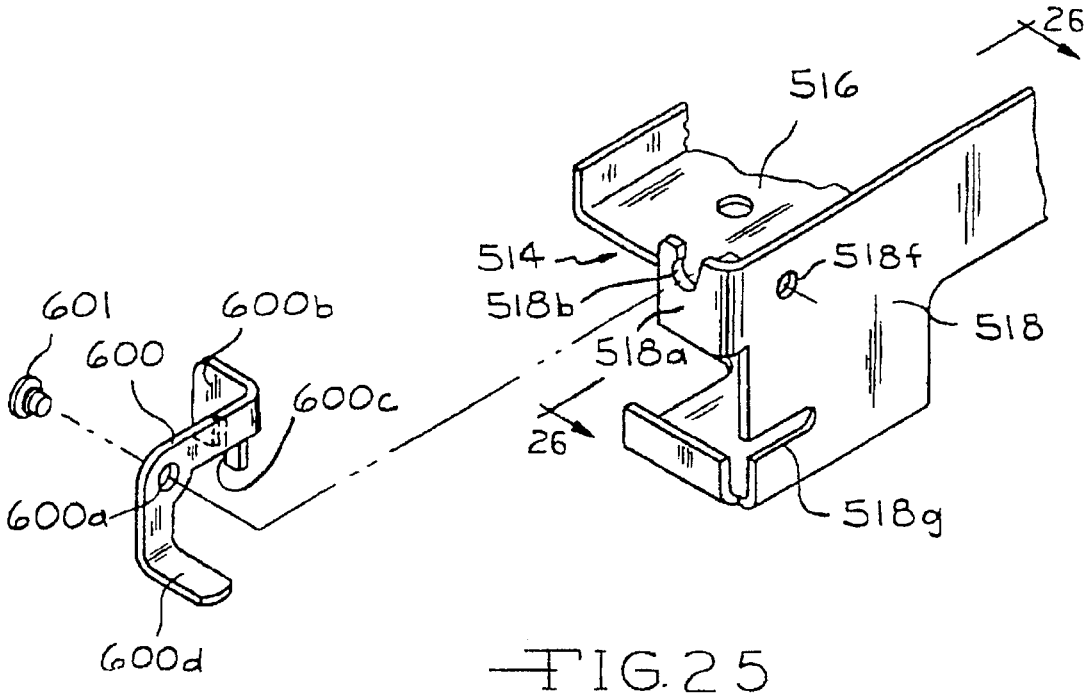
FIG. 25 is a partial exploded perspective view of the latch assembly illustrating a child safety lock lever.
Figure 26:
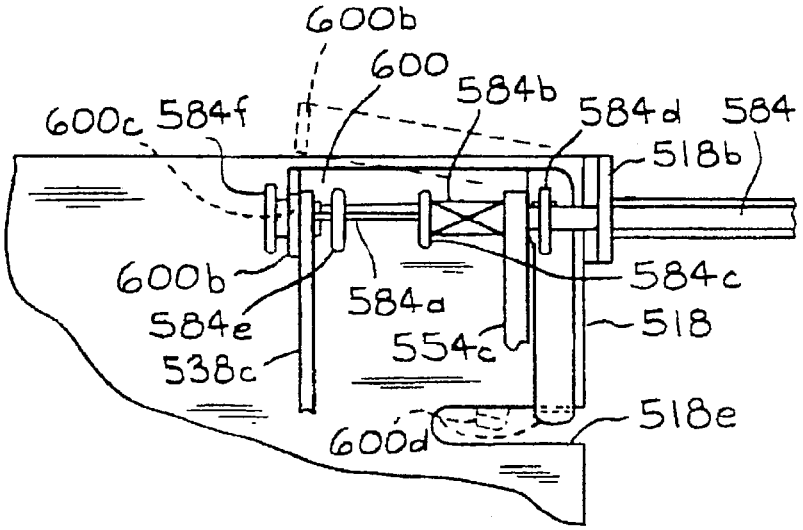
FIG. 26 is a view taken along the line 26—26 of the FIG. 25.

The latch assembly 501 may be provided with a child safety lock feature, as illustrated in FIGS. 25 through 27. A child safety lock feature prevents a vehicle door from being unlocked from the inside of the vehicle when the safety lock feature is activated. The frame 514 can be provided with an aperture 518*f* and a laterally extending notch 518*g* in the wall portion 518 thereof. A child safety lock lever 600 includes an aperture 600*a* therethrough. A pivot 601 extends through the aperture 600*a* and is fixed in the aperture 518*f* through the wall portion 518 to rotatably mount the lever 600. The lever 600 includes a tab 600*b* extending over the base portion 516 of the frame 514. A notch 600*c* is formed in the lower edge of the tab 600*b*. The lever 600 also includes a second tab 600*d* which extends horizontally through the notch 518*g* in the wall portion 518.

As shown in FIG. 26, the lever 600 may be selectively moved between a blocking position shown in solid lines, and a non-blocking position, shown in broken lines. In the blocking position, the notch 600*c* is fitted over the Bowden cable 584 so that the tab 600*b* is interposed between the flange of the barrel 584*f* and the tab 538*c* on the actuator member 538. Thus, unlatching is prevented from the interior of the vehicle, since the barrel 584*f* is prevented by the lever 600 from urging the actuator member 538 to the actuated position thereof. In the non-blocking position, the tab 600*b* is removed from between the flange of the barrel 584*f* and the actuator member 538, allowing normal unlatching of the latch assembly 501 from inside the vehicle.

The lever 600 may be moved by manually positioning the tab 600*d*. Remote operation of the lever 600 may be provided as illustrated in FIG. 27. A child safety lock actuator 602 may be coupled to the tab 600*d* or other portion of the lever 600 and operated to selectively move the lever 600 between the blocking position and the non-blocking position. The actuator 602 may be any suitable remote actuator, such as an electric motor or solenoid. Preferably, the actuator 602 will be controlled by manipulating a child safety dashboard switch 603. The switch 603 operates through the central locking control module 598 to control the actuator 602.

Referring again to FIG. 18, the latch assembly 501 is preferably provided with a deceleration bumper 605. The bumper 605 extends between the actuator housing 512 and the frame 514. The bumper 605 extends about the inner end of the notch 224 in the base portion 516 of the frame 514. The striker bolt 226 will engage the bumper 605 when it reaches the inner end of the notch 224 and be relatively gently slowed to a stop thereby. The bumper 605 thus limits the stress and wear which might otherwise result if the striker bolt 226 were to directly strike stationary parts of the latch assembly 501.

The preferred embodiment of the present invention, and exemplary alternate embodiments have been discussed in this application. However, various modifications of the present invention, and applications therefor, will be apparent to those of ordinary skill in the art after studying this application. Accordingly, such modifications and changes in application can be carried out without departing from the scope of the invention. For example, in the fifth embodiment, the latch assembly 401 may be modified such that the tines 456*b* and 456*c* of the interior lock fork 456 extend upwardly the distance "D" above the frame 214. A portion of the arm 465*b* of the lock/unlock lever 456 may be bent upwardly relative to the arm 465*c*, thus causing the arm 465*b* to disengage the interior lock fork 456 while the arm 456*c* remains engaged with the exterior lock link 566 as the lock/unlock lever 465 is moved axially upwardly relative to the shaft 262. Thus the latch assembly 401 may be modified to provide yet another method of selectively uncoupling the exterior locking mechanism from the lock of the latch assembly 401 in the double lock condition thereof.

FIGS. 28 through 32 illustrate another embodiment of the latch assembly of this invention. The latch assembly indicated generally at 701 is generally identical in structure to the latch assembly 201 illustrated in FIGS. 8 through 12. The latch assembly 701 has a frame 714 which has an upstanding wall portion 718. Formed on the wall portion 718 is an inwardly extending flange 718*b* which has a notch 718*c* formed therein, the purpose of which will be described below. Also formed on the upstanding wall portion 718 is an inwardly extending pivot pin 719, a second inwardly extending pivot pin 720, inwardly extending anchor pin 721, and an inwardly extending stop 722.

Figure 28:
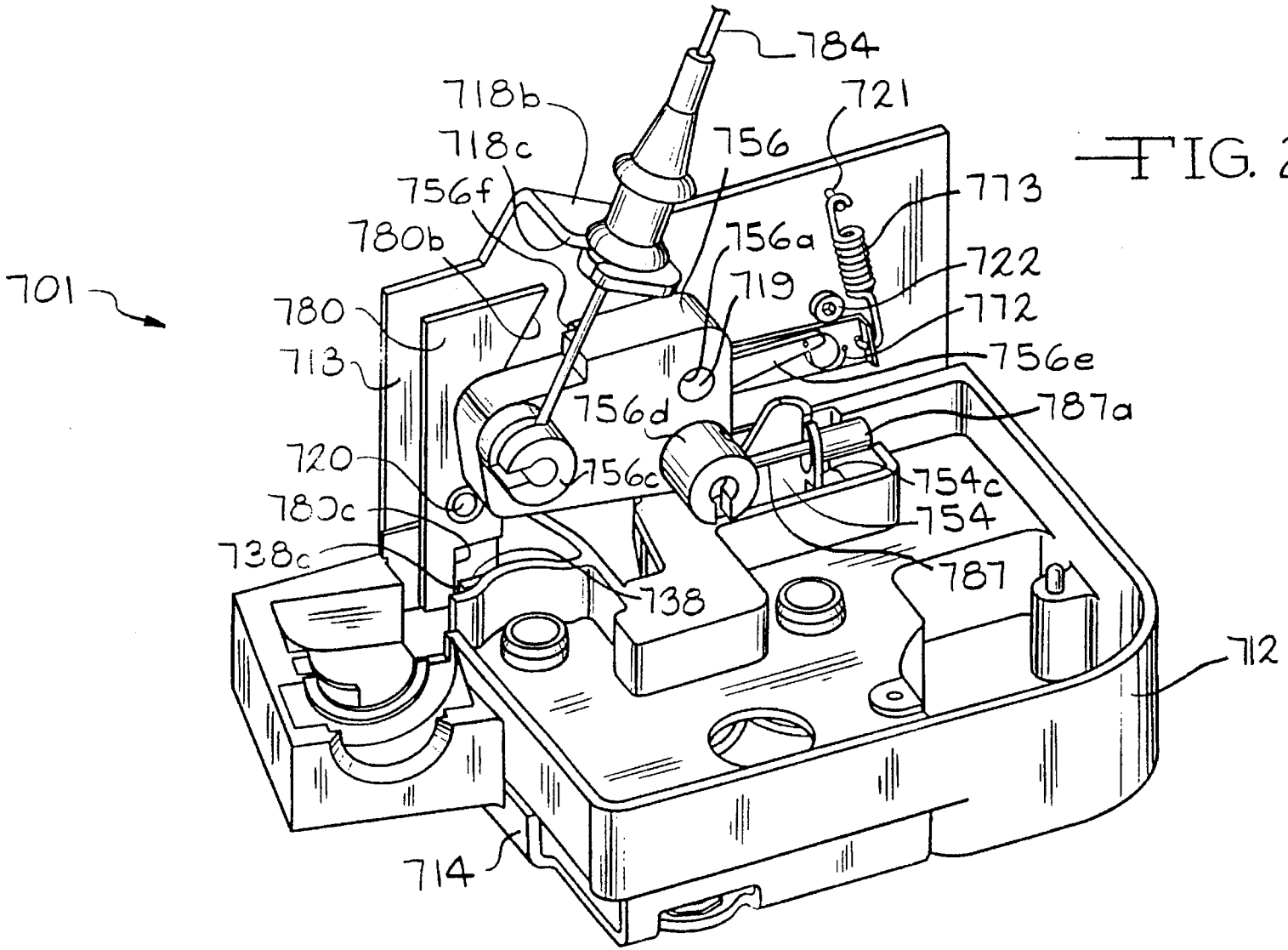
FIG. 28 is a perspective view of an embodiment of a latch assembly of this invention having a lost motion connection with a Bowden cable.

The latch assembly 701 also includes a housing 712 which fits over the frame 714 and the components mounted therein in a manner similar to the housing 212 in the latch assembly 201 described above. As seen in FIG. 28, an actuator member 738 similar to actuator member 238 has a tab 738*c* which extends upwardly through the housing 712. Similarly, the latch assembly 701 has an interior lock lever 754 which is similar to the interior lock lever 254 described above. A tab 754*c* formed on the interior lock lever 754 extends upwardly through the housing 712.

A bell crank lever 756 is pivotally mounted on the pivot pin 719 by means of a central bore 756*a*. The bell crank lever 756, has an axially extending lug 756*b* shown in FIGS. 29 through 32, which has a pair of opposed flattened sides. The lug 756*b* extends toward the wall 718. The bell crank lever 756 also is provided with a first retaining boss 756*c*, a second retaining boss 756*d*, and a radially outwardly extending arm 756*e*, opposite the first retaining boss 756*c*. The surface of the bell crank lever 756 most adjacent the wall 718 has a step 756*f* formed therein such that the retaining boss 756*c* is on a relatively thin portion of the bell crank lever 756 and the retaining boss 756*d* is on a relatively thick portion of the bell crank lever 756.

Figure 29:
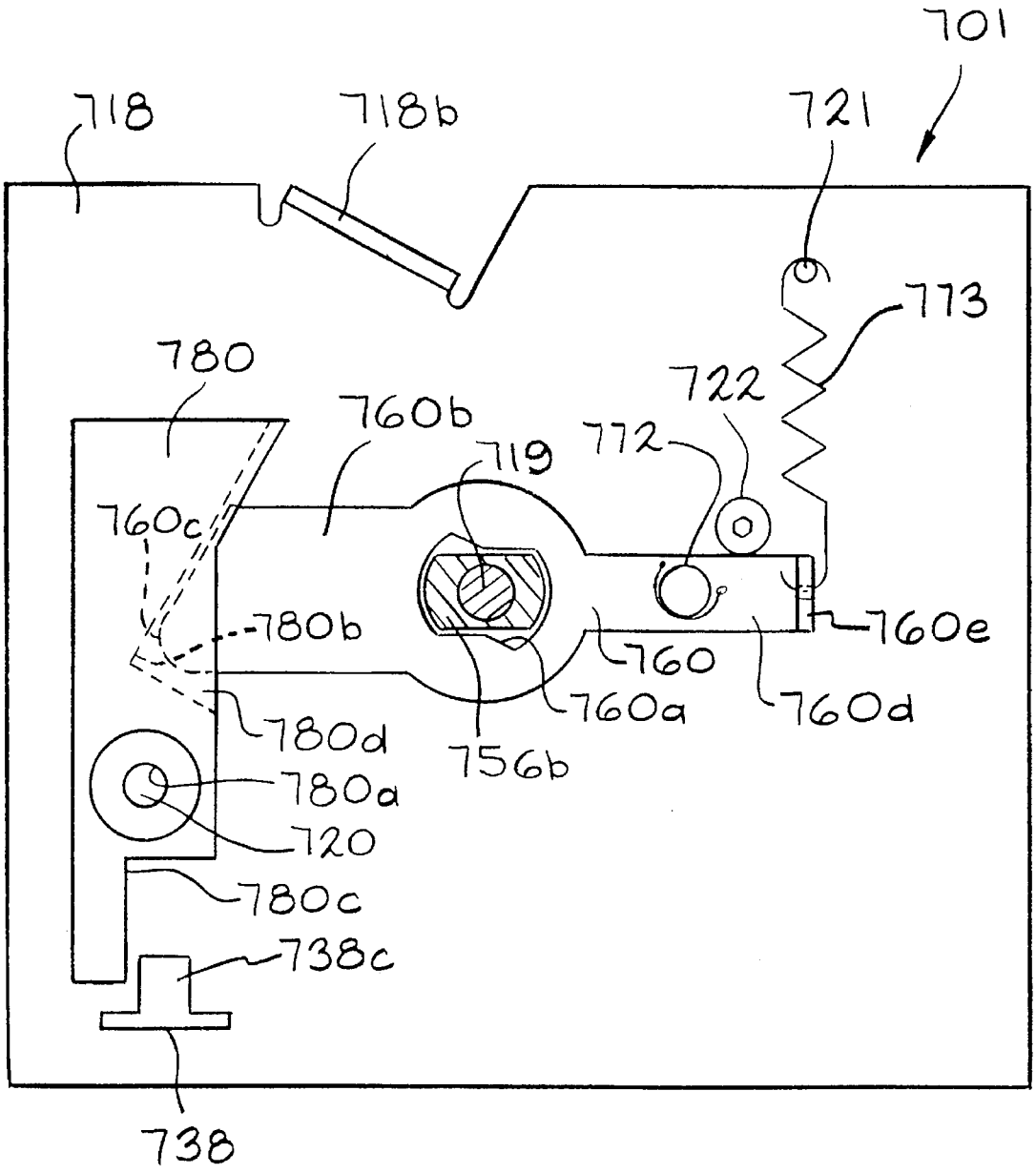
FIG. 29 is a schematic view of the components providing the lost motion connection in FIG. 28, with a cross sectional view of the lug on the bell crank lever shown in FIG. 28.

FIG. 29 is a view taken as a cross section through the lug 756 and the pivot pin 719. As shown therein, a lost motion lever 760 is mounted for restricted pivotal movement about the lug 756*b* of the bell crank lever 756. The lost motion lever 760 has a central opening 760*a* which is a generally hour glass shape opening. The constricted "waist" portion of the opening 760*a* prevents continuous rotation of the lost motion lever about the flattened lug 756*b*, such that the opening 760*a* cooperates with the lug 756*b* to form a lost motion connection between the lost motion lever 760 and the bell crank lever 756. The lost motion lever 760 has a first arm 760*b* which terminates in a cam surface 760*c*. The lost motion lever 760 has a second arm 760*d* which terminates in a inwardly extending tab 760*e*.

An over-center spring 772 is fixed at one end to the second arm 760*d* of the lost motion lever and at the other end thereof to the arm 756*e* of the bell crank lever 756. The over-center spring 772 acts under compression at all times.

The second arm 760*d* of the lost motion lever 760 is urged against the stop 722 by a return spring 773. The return spring 773 is fixed at one end to the tab 760*e* of the lost motion lever 760. The other end of the return spring 773 is fixed to the anchor pin 721.

The latch assembly 701 has an interior release lever 780 pivotally mounted upon the wall 718. The interior release lever 780 has a central opening 780*a* through which the pivot pin 720 extends to pivotally mount the interior release lever 780 on the upstanding wall 718. The interior release lever 780 has a first cam surface 780*b* disposed adjacent the cam surface 760*c* of the lost motion lever 760. The interior release lever 780 has a second cam surface 780*c* formed at the opposite end of the interior release lever 780 from the first cam surface 780*b*. As shown in FIG. 29, the cam surface 780 forms the bottom of a pocket 780*d* which receives the first arm 760*b* of the lost motion lever 760. The two opposed sides of the pocket 780*d* retain the first arm 760*b* of the lost motion lever 760 therebetween, ensuring alignment of the cam surface 760*c* of the lost motion lever 760 with the cam surface 780*b* of the interior release lever 780. For clarity of illustration, the pocket 780*d* is not depicted in FIGS. 30 through 32.

The second cam surface 780*c* of the interior release lever 780 is disposed adjacent a tab 738*c* on an actuator member 738. The actuator member 738 is similar in function and operation to the actuator member 238, and the tab 738*c* corresponds with the second tab 238*c*.

Figure 30:
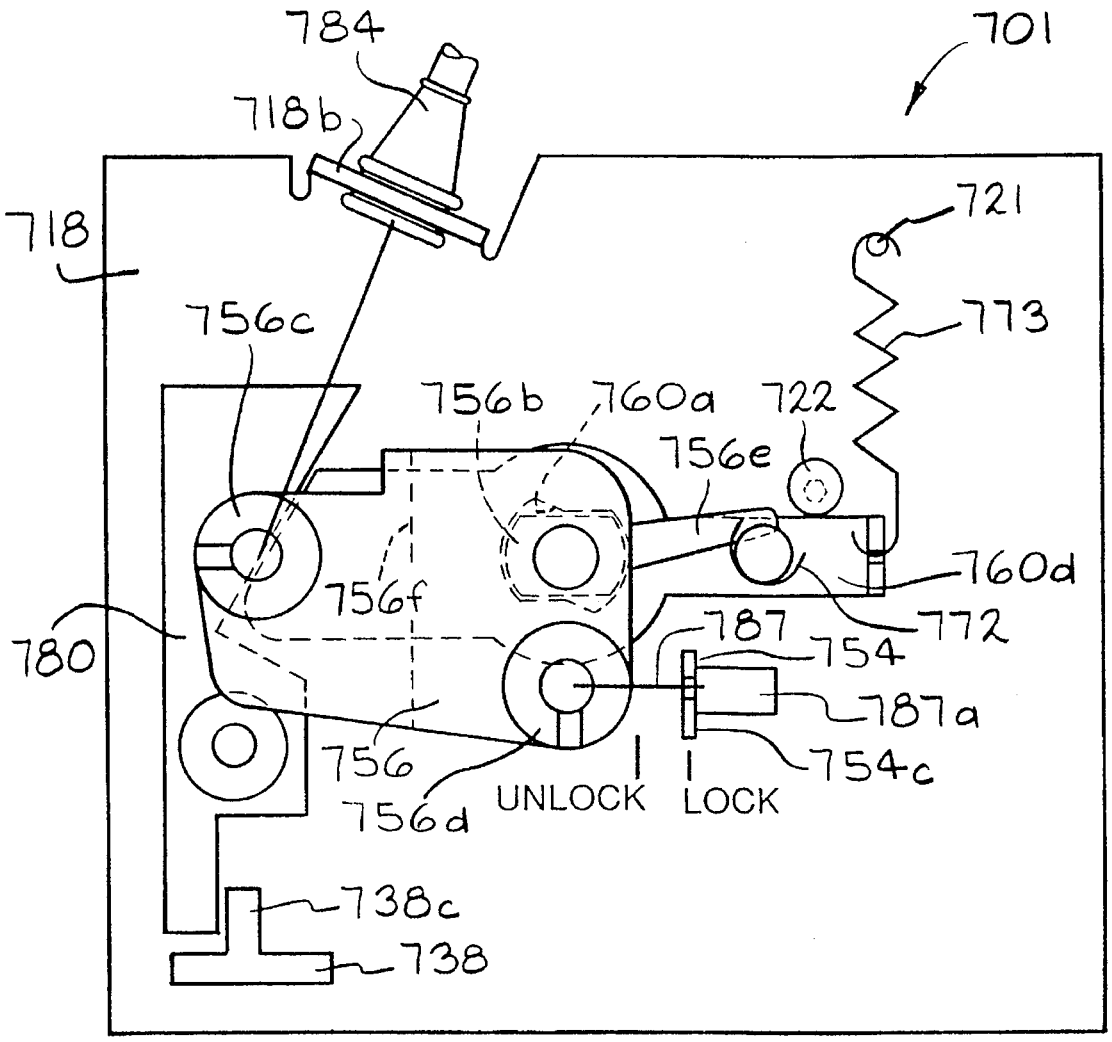
FIG. 30 is a schematic view of a portion of the latch assembly shown in FIG. 28, with the latch assembly in a locked condition.

Referring to FIG. 30, a Bowden cable 784 is fixed by the outer sheath thereof to the notch 718*c* in the flange 718*b* on the wall 718. The inner cable of the Bowden cable 784 is fixed to the bell crank 756 by the retaining boss 756*c*. The bell crank lever 756 is operatively coupled to the interior lock lever 754 by a cable 787 which extends from the retaining boss 756*d* on the bell crank 756 to the tab 754*c* on the interior lock lever 754. A spring pack 787*a* is fixed to the cable 787 on the opposite side of the tab 754*c* from the retaining boss 756*d*.

FIG. 30 illustrates the latch assembly 701 in a locked condition. The inner cable of the Bowden cable 784 is fully extended causing the retaining boss 756*c* to be in its lowermost position. The arm 756*e* of the bell crank lever 756 is disposed above the centerline of the lost motion lever 760. The return spring 773 holds the second arm 760*d* of the lost motion lever 760 against the stop 722. The spring pack 787*a* is uncompressed and the interior lock lever 754 is in the lock position of the lost motion lever 760 against the stop 722. With the interior lock lever 754 in the locked position the link (not shown) of the latch assembly 701 is moved to the uncoupled position, thereby locking the latch assembly 701.

Figure 31:
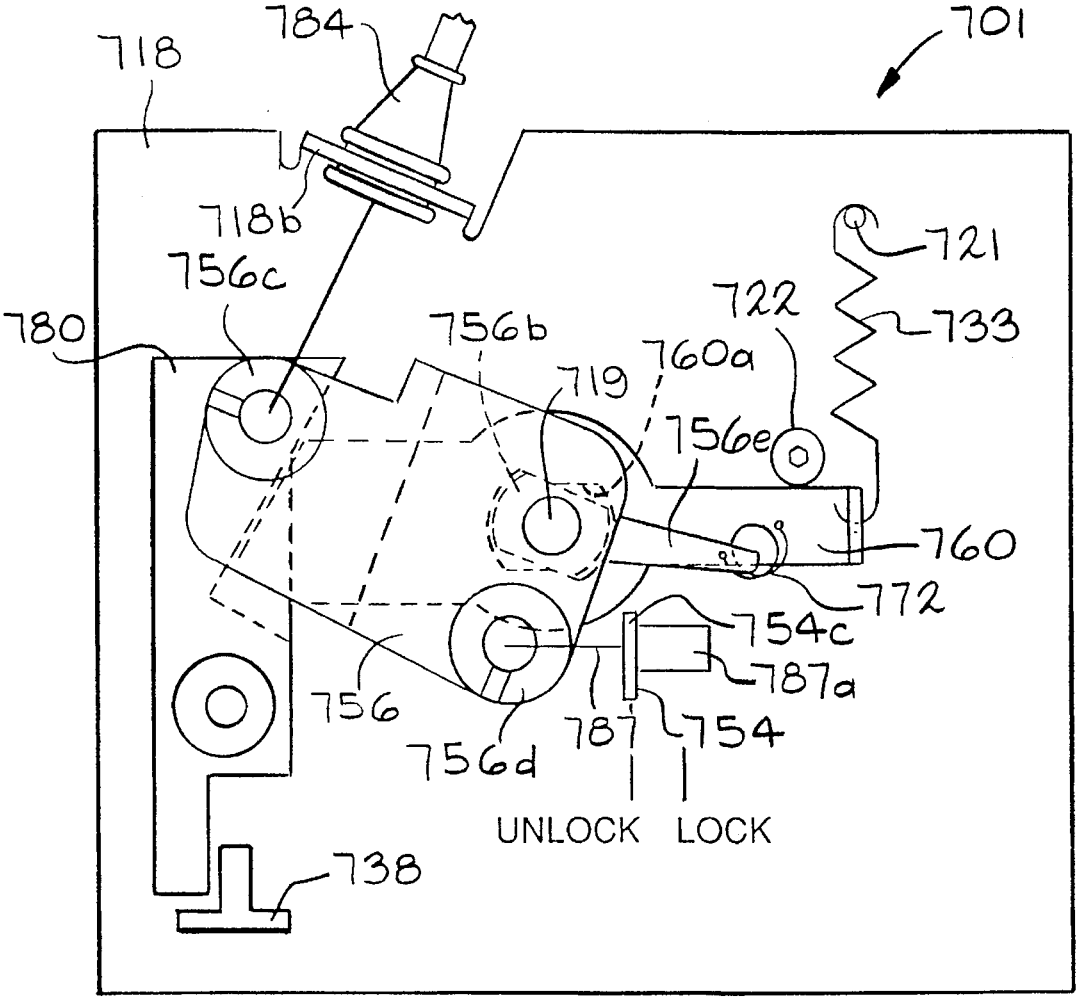
FIG. 31 is a view similar to FIG. 30, except showing the latch assembly in an unlocked condition.

Referring now to FIG. 31, the latch assembly 701 is shown therein in an unlocked position. The inner cable of the Bowden cable 784 is retracted slightly causing the retaining boss 756*c* of the bell crank lever 756 to be urged upwardly, to rotate the bell crank lever 756 about the pivot pin 719. Rotation of the bell crank lever 756 causes the retaining boss 756*d* to pull the cable 787, urging the spring pack 787*a* against the tab 754*c* of the interior lock lever 754. The interior lock lever 754 is thereby urged to the unlocked position thereof. Rotation of the bell crank lever does not cause the lost motion lever 760 to rotate, owing to the hour glass shape of the central opening 760*a* in the lost motion lever, which provides a lost motion connection between the interior operating handle (not shown) connected to the Bowden cable 784, and the power operated components of the latch assembly 701. This lost motion connection limits the force needed to manually operate the latch assembly 701. During rotation of the bell crank lever 756, the arm 756*e* of the bell crank lever moves the centerline of the lost motion lever 760. As the arm 756*e* moves toward the centerline during the first part of this motion, the over-center spring 772 is compressed. After the arm 756*e* passes over the centerline of the lost motion lever 760, the over-center spring 772 acts to urge the arm 756*e* to continue rotating in the same direction. This change in resistance to movement of the bell crank lever 756 is felt by the operator at the other end of the Bowden cable 784 as a distinct "snap", thereby letting the user know that the latch assembly 701 is now in an unlocked position. The lost motion lever 760 does not rotate, as stated above, and continues to be held against the stop 722 by the return spring 773.

Figure 32:
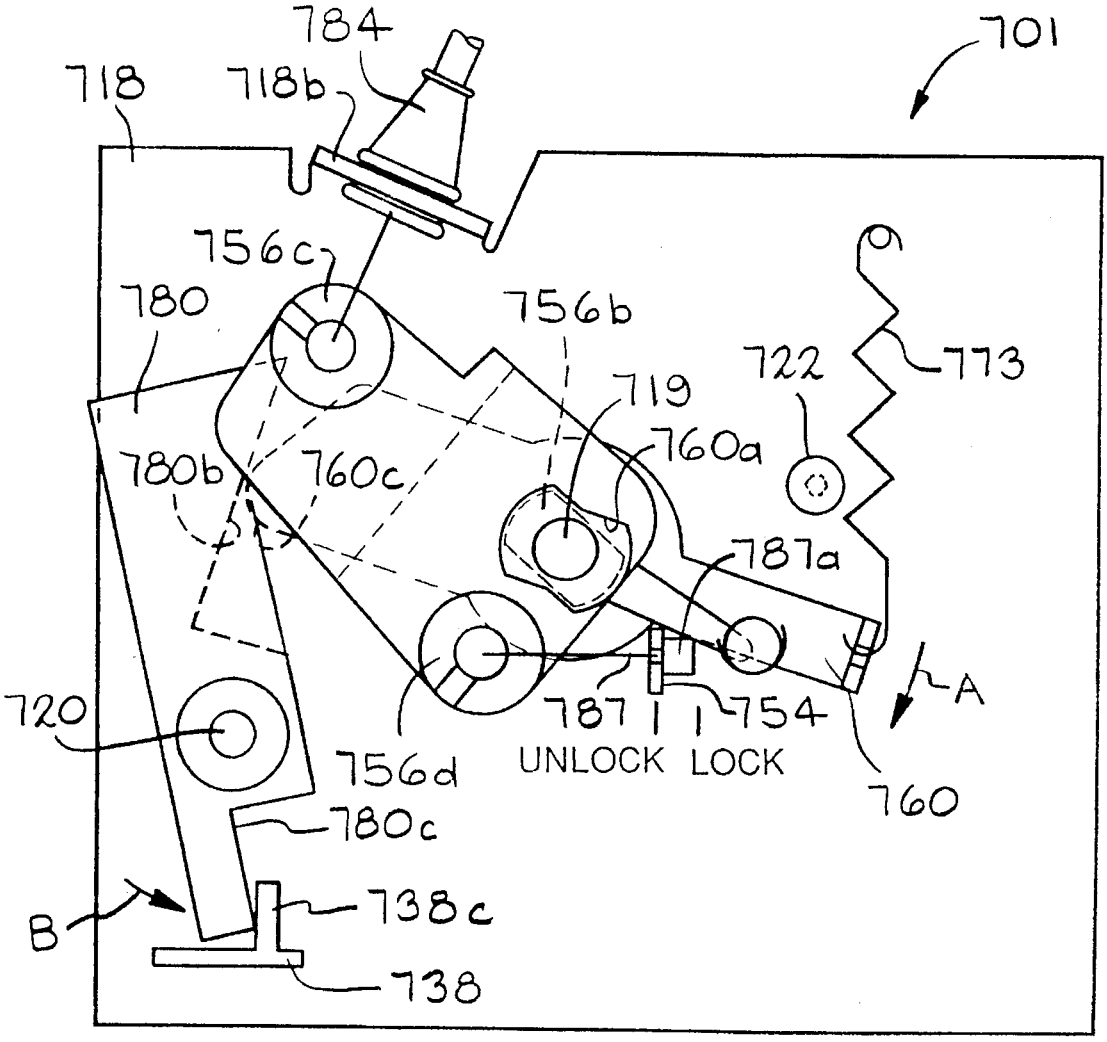
FIG. 32 is a view similar to FIGS. 30 and 31, except showing the latch assembly in an unlocked and released condition.

Referring now to FIG. 32, the latch assembly 701 is shown in the unlocked/release position thereof. The inner cable of the Bowden cable 784 is fully retracted by the operator using the interior operating handle (not shown). The bell crank lever 756 is fully rotated with the retaining boss 756 in its most upward position. The retaining boss 756*d* urges the cable spring pack 787*a* against the tab 754*c*, compressing the spring pack 787*a*. The interior lock lever 754 remains in the unlocked position, with the spring pack 787 accommodating the additional movement of the cable 787.

The continued rotation of the bell crank lever 756 from the unlocked position to the unlocked/release position causes the flat sides of the lug 756*b* of the bell crank lever 756 to engage the constricted waist portions of the lost central opening 760*a* of the lost motion lever 760. This engagement of the lost motion lever 760 by the lug 756*b* causes the lost motion lever 760 to rotate with the bell crank lever 756 in the direction of the arrow A. Rotation of the lost motion lever 760 causes the second arm 760*d* of the lost motion lever 760 to move away from the stop 722, stretching the return spring 773. The cam surface 760*c* of the lost motion lever 760 engages the cam surface 780*b* of the interior release lever 780, and thereby urges the interior release lever 780 to pivot about the pivot pin 720 in the direction of the arrow B. The second cam surface 780*c* of the interior release lever 780 consequently drives against the tab 738*c* of the actuator member 738, causing the actuator member 738 to rotate. Rotation of the actuator member 738, moves the associated coupling link (not shown) of the latch assembly 701, which was rotated into the coupled position thereof by movement of the interior lock lever 754 to the unlock position as described above. As with the previous embodiments, movement of the coupling link in the coupled position causes the pawl (not shown) to disengage the rotor (not shown), allowing the rotor to release the striker bolt (not shown).

When the operator releases the interior operating handle (not shown) at the other end of the Bowden cable 784, the return spring 773 will act to rotate the lost motion lever back against the stop 722. The lost motion lever will engage the lug 756*b* of the bell crank lever 756 to rotate the bell crank lever back to the unlocked position illustrated in FIG. 31, causing the interior cable of the Bowden cable 784 to extend partially outwardly. The interior release lever 780 is returned to its unpivoted position shown in FIG. 31 under the urging of the actuator member 738, which is spring returned to an unactuated position.

Another embodiment of the latch assembly of this invention is indicated generally at 801, and is illustrated in FIGS. 33 through 38. The latch assembly 801 is generally similar to the latch assembly 501 described above, and like reference numbers are used to indicate similar components. For example, as shown in FIGS. 33 through 35, and FIG. 38, the latch assembly 801 is constructed on the frame 514. The stepped pin 245 is fixed to the frame 514. The pawl 546 is pivotally mounted on the pivot pin 245, and is provided with a spur 550.

In the latch assembly 801, however, the link 510 is replaced with a generally similar link 810, and the index member 563 is replaced by a generally similar index member 863. The index member 863 is pivotally mounted on the pivot 562. The link 810 can be rotated by the index member 863 between an uncoupled position, shown in FIG. 33, and a coupled position, shown in FIGS. 34 and 35, as in the previously described embodiments. The generally rectangular link 810 has a first hook 810*a* at one end thereof, and a second hook 810*b* at the other end thereof. The hook 810*b* can engage the spur 550 on the pawl 546 when the link 810 is in the coupled position thereof. The link 810 has a central slot 810*c* through which the index member 863 extends. The spring 564 (not shown for clarity) is disposed in the slot to urge the end of the link 810 with the hook 810*b* away from the index member 863.

The hook 810*a* of the link 810 can be selectively coupled to an actuator member 838. The actuator member 838 is coupled to the exterior latch actuating mechanism for selective operation thereby.

Figure 34:
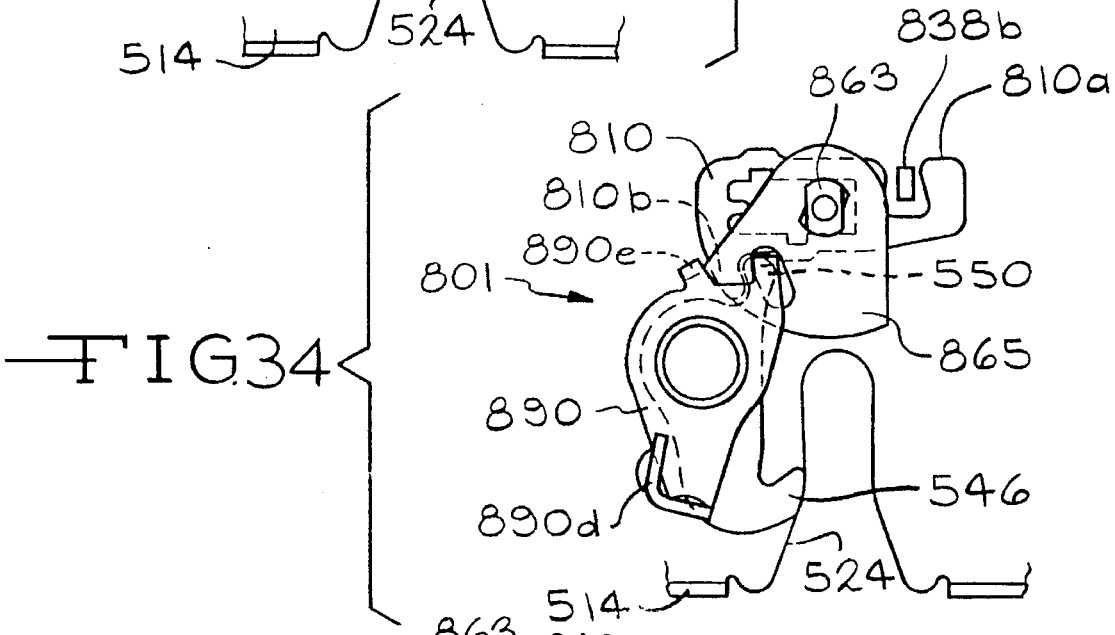
FIG. 34 is a view similar to FIG. 33, except showing the latch assembly in an unlocked condition.
Figure 35:
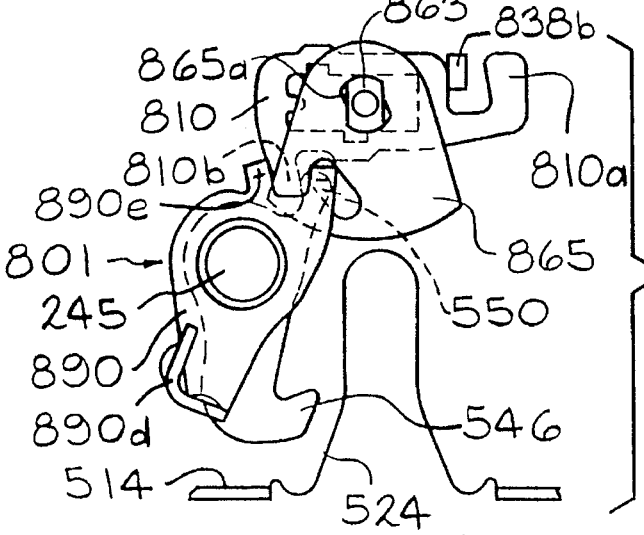
FIG. 35 is a view similar to FIGS. 33 and 34, except showing the latch assembly in an unlocked and released condition.
Figure 36:
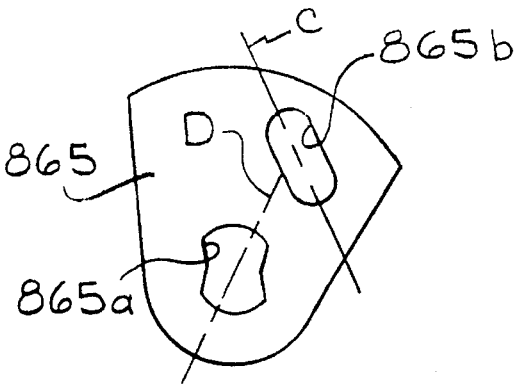
FIG. 36 is an enlarged view of the path lever shown in FIGS. 33 through 35.

A path lever 865, shown in detail in FIG. 36, is mounted on the index member 863 above the link 810, as seen in FIGS. 33 through 36, and 38. The path lever 865 has a first, hour glass-shaped opening 865*a* formed through one end thereof. The index member 863 extends through the opening 865*a*. The flattened sides of the index member 863 and the hour glass-shaped opening 865 cooperate to form a lost motion connection between the index member 863 and the path lever 865, the purpose of which is the same as the lost motion connection between the index member 563 and the lock/unlock lever 565 described above. The path lever 865 has a second, elongated oval opening 865*b* at the other end of the path lever 865 from the opening 865*a*. As shown in FIG. 36, the major axis C of the oval opening 865*b* extends at an angle to the axis D between the centers of the openings 865*a* and 865*b*, the purpose of which will be made clear below.

Figure 37:
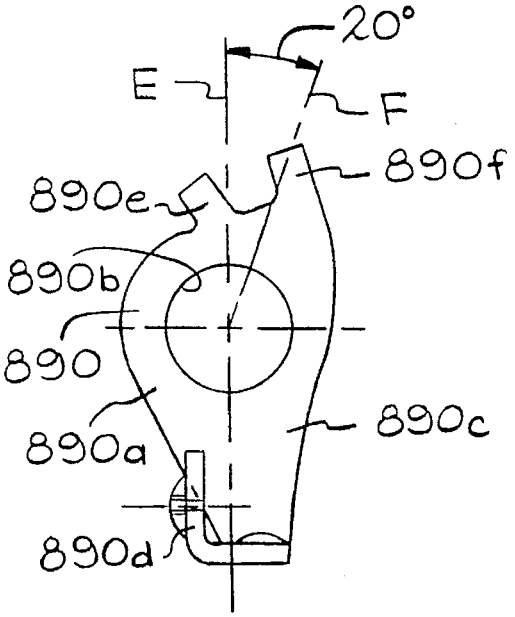
FIG. 37 is an enlarged view of the lock/unlock lever shown in FIGS. 33 through 35.

In the latch assembly 810, the interior latch and lock operating mechanisms are coupled to the latch assembly through a lock/unlock lever 890, shown in detail in FIG. 37. The lock/unlock lever 890 has an annular body 890*a* with a central opening 890*b* there through. The lock/unlock lever 890 has a first arm 890*c* with an upwardly (as viewed in FIG. 38) extending tab 890*d*. The tab 890*d* is adapted to be connected to a Bowden cable (not shown) or other suitable operating member, so that the lock/unlock lever 890 can be selectively rotated thereby. The lock/unlock lever 890 has a central axis E extending along the arm 890*c*.

Figure 38:
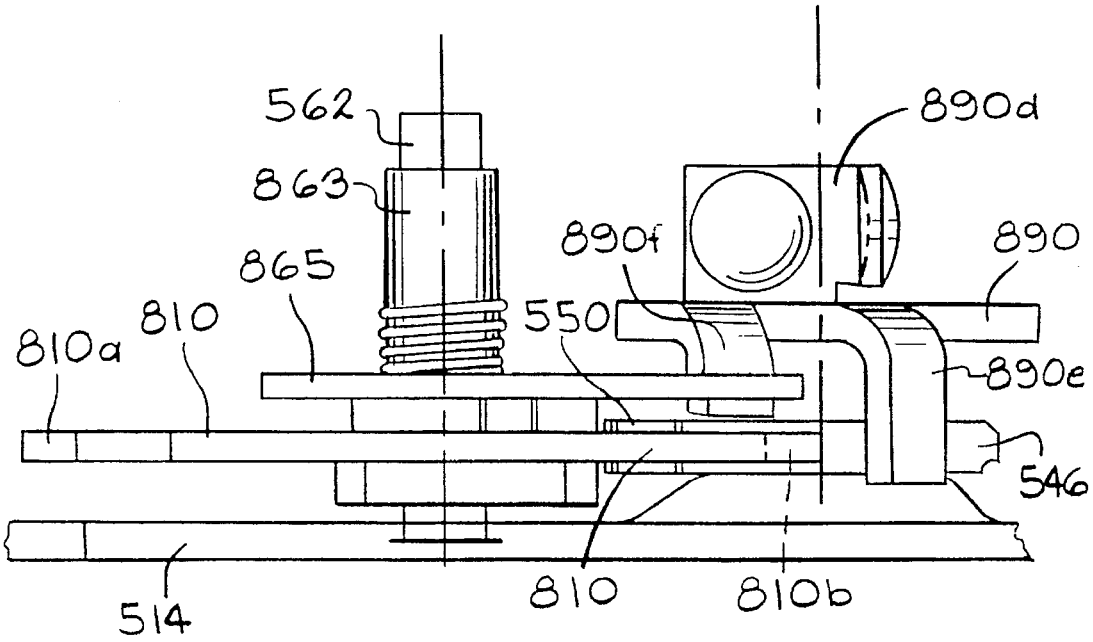
FIG. 38 is an elevational view of the latch assembly taken along the line 38—38 of FIG. 33.

Extending from the body 890*a* is a first downwardly curved arm 890*e*. The arm 890*e* extends outwardly from the body 890*a* at an angle to the axis E. As seen in FIG. 38, the arm 890*e* extends downwardly through the opening 865*b* of the path lever 865 so as to couple the path lever 865 and the lock/unlock lever 890. However, the arm 890*e* does not extend down so far as to reach the plane of rotation of the pawl 546. Thus, the lock/unlock lever 890 can pivot without the arm 890*e* directly engaging the pawl 546.

A second downwardly curved arm 890*f* extends outwardly from the body 890*a*. In one suitable arrangement, the downwardly extending portion of the arm 890*f* cooperates with the center of the opening 890*b* to define an axis F which extends at about a 20 degree angle to the axis E. The arm 890*f* is longer than the arm 890*e*, and extends downwardly to the plane of rotation of the link 810 and the pawl 546, for a purpose which will be described below. The lock/unlock lever 890 is pivotally mounted on the pivot pin 245, above the pawl 546, with the pivot pin 245 extending through the central opening 890*b*.

Figure 33:
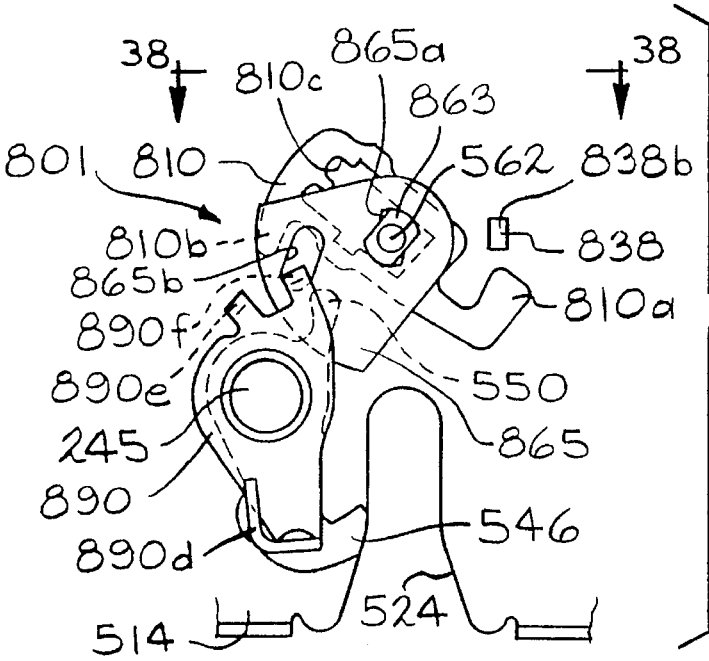
FIG. 33 is a partial plan view of another embodiment of a latch assembly according to this invention in which a cable-operated lock/unlock lever can be selectively coupled to operate the pawl, shown in a locked condition.

The latch assembly 801 is illustrated in a locked condition in FIG. 33. The lock unlock lever 890 is in the locked position thereof. The arm 890*f* of the lock/unlock lever 890 holds the path lever 865 in the lock position. The path lever 865, acting through the index member 863, holds the link 810 in the uncoupled position thereof. Of course, the index member 863 may be positioned to the lock position thereof to hold the link 810 in the uncoupled position thereof by other means such as an electric motor remote operator (not shown), such as that described above with respect to other similar embodiments of latch assemblies.

In FIG. 34, the lock/unlock lever 890 has been rotated to the unlock position, and has driven the path lever 865 to the unlock position thereof. Note that the arm 890*e* of the lock/unlock lever 890 moves from the radially outer end of the opening 865*b* (as seen in FIG. 33) to the radially inner end of the opening 865. Thus the opening 865*b* accommodates relative movement between the lock/unlock lever 890 and the path lever 865 during rotation thereof. As the path lever 865 rotates, the link 810 is urged thereby to the coupled position (after the initial lost motion of the connection between the index member 863 and the path lever 865). In the coupled position the hook 810*a* of the link 810 engages the actuator member 838, and the hook 810*b* of the link 801 engages the spur 550 of the pawl 545. The long arm 890*e* is disposed adjacent the other side of the hook 810*b*, such that the lock/unlock lever 890 is coupled to the spur 550 of the pawl 546 thereof through the hook 810*b* of the link 810. In this condition, the latch assembly 801 has been unlocked but the striker bolt (not shown) has not been released from the rotor (not shown).

In FIG. 35, the Bowden cable or other operating member connected to the lock/unlock lever 890 is operated further to cause the lock/unlock lever 890 to rotate to the release position thereof. This causes the long arm 890*e* of the lock/unlock lever 890 to press against the spur 550 of the pawl 546, causing the pawl 546 to release the rotor (not shown) and allow the striker bolt (not shown) to move out of the slot 524 of the frame 514. The components of the latch assembly 801 are returned from the position shown in FIG. 35 to the position shown in FIG. 34 by springs (not shown)

Of course the actuator member 838 could be operated in FIGS. 34 and 35 instead of the lock/unlock lever 890. Operation of the actuator member 838 pulls the hook 810 link such that the hook 810*b* drives into the spur 550 of the pawl 546, unlatching the latch assembly 801.

While the principle and mode of operation of the present invention have been explained and illustrated in its preferred embodiment, it must be understood that the present invention may be practiced otherwise than as specifically explained and illustrated without departing from its spirit or scope.

What is claimed is:

1. A vehicle door latch assembly adapted to be mounted to a vehicle structure to engage a striker bolt, comprising:

a pivotal rotor adapted in a first position to engage the striker bolt;

a pawl operatively coupled to said rotor and moveable between a blocking position retaining said rotor in said first position, and a release position permitting said rotor to move from said first position;

a link operatively coupled to said pawl and engaging said pawl in a coupled position, said link being selectively moveable between said coupled position and an uncoupled position in which said link is disengaged from said pawl;

a lever operatively coupled to said link to selectively move said link between said uncoupled position and said coupled position, said lever being further operatively coupled to said link such that, when said link is in said coupled position, said lever can be selectively operated to cause said link to move said pawl to said release position; and an actuator member operatively coupled to said link and engaging said link when said link is in said coupled position, said actuator member being disengaged from said link when said link is in said uncoupled position, said actuator member being selectively moveable between an unactuated position and an actuated position in which said actuator member causes, when said link is in said coupled position, said link to move said pawl to said release position.

2. The latch assembly of claim 1, including a detent operatively coupled to said link for selectively preventing movement of said link.

3. The latch assembly of claim 1, including a motor operatively coupled to said link for moving said link between said coupled position and said uncoupled position.

4. The latch assembly of claim 1, including a first lock operating mechanism coupled to said link to selectively move said link between said uncoupled position, said coupled position, and a double lock position in which said actuator member and said pawl are uncoupled, the latch assembly further including a second lock operating mechanism which may be selectively coupled to said link to selectively move said link between said uncoupled position and said coupled position, said link being uncoupled from said second lock operating mechanism in said double lock position.

5. The latch assembly of claim 4, including an index member coupled to said link for rotation therewith, said link being adapted to selectively move radially relative to said index member to move said pawl between said blocking position and said release position.

6. The latch assembly of claim 5 wherein said first lock operating mechanism and said second lock operating mechanism are coupled to said link through said index member.

7. The latch assembly of claim 1, wherein said lever is a first lever, the latch assembly further including a second lever operatively coupling said first lever to said link with a lost motion connection.

8. The latch assembly of claim 7 wherein said lost motion connection is between said first lever and said second lever, said second lever being selectively driven by said first lever to move said link between said coupled position and said uncoupled position, said lost motion connection allowing said first lever to move between a first position relative to said second lever and a second position relative to said second lever, said latch assembly further including an over-center spring coupling said first lever and said second lever, said over-center spring urging said first lever to one of said first position and said second position relative to said second lever.

9. The latch assembly of claim 8 wherein said first lever is a bell crank lever having an attachment to an operating cable for selectively rotating said first lever.

10. The latch assembly of claim 9 wherein said first lever pivots about a generally cylindrical boss having a pair of flattened opposed sides, said boss extending through an hour glass-shaped opening in said second lever to provide a lost motion connection between said first lever and said second lever.

11. The latch assembly of claim 7 wherein said first lever includes a first arm engaging said second lever to provide a driving connection between said first lever and said second lever, said first lever further having a second arm, said first lever being selectively moveable to urge said second arm into contact with said link when said link is in said coupled position, thereby urging said link to move said pawl to said release position.

12. The latch assembly of claim 11 wherein said first lever is provided with an attachment to an operating cable for selectively rotating said first lever in a plane of rotation of said first lever, said second lever rotating to define a first plane of rotation, said pawl rotating to define a second plane of rotation, said first arm extending from said plane of rotation of said first lever to said first plane of rotation, said second arm extending from said plane of rotation of said first lever to said second plane of rotation.

13. The latch assembly of claim 1 wherein said lever is a first lever, said first lever including an arm, said first lever being selectively moveable to urge said arm into contact with said link when said link is in said coupled position, thereby urging said link to move said pawl to said release position.

* * * * *